US006013421A

United States Patent [19]

Nakamura et al.

[11] Patent Number: 6,013,421

[45] Date of Patent: Jan. 11, 2000

[54] SILVER HALIDE PHOTOGRAPHIC LIGHT-SENSITIVE MATERIAL AND IMAGE-FORMING METHOD

[75] Inventors: Koki Nakamura; Kazuhiko Matsumoto, both of Minami-ashigara, Japan

[73] Assignee: Fuji Photo Film Co., Ltd., Kanagawa-ken, Japan

[21] Appl. No.: 08/897,159

[22] Filed: Jul. 18, 1997

[30] Foreign Application Priority Data

Jul. 19, 1996 [JP] Japan ..... 8-207708
Aug. 16, 1996 [JP] Japan ..... 8-216206

[51] Int. Cl.[7] ..... G03C 1/06; G03C 5/29; G03C 7/333

[52] U.S. Cl. ..... 430/351; 430/203; 430/264; 430/380; 430/440; 430/446; 430/467; 430/483; 430/543; 430/553; 430/555; 430/557; 430/955; 430/958; 430/959

[58] Field of Search ..... 430/380, 543, 430/351, 955, 262, 958, 203, 959, 224, 553, 435, 555, 440, 446, 557, 467, 483

[56] References Cited

U.S. PATENT DOCUMENTS

| | | | |
|---|---|---|---|
| 4,861,701 | 8/1989 | Burns et al. | 430/543 |
| 5,667,945 | 9/1997 | Takeuchi et al. | 430/380 |
| 5,683,853 | 11/1997 | Makuta et al. | 430/264 |
| 5,756,275 | 5/1998 | Takizawa et al. | 430/566 |

FOREIGN PATENT DOCUMENTS 8286340 11/1996 Japan .

*Primary Examiner*—Thorl Chea
*Attorney, Agent, or Firm*—Sughrue, Mion, Zinn, Macpeak & Seas, PLLC

[57] ABSTRACT

There is disclosed a silver halide photographic light-sensitive material containing a color-developing agent of formula (I) and a coupler of formula (II), in at least one photographic constitutional layer:

formula (I)

formula (II)

Cp-(Time)$_t$-PUG

In formula (I), Z is a carbamoyl, acyl, alkoxycarbonyl, or aryloxycarbonyl group, and Q is a group of atoms that, together with the C, form an unsaturated ring. In formula (II), Cp is a coupler residue, Time is a group that releases PUG upon released from Cp by coupling reaction, PUG is a photographically useful group, and t is 0, 1, 2, or 3. There is also disclosed a silver halide photographic light-sensitive material containing a color-developing agent of formula (I), a dye-forming coupler, and a non-dye-forming coupler (that is unsubstituted on its active site), in at least one photographic constitutional layer. There is further disclosed methods for forming an image using the light-sensitive materials.

4 Claims, No Drawings

SILVER HALIDE PHOTOGRAPHIC LIGHT-SENSITIVE MATERIAL AND IMAGE-FORMING METHOD

FIELD OF THE INVENTION

The present invention relates to a novel technique of releasing a photographically useful group in a silver halide photographic light-sensitive material. More specifically, the present invention relates to a novel silver halide photographic light-sensitive material that comprises a novel color-developing agent (reducing agent for color formation) and a coupler capable of reacting with an oxidation product of the color-developing agent, wherein the light-sensitive material uses a technique of releasing a photographically useful group. Further, the present invention relates to a novel method for forming an image by using the above technique.

Further, the present invention relates to a silver halide photographic light-sensitive material containing a novel color-developing agent. Particularly, the present invention also relates to a silver halide photographic light-sensitive material that gives an image that has less color muddiness, that is bright (sharp and clear), and that has good white background.

BACKGROUND OF THE INVENTION

In silver halide photographic light-sensitive materials, techniques wherein a photographically useful group is released as a function of development, have long been known. Among them, in particular, the technique of releasing a photographically useful group through a coupling reaction of a coupler with a color-developing agent is practically used for, for example, color negative films that use DIR couplers. This technique is widely used for the purpose of improving the graininess, sharpness, and color reproduction of images, and that technique has been known as a quite important technique.

In recent years, for the purposes of making the development processing rapid and reducing the influence of processing waste solutions on the earth's environment, a method is suggested wherein a developing solution is not used; rather a color-developing agent is built in a light-sensitive material, and the light-sensitive material is subjected to the so-called activator process, wherein it is processed with a processing solution that does not contain a developing agent. Para-phenylenediamine derivatives widely used as a color-developing agent are an important developing agent in that their oxidation products have chemical structures that cause coupling reaction with couplers having a photographically useful group bonded at the coupling site, to release the said photographically useful group. However, since para-phenylenediamine derivatives have extremely low stability of oxidation resistance, and it is difficult to build them into light-sensitive materials stably, the intended purpose cannot be achieved in the above activator process. To overcome this problem, for examples, as described in JP-A-5-257225 ("JP-A" means unexamined published Japanese patent application), the so-called precursor means is suggested, wherein a para-phenylenediamine derivative is built, in a stable form, in a light-sensitive material, and it is activated during development processing. However, it is difficult to simultaneously make the precursor itself stable and to allow the precursor to be converted to the intended product quickly during processing.

As a color-developing agent that can be advantageously built in, a sulfonylhydrazine derivative described in U.S. Pat. No. 5,284,739 is known. Although this color-developing agent has very high stability of oxidation resistance and it can be built in a light-sensitive material, this color-developing agent is not practically used to release a photographically useful group.

Thus, a practical technique, wherein a photographically useful group is released as a function of development of a silver halide, through use of a combination of a color-developing agent that can be built in with a coupler, is not yet known, and there is a strong need in the art for such a technique.

On the other hand, in color photographic light-sensitive materials, when the photographic material is exposed to light image-wise and then subjected to color development, the oxidized color developing agent and couplers are reacted, and an image of dyes is formed. In this system, color reproduction by the subtractive color process is used, and, to reproduce blue, green, and red colors, dye images are formed that are yellow, magenta, and cyan in color, respectively complementary to blue, green, and red.

Color development is accomplished by immersing the light-exposed color photographic light-sensitive material in an aqueous alkali solution in which a color-developing agent is dissolved (a developing solution). However, the color-developing agent in an aqueous alkali solution is unstable and liable to deteriorate with a lapse of time, and there is the problem that the developing solution must be replenished frequently in order to retain stable developing performance. Further, used developing solutions containing a color-developing agent are required to be discarded, and this, together with the above frequent replenishment, creates a serious problem regarding the treatment of used developing solutions that are discharged in large volume. Thus, low-replenishment and reduced discharge of developing solutions are strongly demanded.

One effective measure proposed for realizing low-replenishment and reduced discharge of developing solutions is a method wherein an aromatic primary amine developing agent or its precursor is built in a hydrophilic colloid layer of a color photographic material. Examples of the developing agents that can be built in include compounds described, for example, in GB-803 783, U.S. Pat. Nos. 3,342,597, 3,719,492, and 4,060,418, GB-1 069 061, West German Patent No. 1 159 758, JP-B-58-14671 ("JP-B" means examined Japanese patent publication) and 58-14672, and JP-A-57-76543 and 59-81643. However, color photographic materials having these aromatic primary amine developing agents or their precursors built therein have a defect that satisfactory color formation is not attained when they are chromogenically developed. Another effective measure proposed is a method wherein a sulfonylhydrazine-type developing agent is built in a hydrophilic colloid layer of a color photographic material, and examples of the color-developing agent that can be built in include compounds described, for example, in EP-A-545 491 and 565 165. However, even the developing agent mentioned therein cannot attain satisfactory color formation when color-developed; and further, when, for this sulfonylhydrazine-type developing agent, use is made of a two-equivalent coupler, there is the problem that color formation hardly takes place. In comparison with four-equivalent couplers, two-equivalent couplers have the advantages that stain due to couplers can be reduced, and that the activity of the couplers can be easily adjusted by the substituent. Accordingly, there is strong need for a developing agent that, even when built-in, can provide satisfactory color formation when developed, and that also can show good color-formation property in developing an image, even when a two-equivalent coupler is used.

Further, there was the problem that unfavorable color muddiness or rise of density of the white background were occurred, because of the increase of minimum density due to fog at developing process.

SUMMARY OF THE INVENTION

Therefore, a first object of the present invention is to develop a color-developing agent that has satisfactory oxidation resistance stability and that can be stably built in a light-sensitive material, and the agent's oxidation product can react with a coupler to release, quickly, a photographically useful group as a function of development of a silver halide.

A second object of the present invention is to provide a light-sensitive material that comprises such a color-developing agent and a coupler and that can release a photographically useful group as a function of the development of a silver halide, thereby solving a variety of problems (needs). Herein the variety of problems includes improvement in graininess of images, improvement in sharpness, improvement in color reproduction, development inhibition, development acceleration, formation of transferred dye images by diffusion dyes, acceleration of bleaching and fixing, color masking, and improvement in sensitivity; and in order to solve the problems, as the photographically useful group to be released, a development inhibitor, a development accelerator, a diffusion dye, a bleach accelerator, a fixation accelerator, a water-soluble dye, a sensitizer, or the like can be suitably selected and employed.

Still another object of the present invention is to provide a means of preventing the color contamination and the minimum density of a light-sensitive material from increasing without adversely influencing the preservability or the like of the light-sensitive material, thereby providing a light-sensitive material having less color muddiness (color contamination) and low density of the white background.

Other and further objects, features, and advantages of the invention will appear more fully from the following description.

DETAILED DESCRIPTION OF THE INVENTION

The above objects of the present invention have been attained by the following means.

(1) A silver halide light-sensitive material, containing a developing agent represented by the following formula (I) and a coupler represented by the following formula (II) (preferably, the silver halide light-sensitive material contains the compound of formula (I) and the compound of formula (II) in at least one hydrophilic colloid layer provided on a base.):

formula (I)

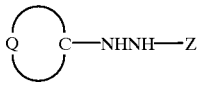

formula (II)

$Cp\text{-}(Time)_t\text{-}PUG$

In formula (I), C represents a carbon atom, Z represents a carbamoyl group, an acyl group, an alkoxycarbonyl group, or an aryloxycarbonyl group, and Q represents a group of atoms that, together with the C, form an unsaturated ring. In formula (II), Cp represents a group that undergoes a coupling reaction with the oxidation product of the compound represented by formula (I), $(Time)_t$—PUG represents a group that is released from Cp as a result of the coupling reaction, Time represents a group that releases PUG upon released from Cp, PUG represents a photographically useful group, and t is 0, 1, 2, or 3.

(2) A method for forming an image, comprising subjecting the silver halide light-sensitive material described in the above (1) to development.

(3) The method for forming an image as stated in the above (2), wherein the silver halide light-sensitive material is subjected to heat-development.

(4) The method for forming an image as stated in the above (2), wherein the silver halide light-sensitive material is subjected to development in a solution.

(5) The method for forming an image as stated in the above (2), wherein the silver halide light-sensitive material is subjected to development under alkali generation from a slightly soluble metal salt and a complexing agent of the said metal salt.

(hereinafter, the light-sensitive material of the above (1) and the methods of the above (2) to (5) are referred to as the first invention of the present invention.)

(6) A silver halide light-sensitive material, containing a color-developing agent represented by the above formula (I) and a coupler for color formation (a dye-forming coupler) that undergoes the coupling reaction with the oxidation product of the said color-developing agent to form a dye image, in at least one hydrophilic colloid layer provided on a base, further containing, in combination with the said coupler for color formation, a coupler that undergoes the coupling reaction with the oxidation product of the said color-developing agent but does not form a dye (color) enough to substantially contribute to the image density (which coupler is hereinafter referred to as a non-dye-forming coupler).

(7) A method for forming an image, comprising subjecting the silver halide light-sensitive material described in the above (6) to development.

(8) The method for forming an image as stated in the above (7), wherein the silver halide light-sensitive material is subjected to heat-development.

(9) The method for forming an image as stated in the above (7), wherein the silver halide light-sensitive material is subjected to development in a solution. (hereinafter, the light-sensitive material of the above (6) and the methods of the above (7) to (9) are referred to as the second invention of the present invention.)

In this specification, "the present invention" denotes both the above first and second inventions, unless otherwise specified.

The compound represented by formula (I) used in the present invention will be explained more in detail.

In formula (I), Z represents a carbamoyl group, an acyl group, an alkoxycarbonyl group, or an aryloxycarbonyl group. Preferred among them is a carbamoyl group, and a carbamoyl group, in which at least one substituent of two substituents on the nitrogen atom of the carbamoyl group is a hydrogen atom, is particularly preferred.

The carbamoyl group preferably has from 1 to 50 carbon atoms, and more preferably 1 to 40. Specific examples include a carbamoyl group, a methylcarbamoyl group, an ethylcarbamoyl group, an n-propylcarbamoyl group, a sec-butylcarbamoyl group, an n-octylcarbamoyl group, a cyclohexylcarbamoyl group, a tert-butylcarbamoyl group, a dodecylcarbamoyl group, a 3-dodecyloxypropylcarbamoyl group, an octadecylcarbamoyl group, a 3-(2,4-tertpentylphenoxy)-propylcarbamoyl group, a 2-hexyldecylcarbamoyl group, a phenylcarbamoyl group, a 4-dodecyloxyphenylcarbamoyl group, a 2-chloro-5-dodecyloxycarbonylphenylcarbamoyl group, a naphthylcarbamoyl group, a 3-pyridylcarbamoyl group, a 3,5-bis-octyloxycarbonylphenylcarbamoyl group, a 3,5-bis-tetradecyloxyphenylcarbamoyl group, a benzyloxycarbamoyl group, and a 2,5-dioxo-1-pyrrolidinylcarbamoyl group.

The acyl group preferably has from 1 to 50 carbon atoms, and more preferably from 1 to 40. Specific examples include a formyl group, an acetyl group, a 2-methylpropanoyl group, a cyclohexylcarbonyl group, an n-octanoyl group, a 2-hexyldecanoyl group, a dodecanoyl group, a chloroacetyl group, a trifluoroacetyl group, a benzoyl group, a 4-dodecyloxybenzoyl group, a 2-hydroxymethylbenzoyl group, and a 3-(N-hydroxy-N-methylaminocarbonyl) propanoyl group.

The alkoxycarbonyl group and the aryloxycarbonyl group, respectively, preferably have from 2 to 50 carbon atoms, and more preferably from 2 to 40. Specific examples include a methoxycarbonyl group, an ethoxycarbonyl group, an isobutyloxycarbonyl group, a cyclohexyloxycarbonyl group, a dodecyloxycarbonyl group, a benzyloxycarbonyl group, a phenoxycarbonyl group, a 4-octyloxyphenoxycarbonyl group, a 2-hydroxymethylphenoxycarbonyl group, and a 4-dodecyloxyphenoxycarbonyl group.

Z in formula (I) is released from formula (I) in the dye formation reaction process at the time of development. Accordingly, to allow a photographically useful group to be released as a result of color formation, Z may contain a photographically useful group.

Q represents a group of atoms that form an unsaturated ring together with the C, in which the unsaturated ring formed is preferably a 3- to 8-membered ring, and more preferably a 5- to 6-membered ring. This unsaturated ring may be a heterocyclic ring. Preferred examples of the unsaturated ring are a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, and a thiophene ring, and a condensed ring formed from the above-mentioned rings condensed with each other is also preferably used.

Further, the above-mentioned ring may have a substituent. Examples of the substituent include a straight-chain or branched, chain or cyclic alkyl group having 1 to 50 carbon atoms (e.g. trifluoromethyl, methyl, ethyl, propyl, heptafluoropropyl, isopropyl, butyl, t-butyl, t-pentyl, cyclopentyl, cyclohexyl, octyl, 2-ethylhexyl and dodecyl); a straight-chain or branched, chain or cyclic alkenyl group having 2 to 50 carbon atoms (e.g. vinyl, 1-methylvinyl, and cyclohexene-1-yl), an alkynyl group having 2 to 50 total carbon atoms (e.g. ethynyl and 1-propynyl), an aryl group having 6 to 50 carbon atoms (e.g. phenyl, naphthyl, and anthryl), an acyloxy group having 1 to 50 carbon atoms (e.g. acetoxy, tetradecanoyloxy, benzoyloxy, and picolinoyloxy), a carbamoyloxy group having 1 to 50 carbon atoms (e.g. N,N-dimethylcarbamoyloxy and morpholinocarbonyloxy), a carbonamide group having 1 to 50 carbon atoms (e.g. formamide, N-methylacetoamide, acetoamide, N-methylformamide, and benzamide), a sulfonamide group having 1 to 50 carbon atoms (e.g. methanesulfonamide, dodecanesulfonamide, benzenesulfonamide, and p-toluenesulfonamide), a carbamoyl group having 1 to 50 carbon atoms (e.g. N-methylcarbamoyl, N,N-diethylcarbamoyl, and N-mesylcarbamoyl), a sulfamoyl group having 0 to 50 carbon atoms (e.g. N-butylsulfamoyl, N,N-diethylsulfamoyl, N-methyl-N-(4-methoxyphenyl) sulfamoyl, and decanoylsulfamoyl), an alkoxy group having 1 to 50 carbon atoms (e.g. methoxy, propoxy, isopropoxy, octyloxy, t-octyloxy, dodecyloxy, and 2-(2,4-di-t-pentylphenoxy)ethoxy), an aryloxy group having 6 to 50 carbon atoms (e.g. phenoxy, 4-methoxyphenoxy, and naphthoxy), an aryloxycarbonyl group having 7 to 50 carbon atoms (e.g. phenoxycarbonyl and naphthoxycarbonyl), an alkoxycarbonyl group having 2 to 50 carbon atoms (e.g. methoxycarbonyl and t-butoxycarbonyl), an N-acylsulfamoyl group having 1 to 50 carbon atoms (e.g. N-tetradecanoylsulfamoyl and N-benzoylsulfamoyl), an alkylsulfonyl group having 1 to 50 carbon atoms (e.g. methanesulfonyl, octylsulfonyl, 2-methoxyethylsulfonyl and 2-hexyldecylsulfonyl), an arylsulfonyl group having 6 to 50 carbon atoms (e.g. benzenesulfonyl, p-toiuenesulfonyl, and 4-phenylsulfonylphenylsulfonyl), an alkoxycarbonylamino group having 2 to 50 carbon atoms (e.g. ethoxycarbonylamino), an aryloxycarbonylamino group having 7 to 50 carbon atoms (e.g. phenoxycarbonylamino and naphthoxycarbonylamino), an amino group having 0 to 50 carbon atoms (e.g. amino, methylamino, diethylamino, diisopropylamino, anylino, and morpholino), a cyano group, a nitro group, a carboxyl group, a hydroxy group, a sulfo group, a mercapto group, an alkylsulfinyl group having 1 to 50 carbon atoms (e.g. methanesulfinyl and octanesulfinyl), an arylsulfinyl group having 6 to 50 carbon atoms (e.g. benzenesulfinyl, 4-chlorophenylsulfinyl, and p-toluenesulfinyl), an alkylthio group having 1 to 50 carbon atoms (e.g. methylthio, octylthio, and cyclohexylthio), an arylthio group having 6 to 50 carbon atoms (e.g. phenylthio, naphthylthio, and 5-tetrazolylthio), a ureido group having 1 to 50 carbon atoms (e.g. 3-methylureido, 3,3-dimethylureido, and 1,3-diphenylureido), a heterocyclic group having 2 to 50 carbon atoms (a 3- to 12-membered monocyclic or condensed ring containing, for example, at least one nitrogen, oxygen, or sulfur as hetero atoms, e.g. 2-furyl, 2-pyranyl, 2-pyridyl, 2-thienyl, 2-imidazolyl, morpholino, 2-quinolyl, 2-benzimidazolyl, 2-benzothiazolyl and 2-benzooxazolyl), an acyl group having 1 to 50 carbon atoms (e.g. acetyl, benzoyl and trifluoroacetyl), a sulfamoylamino group having 0 to 50 carbon atoms (e.g. N-butylsulfamoylamino and N-phenylsulfamoylamino), a silyl group having 3 to 50 carbon atoms (e.g. trimethylsilyl, dimethyl-t-butylsilyl and triphenylsilyl) and a halogen atom (e.g. fluorine atom, chlorine atom, and bromine atom). The substituent described above may have a substituent, and those substituents mentioned above can be mentioned as examples for such a substituent.

The number of carbon atoms of the substituent is preferably 50 or below, more preferably 42 or below, and further preferably 30 or below.

When the ring formed with Q and the C consists only of carbon atoms, on which the substituents are present (e.g. a benzene ring, a naphthalene ring, and an anthrathene ring), the sum of the σ values of the Hammett's substituent constant (σp value is used when the substituent is at 1,2, 1,4, . . . relation for the C and σm value is used when the substituent is at 1,3, 1,5, . . . relation for the C) for all substituents is preferably 0.8 or more but 4.0 or below, more preferably 1.2 or more but 3.5 or below, and most preferably 1.5 or more but 3.0 or below.

Herein, Hammett substituent constants σp and σm are described in detail in such books as "Hammett no Hosoku/Kozo to Hannousei," written by Naoki Inamoto (Maruzen); "Shin-jikken Kagaku-koza 14/Yukikagoubutsu no Gosei to Hanno V," page 2605 (edited by Nihonkagakukai, Maruzen); "Riron Yukikagaku Kaisetsu," written by Tadao Nakaya, page 217 (Tokyo Kagakudojin); and "Chemical Review" (Vol. 91), pages 165 to 195 (1991).

Now, specific examples of the color-developing agent represented by formula (I) are described below, but the scope of the present invention is not limited to them.

(1)

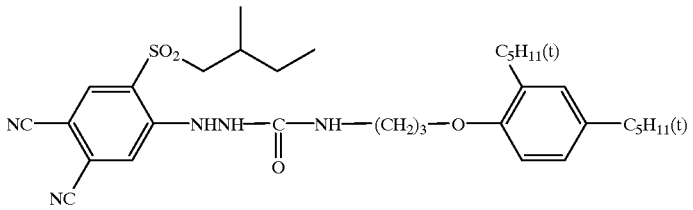

(2)

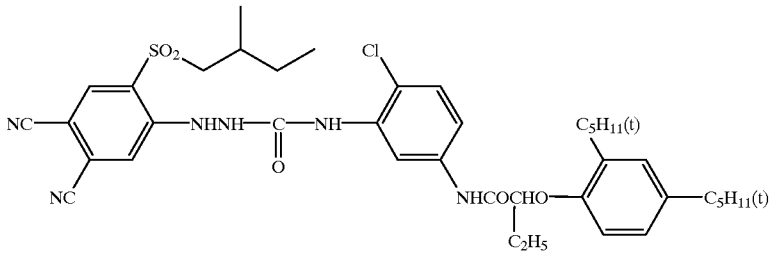

(3)

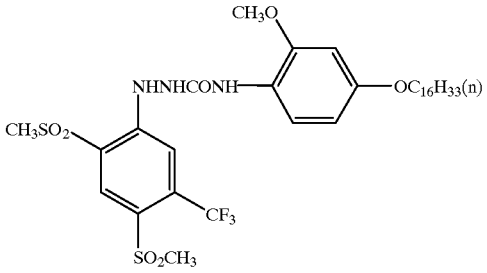

(4)

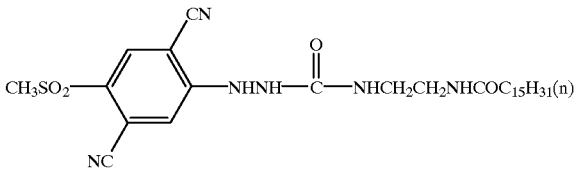

(5)

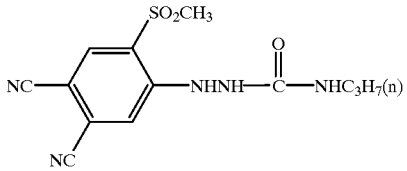

(6)

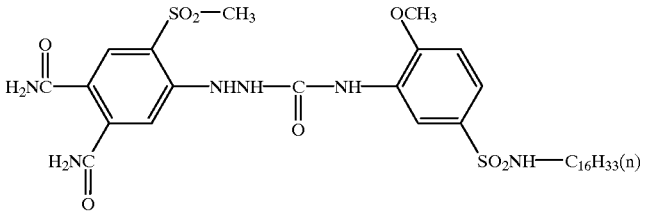

-continued
(7)
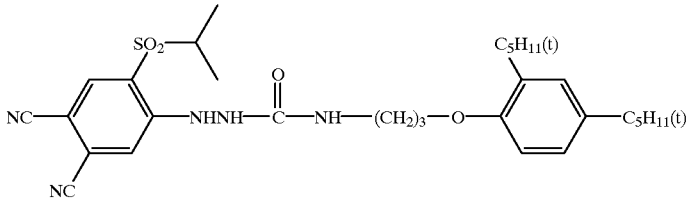
(8)
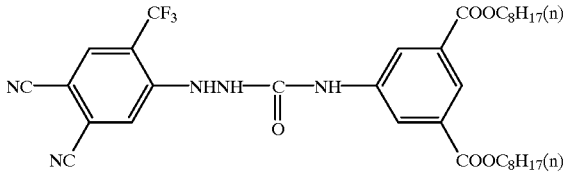
(9)
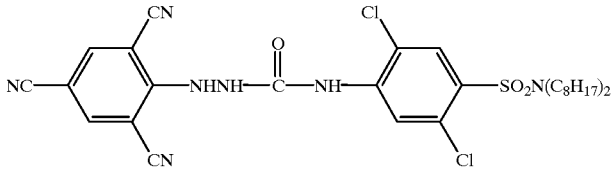
(10)
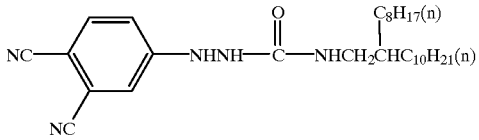
(11)
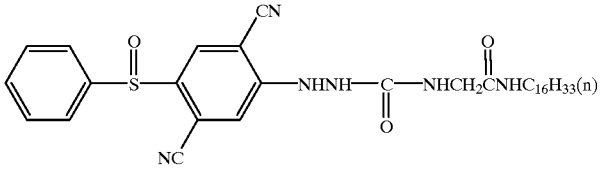
(12)
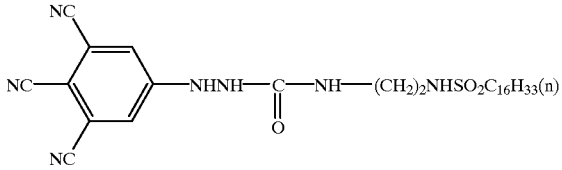
(13)
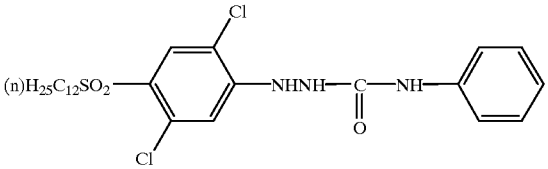
(14)
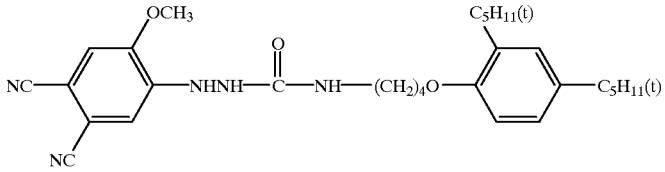

-continued
(15)
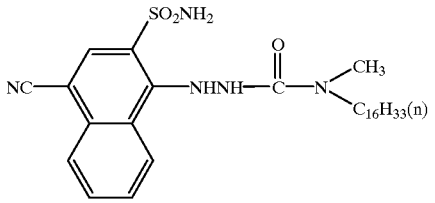
(16)
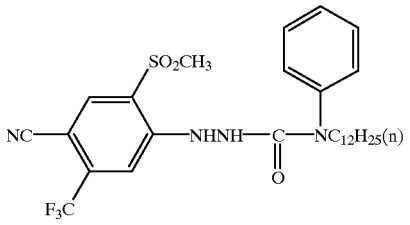
(17)
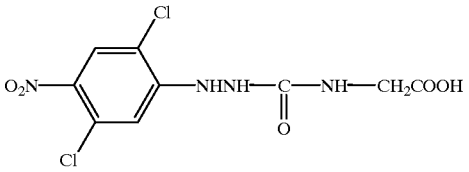
(18)
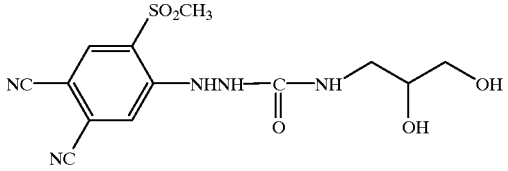
(19)
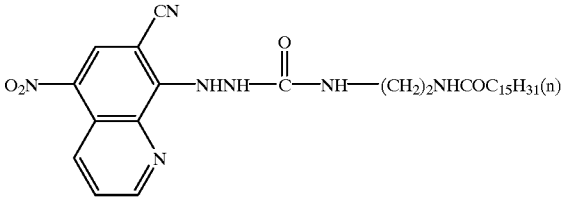
(20)
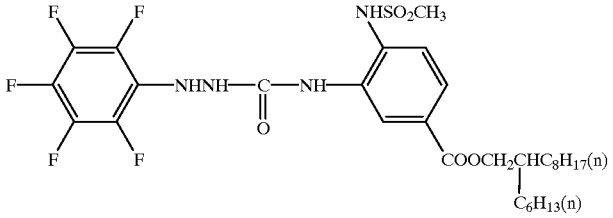
(21)
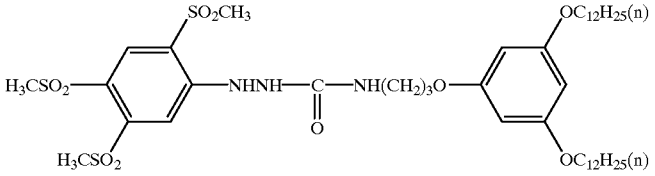

-continued
(22)
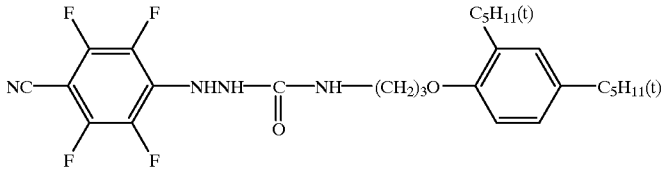
(23)
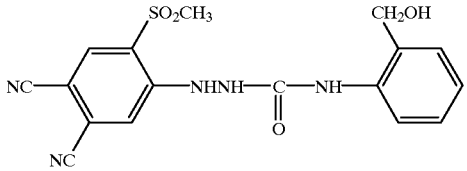
(24)
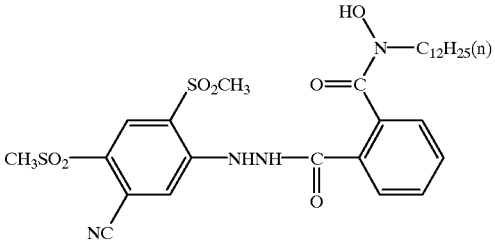
(25)
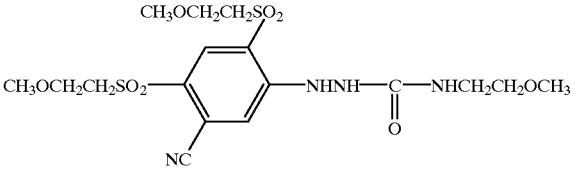
(26)
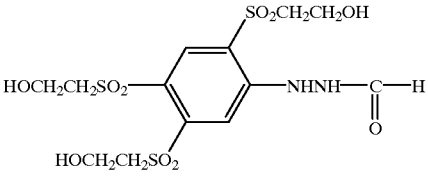
(27)
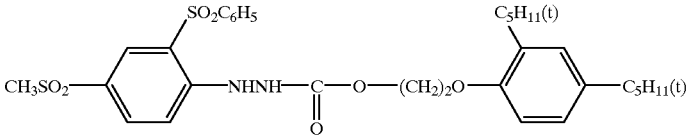
(28)
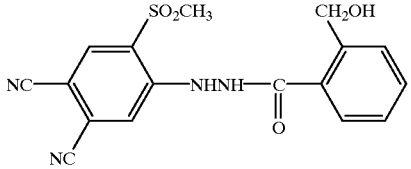
(29)
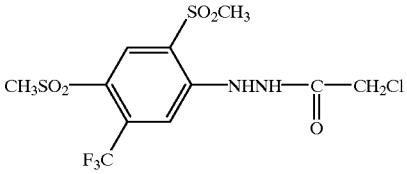

-continued
(30)
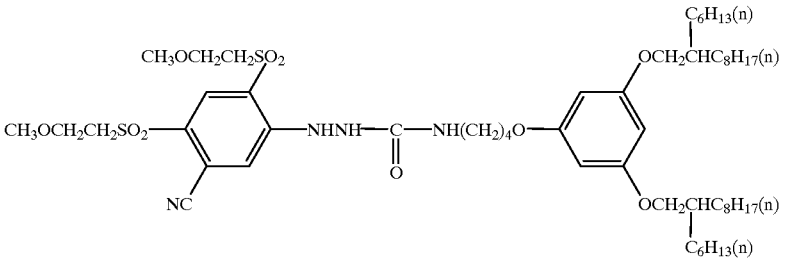
(31)
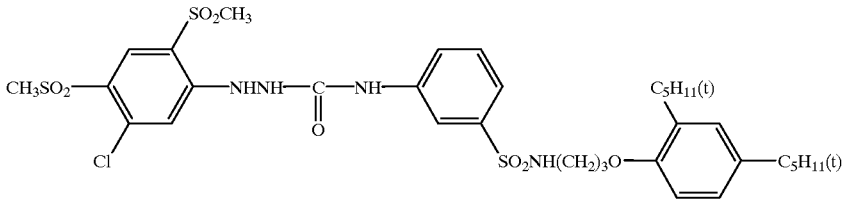
(32)
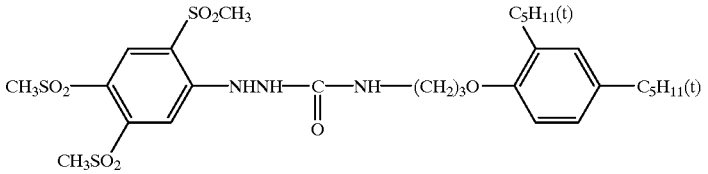
(33)
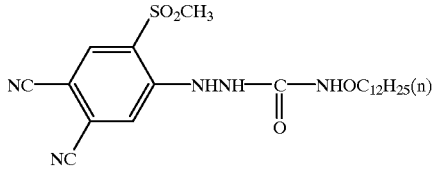
(34)
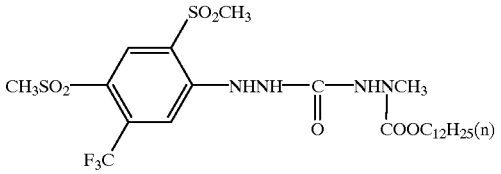
(35)
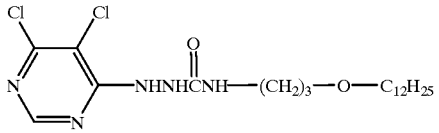
(36)
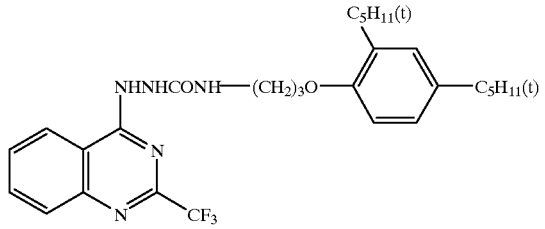

-continued
(37)
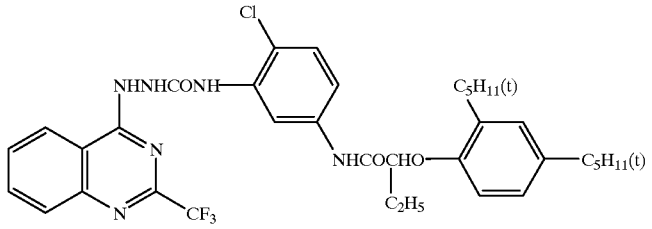
(38)
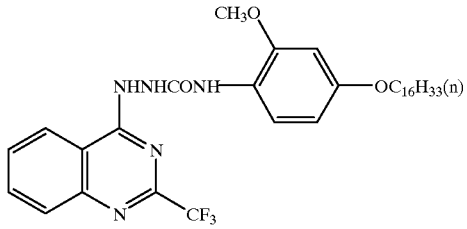
(39)
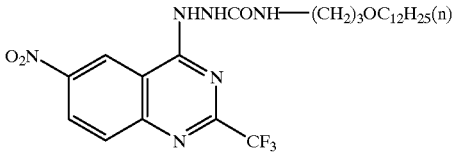
(40)
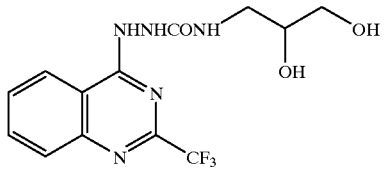
(41)
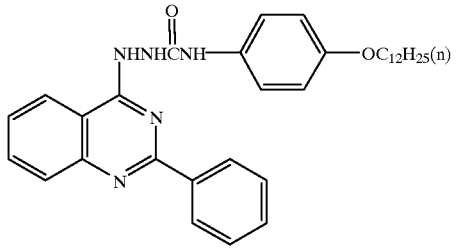
(42)
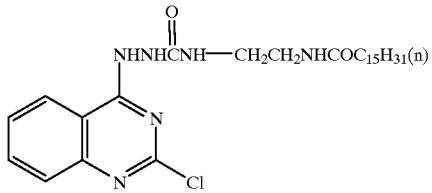
(43)
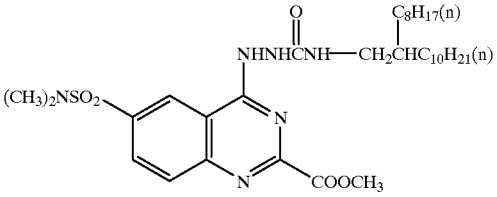

-continued
(44)
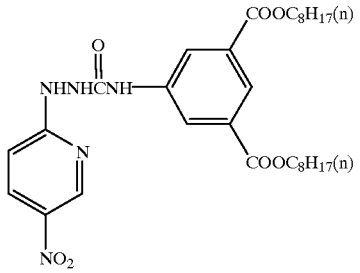
(45)
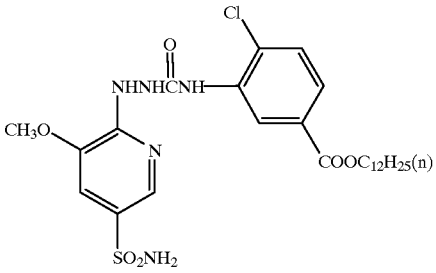
(46)
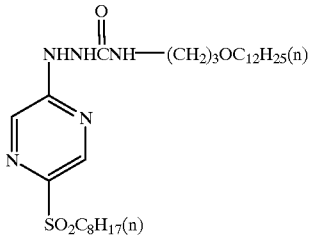
(47)
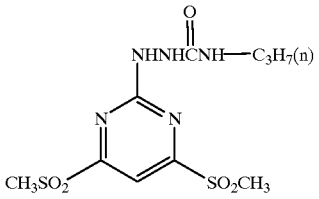
(48)
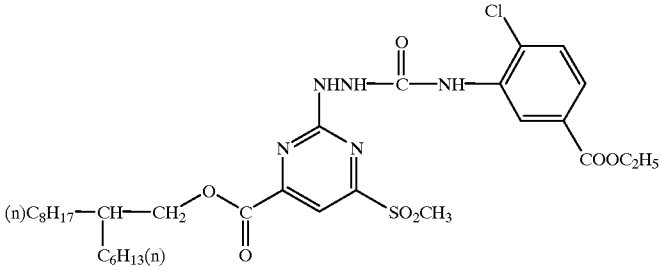

-continued
(49)
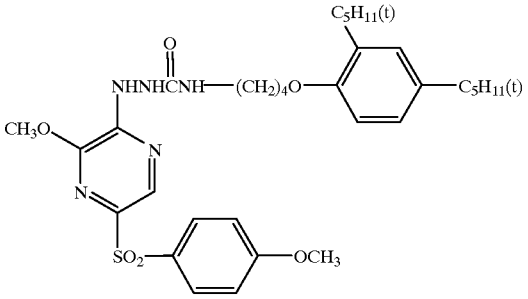
(50)
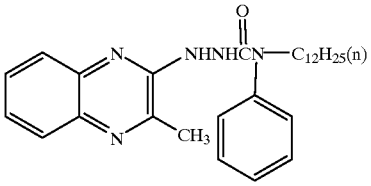
(51)
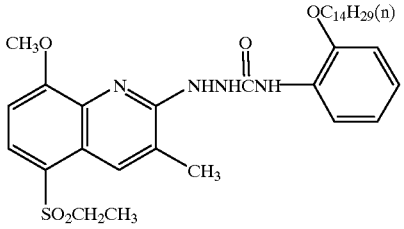
(52)
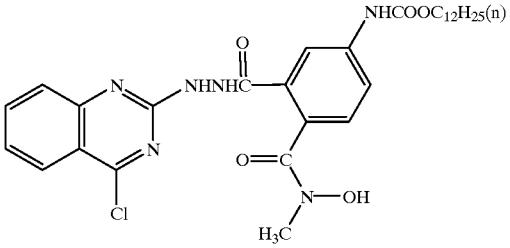
(53)
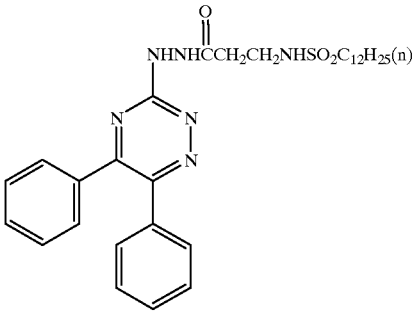
(54)
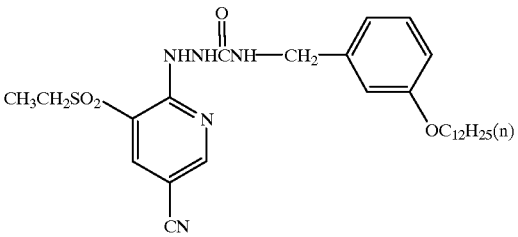

-continued
(55)
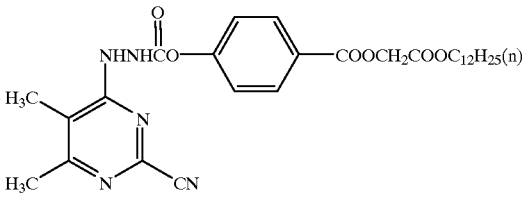
(56)
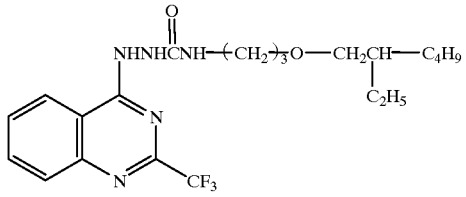
(57)
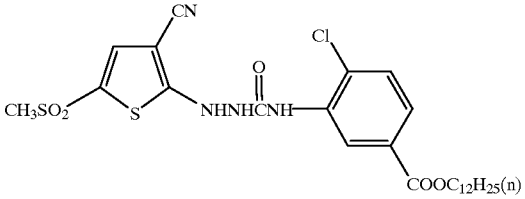
(58)
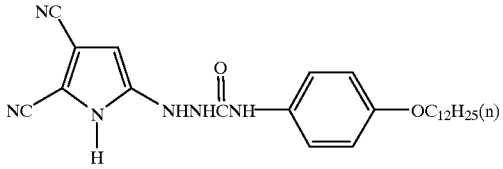
(59)
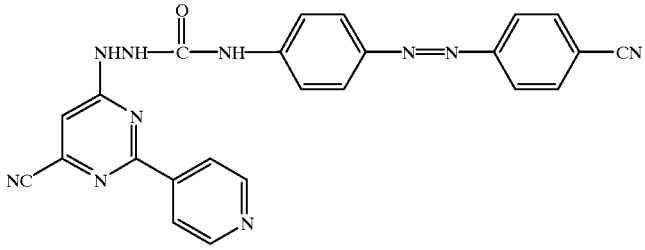
(60)
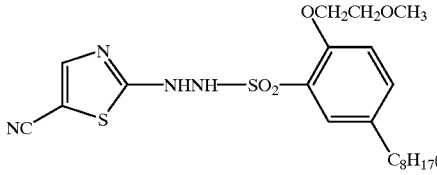
(61)
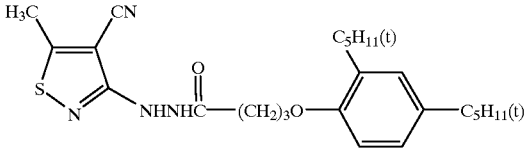

-continued
(62)
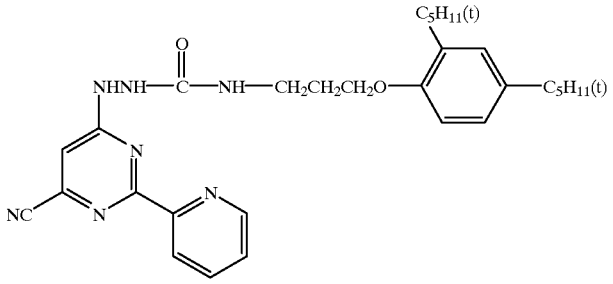
(63)
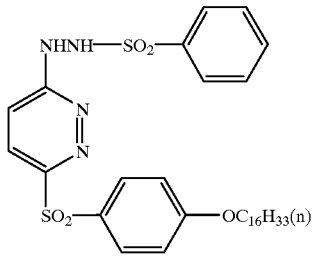
(64)
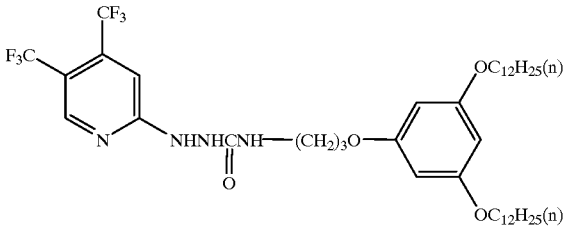
(65)
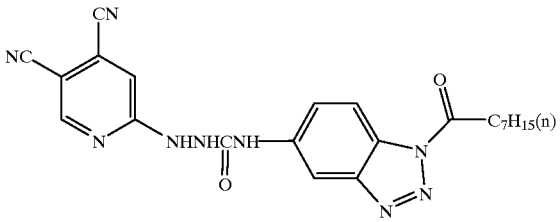
(66)
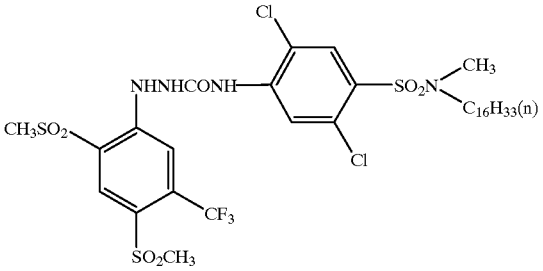
(67)
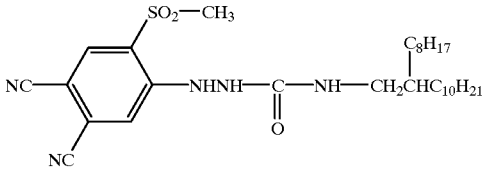

-continued
(68)
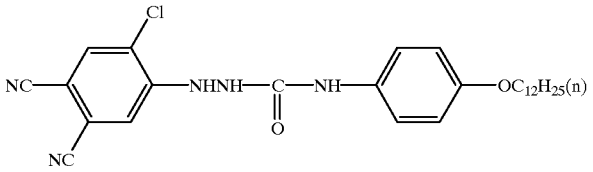
(69)
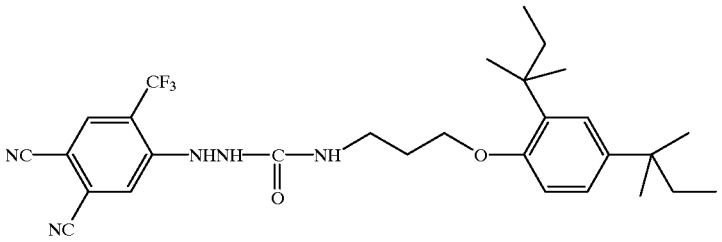
(70)
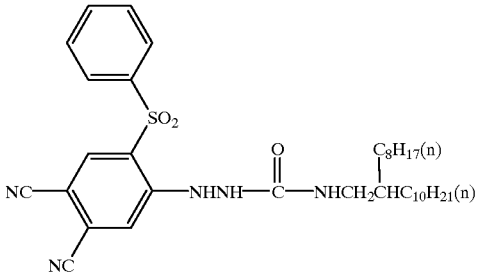
(71)
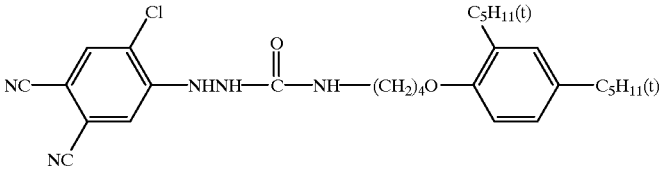
(72)
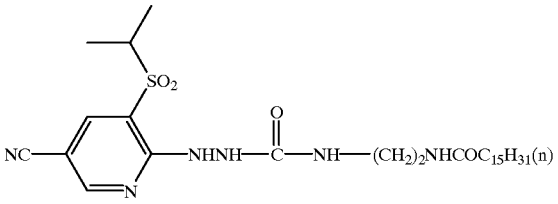
(73)
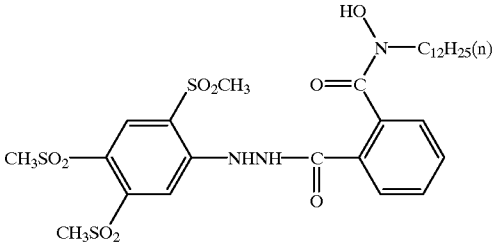
(74)
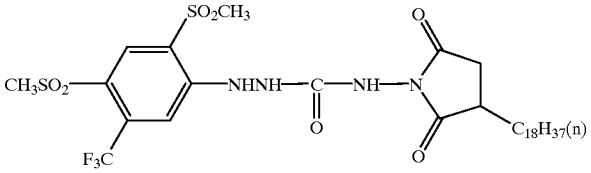

-continued
(75)
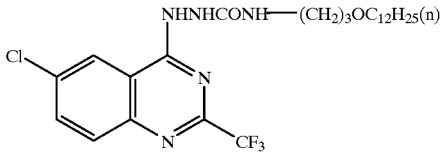
(76)
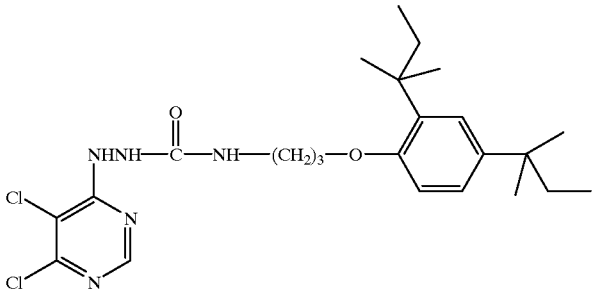
(77)
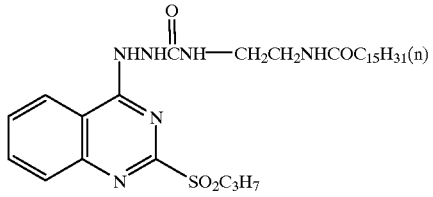
(78)
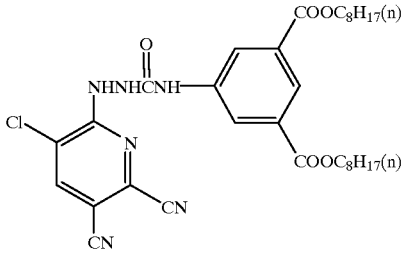
(79)
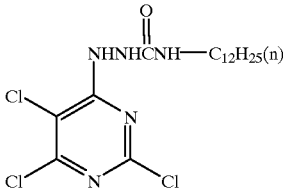
(80)
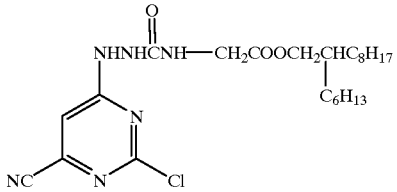

-continued
(81)
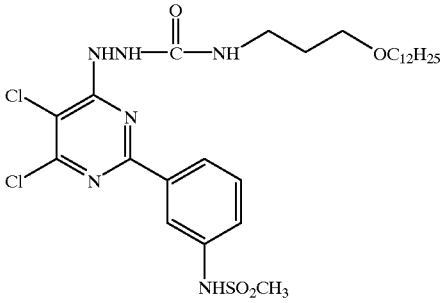
(82)
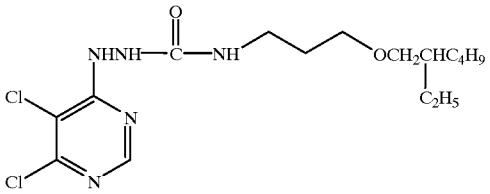
(83)
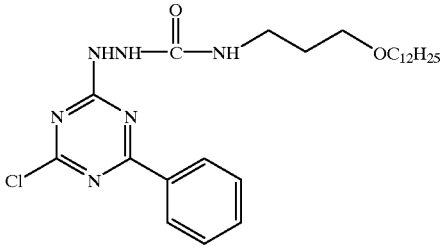
(84)
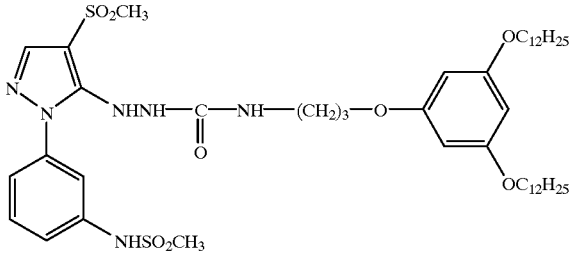
(85)
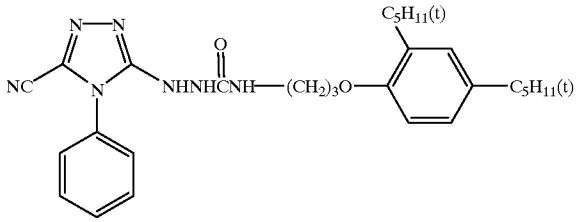
(86)
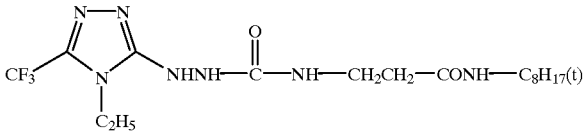

-continued (87)

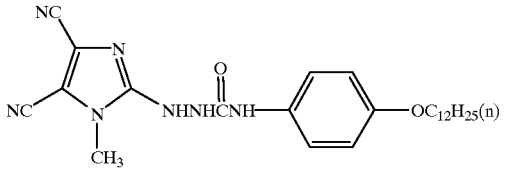

(88)

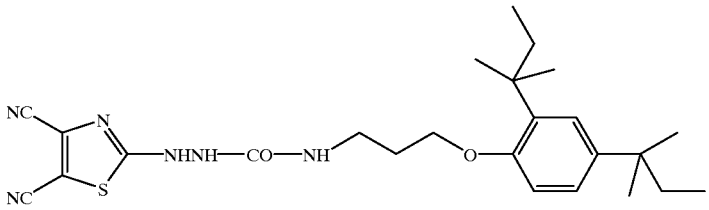

(89)

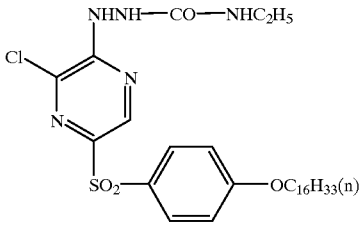

(90)

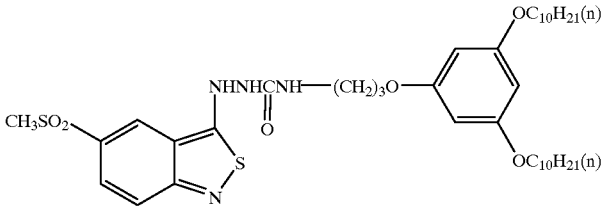

Next, general synthesis method of compounds used in the present invention are shown. Typical synthetic examples of some compounds out of the compounds used in the present invention are shown below. Other compounds can also be synthesized in the same way as that for the following examples.

Synthetic Example 1. Synthesis of Exemplified Compound (5)

The synthesis is carried out by following the below-shown synthesis route:

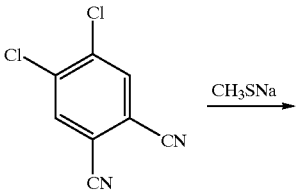

(A-1)

-continued

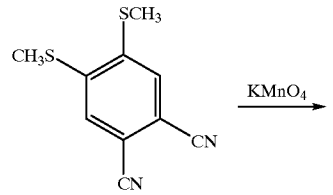

(A-2)

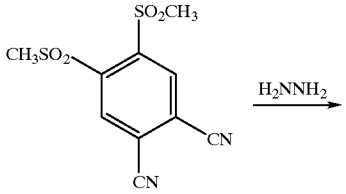

(A-3)

-continued

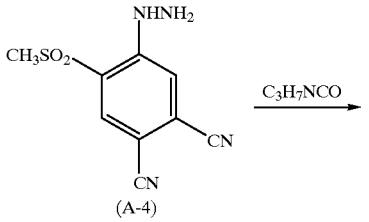

(Exemplified Compound (5))

Synthesis of Compound (A-2)

53.1 g of 1,2-dichloro-4,5-dicyanobenzene (A-1) (CAS Registry No. 139152-08-2) was dissolved in 1.1 liters of N,N-dimethylformamide (DMF), and then 268 g of an aqueous methyl mercaptan sodium salt solution (15%) was added, dropwise, to the solution, at room temperature over 1 hour, followed by stirring at 60° C. for 1 hour. The reaction liquid was cooled to room temperature and poured into water, followed by stirring for 30 min. The produced white solid was filtered, washed with water, and dried. Yield: 46.5 g (78.1%).

Synthesis of Compound (A-3)

41.1 g of Compound (A-2) was suspended in 400 ml of acetic acid, and then a solution of 89.3 g of potassium permanganate in 400 ml of water was added, dropwise, over 1 hour under cooling with water. After the reaction mixture was allowed to stand overnight at room temperature, 2 liters of water and 2 liters of ethyl acetate were added thereto, and the mixture was Celite-filtered. The filtrate was separated, and the organic layer was washed with water, an aqueous sodium hydrosulfite solution, an aqueous sodium bicarbonate solution, and then brine, followed by drying over anhydrous magnesium sulfate. After filtering the dried organic layer, the solvent was distilled off, and an ethyl acetate/hexane mixed solvent was added to the residue, to effect crystallization, to obtain 29.4 g of a white solid of Compound (A-3). Yield: 55.0%.

Synthesis of Compound (A-4)

29.4 g of Compound (A-3) was dissolved in 200 ml of dimethylsulfoxide (DMSO), and 8.7 g of hydrazine monohydrate was added, dropwise, to the solution, over 15 min under cooling with water, followed by stirring for 10 min under cooling with water. The reaction liquid was poured into water, and the produced yellow solid was filtered, washed with water, and dried. Yield: 17.4 g (70.9%).

Synthesis of Exemplified Compound (5)

11.8 g of Compound (A-4) was dissolved in 50 ml of tetrahydrofuran, and 4.7 g of propyl isocyanate was added, dropwise, to the solution, at room temperature over 30 min, followed by stirring for 1 hour. The reaction mixture was poured into water, and extraction was effected with ethyl acetate. The organic layer was washed with hydrochloric acid and then brine; then it was dried over anhydrous magnesium sulfate, filtered, and the solvent was distilled off. The residue was crystallized from an ethyl acetate/hexane mixed solvent (1:10), to obtain 14.5 g of a white solid of Exemplified Compound (5). Yield: 90.2%.

Synthetic Example 2. Synthesis of Exemplified Compound (2)

The synthesis was made by following the below-shown synthesis route:

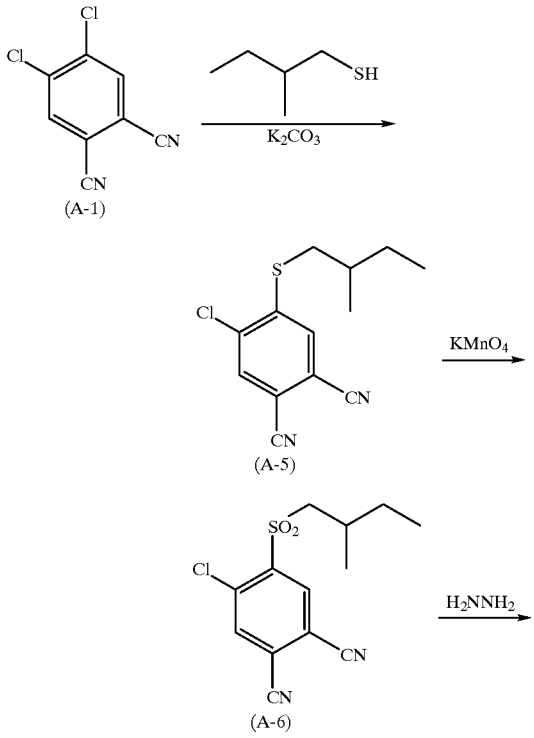

-continued

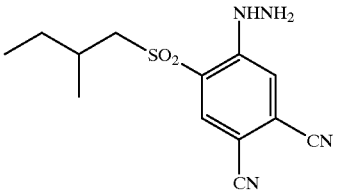

(A-7)

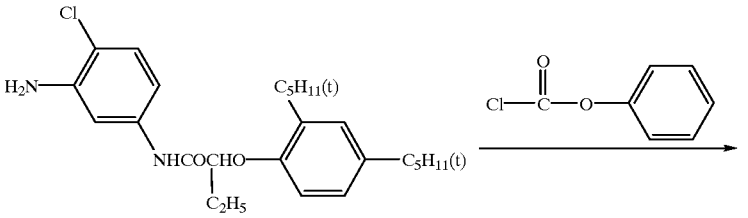

(A-8)

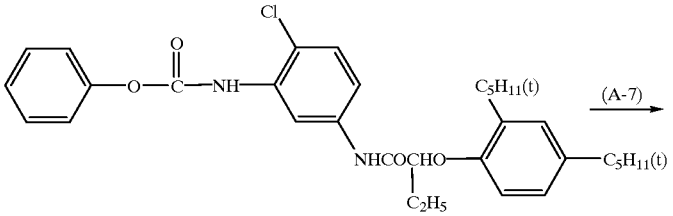

(A-9)

(Exemplified Compound (2))

Synthesis of Compound (A-5)

84.7 g of Compound (A-1) and 89.8 g of potassium carbonate were suspended in 600 ml of DMF, and then 60.3 ml of 2-methylbutylmercaptan was added, dropwise, to the suspension, at room temperature over 1 hour, followed by stirring at room temperature for 1 hour. The reaction mixture was poured into water and stirred for 10 min. The produced white solid was filtered, washed with water, and dried. Yield: 100.8 g (88.5%).

Synthesis of Compound (A-6)

98.0 g of Compound (A-5) was suspended in 500 ml of acetic acid and 500 ml of water, and to the suspension was added, dropwise, a solution of 88.5 g of potassium permanganate in 500 ml of water, at room temperature over 1 hour, followed by stirring at room temperature for 2 hours. Then 2 liters of water and 2 liters of ethyl acetate were added to the reaction mixture, followed by Celite-filtering. The filtrate was separated, and the organic layer was washed with water, an aqueous hydrosulfite solution, an aqueous sodium bicarbonate solution, and brine, followed by drying over anhydrous magnesium sulfate. After filtering the dried organic layer, the solvent was distilled off, and isopropyl alcohol was added to the residue, to effect crystallization, to obtain 53.2 g of a white solid of Compound (A-6). Yield: 48.4%.

Synthesis of Compound (A-7)

50.5 g of Compound (A-6) was dissolved in 100 ml of DMSO, and then 17.0 g of hydrazine monohydrate was added, dropwise, thereto, over 10 min under cooling with ice, followed by stirring at room temperature for 30 min. The reaction mixture was poured into water, and extraction was carried out with ethyl acetate. The organic layer was washed with water and dried over anhydrous magnesium sulfate. After filtering the dried organic layer, the solvent was distilled off, and the residue was purified by silica gel chromatography, using methylene chloride as an eluent. Crystallization was carried out from ethyl acetate/hexane (1:2), to obtain 31.4 g of a yellow solid of Compound (A-7). Yield: 63.2%.

Synthesis of Compound (A-9)

44.5 g of Compound (A-8) (CAS Registry No. 51461-11-1) was dissolved in 500 ml ethyl acetate, and then a solution of 25 g of sodium bicarbonate in 500 ml of water was added to the solution. To the resulting solution was added, dropwise, 16.4 g of phenyl chlorocarbonate, at room temperature over 30 min, followed by stirring for a further 1 hour. The layers were separated, the organic layer was washed with brine and dried over anhydrous magnesium sulfate, and after filtering the dried organic layer, the solvent was distilled off, to obtain 54.0 g of a pale yellow oil of Compound (A-9). Yield: 95.6%.

Synthesis of Exemplified Compound (2)

5.8 g of Compound (A-7), 11.3 g of Compound (A-9), and 0.60 g of DMAP (N,N-dimethylaminopyridine) were dissolved in 100 ml of acetonitrile, and the solution was stirred at 60° C. for 3 hours. The reaction mixture was poured into water, and extraction with ethyl acetate was carried out. The organic layer was washed with an aqueous sodium bicarbonate solution, hydrochloric acid, and then brine; then it was dried over anhydrous magnesium sulfate, and after filtration of the dried organic layer was carried out, the solvent was distilled off. The residue was purified by silica gel column chromatography (eluent: ethyl acetate/hexane=

1/2), and crystallization from hexane was carried out, to obtain 8.0 g of a white solid of Exemplified Compound (2). Yield: 52.4%.

Synthetic Example 3. Synthesis of Exemplified Compound (1)

The synthesis was carried out by following the synthesis route shown below:

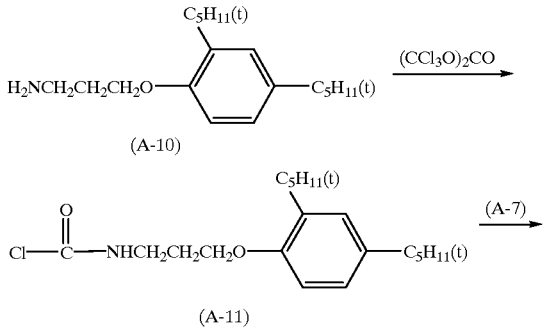

Synthesis of Exemplified Compound (1)

4.6 g of triphosgene was dissolved in 100 ml of THF, and to the solution were added, dropwise, 13.6 g of Compound (A-10) (CAS Registry No. 61053-26-7), at room temperature over 10 min, and then 18.7 ml of triethylamine, at room temperature over 10 min. Reaction was carried out for 30 min, to obtain a solution of Compound (A-11). To this solution was added 13.0 g of Compound (A-7), in portions, at room temperature over 10 min. After the reaction mixture was stirred for a further 1 hour, the reaction mixture was poured into water, and extraction with ethyl acetate was carried out. After the organic layer was washed with an aqueous sodium bicarbonate solution, hydrochloric acid, and then brine, the organic layer was dried over anhydrous magnesium sulfate. After the dried organic layer was filtered, the solvent was distilled off. The residue was purified by silica gel column chromatography, and crystallization from ethyl acetate/hexane 1:10 mixture was carried out, to obtain a white solid of Exemplified Compound (1). Yield: 17.0 g (61.3%).

Synthetic Example 4. Synthesis of Exemplified Compound (37)

The synthesis was carried out by following the synthesis route given below:

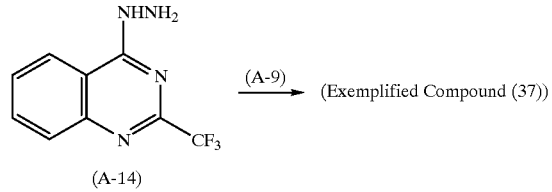

Similarly to Synthetic Example 2, the synthesis was carried out by using 6.0 g of Compound (A-14) (EP-A-545491), 14.98 g of Compound (A-9), and 0.5 g of DMAP, to obtain a white solid of Exemplified Compound (37). Yield: 12.0 g (65.3%).

Synthetic Example 5. Synthesis of Exemplified Compound (36)

Similarly to Synthetic Example 3, the synthesis was carried out by using Compound (A-11), prepared similarly to Synthetic Example 3 from 5.8 g of Compound (A-10), and 4.3 g of Compound (A-14), to obtain a white solid of Exemplified Compound (36). Yield: 6.7 g (61.5%).

Next, a coupler for use in the present invention with a compound represented by formula (I) is described.

The coupler for use in the present invention may be a two-equivalent coupler or a four-equivalent coupler. Further, a combination of two or more couplers may be added to the same layer. However, in the first invention of the present invention, among said couplers, at least one is a coupler that is represented by formula (II).

$$\text{Cp—(Time)}_t\text{—PUG} \qquad \text{formula (II)}$$

In the formula, Cp is a group that undergoes a coupling reaction, at the site at which $(\text{Time})_t$—PUG is bonded, with the oxidation product of the color-developing agent represented by formula (I). Time represents a timing group. The timing group is a group having a function capable of producing a PUG after the split-off (elimination) of $(\text{Time})_t$—PUG from the Cp part. PUG represents a photographically useful group. t is 0, 1, 2, or 3, with preference given to 0, 1, or 2.

In formula (II), Cp and $(\text{Time})_t$—PUG are bonded, in which preferably an oxygen atom, a nitrogen atom, a sulfur atom, a phosphorus atom, a selenium atom, or an iodine atom is bonded to Cp; more preferably an oxygen atom, a sulfur atom, or a nitrogen atom is bonded to Cp, and most preferably an oxygen atom or a sulfur atom is bonded to Cp. When t is 0, the PUG is bonded directly to Cp, in this case preferably they are bonded similarly to the above.

Cp is now described more specifically. Cp in formula (II) is preferably a residue of a compound represented by one of the following formulae (1) to (12) that is removed Y. They are compounds, in general, collectively called active methylenes, pyrazolones, pyrazoloazoles, phenols, naphthols, and pyrrolotriazoles, respectively, and these compounds are known in the art. In the first invention, Y in formulae (1) to (12) has the same meaning as that of $(\text{Time})_t$—PUG defined in formula (II).

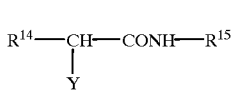

(1)

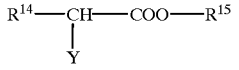

(2)

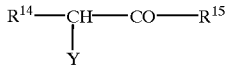

(3)

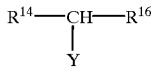

(4)

-continued (5)

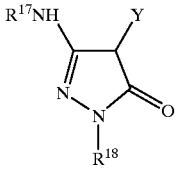

(6)

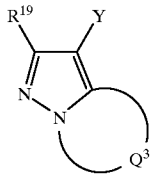

(7)

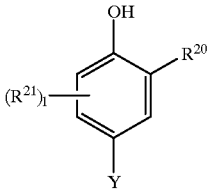

(8)

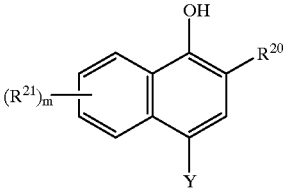

(9)

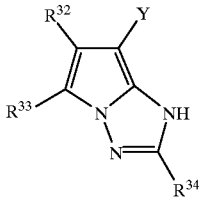

(10)

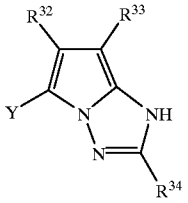

(11)

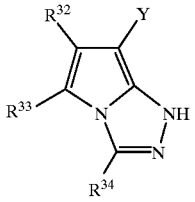

-continued (12)

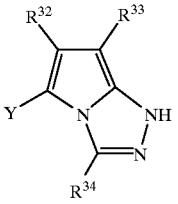

Formulae (1) to (4) represent couplers that are called active methylene couplers, and, in the formulae, $R^{14}$ represents an acyl group, a cyano group, a nitro group, an aryl group, a heterocyclic residue, an alkoxycarbonyl group, an aryloxycarbonyl group, a carbamoyl group, a sulfamoyl group, an alkylsulfonyl group, or an arylsulfonyl group, optionally substituted.

In formulae (1) to (3), $R^{15}$ represents an optionally substituted alkyl group, aryl group, or heterocyclic residue. In formula (4), $R^{16}$ represents an optionally substituted aryl group or heterocyclic residue. Examples of the substituent that may be possessed by $R^{14}$, $R^{15}$, and $R^{16}$ include those mentioned for Q in the above formula (I).

In formulae (1) to (4), $R^{14}$ and $R^{15}$, and $R^{14}$ and $R^{16}$, may bond together to form a ring.

Formula (5) represents a coupler that is called a 5-pyrazolone coupler, and in the formula, $R^{17}$ represents an alkyl group, an aryl group, an acyl group, or a carbamoyl group. $R^{18}$ represents a phenyl group or a phenyl group that is substituted by one or more halogen atoms, alkyl groups, cyano groups, alkoxy groups, alkoxycarbonyl groups, or acylamino groups.

Preferable 5-pyrazolone couplers represented by formula (5) are those wherein $R^{17}$ represents an aryl group or an acyl group, and $R^{18}$ represents a phenyl group that is substituted by one or more halogen atoms.

With respect to these preferable groups, more particularly, $R^{17}$ is an aryl group, such as a phenyl group, a 2-chlorophenyl group, a 2-methoxyphenyl group, a 2-chloro-5-tetradecaneamidophenyl group, a 2-chloro-5-(3-octadecenyl-1-succinimido)phenyl group, a 2-chloro-5-octadecylsulfonamidephenyl group, and a 2-chloro-5-[2-(4-hydroxy-3-t-butylphenoxy)tetradecaneamido]phenyl group; or $R_{17}$ is an acyl group, such as an acetyl group, a 2-(2,4-di-t-pentylphenoxy)butanoyl group, a benzoyl group, and a 3-(2,4-di-t-amylphenoxyacetamido)benzoyl group, any of which may have a substituent, such as a halogen atom or an organic substituent that is bonded through a carbon atom, an oxygen atom, a nitrogen atom, or a sulfur atom.

Preferably $R^{18}$ represents a substituted phenyl group, such as a 2,4,6-trichlorophenyl group, a 2,5-dichlorophenyl group, and a 2-chlorophenyl group.

Formula (6) represents a coupler that is called a pyrazoloazole coupler, and, in the formula, $R^{19}$ represents a hydrogen atom or a substituent. $Q^3$ represents a group of nonmetal atoms required to form a 5-membered azole ring having 2 to 4 nitrogen atoms, which azole ring may have a substituent (including a condensed ring).

Preferable pyrazoloazole couplers represented by formula (6), in view of spectral absorption characteristics of the color-formed dyes, are imidazo[1,2-b]pyrazoles described in U.S. Pat. No. 4,500,630, pyrazolo[1,5-b]-1,2,4-triazoles described in U.S. Pat. No. 4,500,654, and pyrazolo[5,1-c]-1,2,4-triazoles described in U.S. Pat. No. 3,725,067.

Details of substituents of the azole rings represented by the substituents $R^{19}$ and $Q^3$ are described, for example, in U.S. Pat. No. 4,540,654, the second column, line 41, to the eighth column, line 27. Preferable pyrazoloazole couplers are pyrazoloazole couplers having a branched alkyl group directly bonded to the 2-, 3-, or 6-position of the pyrazolotriazole group, as described in JP-A-61-65245; pyrazoloazole couplers containing a sulfonamide group in the molecule, as described in JP-A-61-65245; pyrazoloazole couplers having an alkoxyphenylsulfonamide ballasting group, as described in JP-A-61-147254; pyrazolotriazole couplers having an alkoxy group or an aryloxy group at the 6-position, as described in JP-A-62-209457 or 63-307453; and pyrazolotriazole couplers having a carbonamido group in the molecule, as described in JP-A-1-22279.

Formulae (7) and (8) are respectively called phenol couplers and naphthol couplers, and in the formulae $R^{20}$ represents a hydrogen atom or a group selected from the group consisting of —$CONR^{22}R^{23}$, —$SO_2NR^{22}R^{23}$, —$NHCOR^{22}$, —$NHCONR^{22}R^{23}$, and —$NHSO_2NR^{22}R^{23}$. $R^{22}$ and $R^{23}$ each represent a hydrogen atom or a substituent, with preference given to an alkyl, aryl, and heterocyclic group. In formulae (7) and (8), $R^{21}$ represents a substituent, 1 is an integer selected from 0 to 2, and m is an integer selected from 0 to 4. When 1 and m are 2 or more, $R^{21}$'s may be different. The substituents of $R^{21}$ to $R^{23}$ include those mentioned above as examples for Q in the above formula (I).

Preferable examples of the phenol couplers represented by formula (7) include 2-acylamino-5-alkylphenol couplers described, for example, in U.S. Pat. Nos. 2,369,929, 2,801,171, 2,772,162, 2,895,826, and 3,772,002; 2,5-diacylaminophenol couplers described, for example, in U.S. Pat. Nos. 2,772,162, 3,758,308, 4,126,396, 4,334,011, and 4,327,173, West Germany Patent Publication No. 3 329 729, and JP-A-59-166956; and 2-phenylureido-5-acylaminophenol couplers described, for example, in U.S. Pat. Nos. 3,446,622, 4,333,999, 4,451,559, and 4,427,767.

Preferable examples of the naphthol couplers represented by formula (8) include 2-carbamoyl-1-naphthol couplers described, for example, in U.S. Pat. Nos. 2,474,293, 4,052,212, 4,146,396, 4,282,233, and 4,296,200; and 2-carbamoyl-5-amido-1-naphthol couplers described, for example, in U.S. Pat. No. 4,690,889.

Formulas (9) to (12) are couplers called pyrrolotriazoles, and $R^{32}$, $R^{33}$, and $R^{34}$ each represent a hydrogen atom or a substituent. Y has the same meaning as defined above. Examples of the substituent of $R^{32}$, $R^{33}$, and $R^{34}$ include those mentioned for Q in the above formula (I). Preferable examples of the pyrrolotriazole couplers represented by formulae (9) to (12) include those wherein at least one of $R^{32}$ and $R^{33}$ is an electron-attracting group, which specific couplers are described in EP-A-488 248, 491 197, and 545 300.

Further, a fused-ring phenol, an imidazole, a pyrrole, a 3-hydroxypyridine, an active methylene, an active methine, a 5,5-ring-fused heterocyclic, and a 5,6-ring-fused heterocyclic coupler, can be used.

As the fused-ring phenol couplers, those described, for example, in U.S. Pat. Nos. 4,327,173, 4,564,586, and 4,904,575, can be used.

As the imidazole couplers, those described, for example, in U.S. Pat. Nos. 4,818,672 and 5,051,347, can be used.

As the 3-hydroxypyridine couplers, those described, for example, in JP-A-1-315736, can be used.

As the active methylene and active methine couplers, those described, for example, in U.S. Pat. Nos. 5,104,783 and 5,162,196, can be used.

As the 5,5-ring-fused heterocyclic couplers, for example, pyrrolopyrazole couplers described in U.S. Pat. No. 5,164,289, and pyrroloimidazole couplers described in JP-A-4-174429, can be used.

As the 5,6-ring-fused heterocyclic couplers, for example, pyrazolopyrimidine couplers described in U.S. Pat. No. 4,950,585, pyrrolotriazine couplers described in JP-A-4-204730, and couplers described in EP-556 700, can be used.

In the present invention, preferably in the first invention, in addition to the coupler represented by formula (II), other couplers that do not release a photographically useful group (PUG) can be preferably used. Such couplers can be particularly preferably used, except when the compound represented by formula (II) releases a dye for the formation of an image. Such couplers are represented by formulae (1) to (12), in which Y represents a hydrogen atom, or a group that can be split-off upon the coupling reaction with the oxidation product of the developing agent and that does not contain a PUG. In that case, examples of Y are a heterocyclic group (containing at least one hetero atom, such as a nitrogen, oxygen, or sulfur atom), which may be a saturated or unsaturated 5- to 7-membered monocyclic or condensed ring, and Y is bonded to Cp through the hetero atom present in Y. Examples are succinimido, maleinimido, phthalimido, diglycolimido, pyrrole, pyrazole, imidazole, 1,2,4-triazole, tetrazole, indole, benzopyrazole, benzimidazole, benzotriazole, imidazolin-2,4-dione, oxazolidin-2,4-dione, thiazolidin-2,4-dione, imidazolidin-2-one, oxazolin-2-one, thiazolin-2-one, benzimidazolin-2-one, benzoxazolin-2-one, benzthiazolin-2-one, 2-pyrrolin-5-one, 2-imidazolin-5-one, indolin-2,3-dione, 2,6-dioxypurine, parabic acid, 1,2,4-triazolidin-3,5-dione, 2-pyridone, 4-pyridone, 2-pyrimidone, 6-pyridazone, 2-pyrazone, 2-amino-1,3,4-thiazolidine, and 2-imino-1,3,4-thiazolidin-4-one), a halogen atom (e.g. a chlorine atom and a bromine atom), an aryloxy group (e.g. phenoxy and 1-naphthoxy), a heterocyclic oxy group (e.g. pyridyloxy and pyrazolyoxy), an acyloxy group (e.g. acetoxy and benzoyloxy), an alkoxy group (e.g. methoxy and dodecyloxy), a carbamoyloxy group (e.g. N,N-diethylcarbamoyloxy and morpholinocarbonyloxy), an aryloxycarbonyloxy group (e.g. phenoxycarbonyloxy), an alkoxycarbonyloxy group (e.g. methoxycarbonyloxy and ethoxycarbonyloxy), an arylthio group (e.g. phenylthio and naphthylthio), a heterocyclic thio group (e.g. tetrazolylthio, 1,3,4-thiadiazolylthio, 1,3,4-oxadiazolylthio, and benzimidazolylthio), an alkylthio group (e.g. methylthio, octylthio, and hexadecylthio), an alkylsulfonyloxy group (e.g. methanesulfonyloxy), an arylsulfonyloxy group (e.g. benzenesulfonyloxy and toluenesulfonyloxy), a carbonamido group (e.g. acetamido and trifluoroacetamido), a sulfonamide group (e.g. methanesulfonamide and benzenesulfonamide), an alkylsulfonyl group (e.g. methanesulfonyl), an arylsulfonyl group (e.g. benzenesulfonyl), an alkylsulfinyl group (e.g. methanesulfinyl), an arylsulfinyl group (e.g. benzenesulfinyl), and a carbamoylamino group (e.g. N-methylcarbamoylamino). In that case, preferably the bonding of Y and Cp is such that an oxygen atom, a nitrogen atom, a sulfur atom, a phosphorus atom, a selenium atom, or a halogen atom (e.g. fluorine, chlorine, and bromine), more preferably an oxygen atom, a sulfur atom, a nitrogen atom, or a halogen atom, and most preferably an oxygen atom, a sulfur atom, or a halogen atom, any of which is present in Y, is bonded to Cp. Preferable specific examples of Y are a halogen atom, an aryloxy group, a heterocyclic oxy group, an acyloxy group, an aryloxycarbonyloxy group, an alkoxycarbonyloxy group, a carbamoyloxy group, an arylthio group, and a heterocyclic thio group, with more preference given to a halogen atom, an aryloxy group, a heterocyclic oxy group, an acyloxy group, an aryloxycarbonyloxy group, an alkoxycarbonyloxy group, and a carbomoyloxy group.

Y may be substituted by a substituent, and examples of the substituent of Y include those mentioned for Q in the above formula (I).

With respect to the coupler used in one layer, preferably a combination of two or more couplers represented by formulae (1) to (12), is used, in the combination Cp's and Y's (including $(Time)_t$—PUG) being different. Particularly in the case of a coupler having Y that contains a PUG that is not a dye for the formation of an image, a combination of a coupler having Y that contains a PUG, and a coupler having Y that does not contain a PUG, is preferably used.

When two or more couplers having different Y's are used in combination in one layer, the ratio of the coupler having a PUG in Y to all the couplers used in the same layer, varies depending on the function of the PUG. Generally the ratio ranges preferably from 0.01% to 99%, more preferably from 0.1% to 90%, and most preferably from 0.1% to 60%.

In the present invention, in addition to the above couplers represented by formulae (1) to (12), use can be made of couplers described, for example, in West Germany Patent Nos. 3 819 051A and 3 823 049, U.S. Pat. Nos. 4,840,883, 5,024,930, 5,051,347, and 4,481,268, EP-A-304 856, 329 036, 354 549, 374 781, 379 110, and 386 930, and JP-A-63-141055, 1-32260, 1-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731, and 4-204732.

The group Time is now described. The timing group is a group having a function capable of producing a PUG after the split-off of $(Time)_t$—PUG from the Cp part. The groups having such a function include groups that use cleavage reactions of hemiacetals, as described, for example, in U.S. Pat. Nos. 4,146,396, 4,652,516, or 4,698,297; timing groups that cause a cleavage reaction using an intramolecular nucleophilic substitution reaction, as described in U.S. Pat. Nos. 4,248,962, 4,847,185, 4,912,028, or 4,857,440; timing groups that cause a cleavage reaction using an electron transfer reaction, as described in U.S. Pat. Nos. 4,409,323, 5,034,311, 5,055,385, or 4,421,845; groups that cause a cleavage reaction using hydrolysis of iminoketals, as described in U.S. Pat. No. 4,546,073; or groups that cause a cleavage reaction using a hydrolysis reaction of esters, as described in GB-1 531 927 (OLS).

As examples of the case wherein two Time's are linked, timing groups described in U.S. Pat. Nos. 4,861,701, 5,026, 628, 5,021,322, and 5,021,322, and EP-A-499 279 (OLS) and 438 129 (OLS), can be mentioned. Time also may be a timing group capable of releasing two PUGs, and examples thereof are timing groups described, for example, in EP-A-464 612 (OLS). Time is bonded to Cp at the hetero atom; preferably the oxygen atom, the sulfur atom, or the nitrogen atom, and particularly preferably the oxygen atom or the sulfur atom, contained in that Time.

As Time, one containing at least one nondiffusion group can also be preferably used. The nondiffusion group contains a substituent having generally 8 to 40 carbon atoms, and preferably 10 to 22 carbon atoms, in all. As preferable Time, the following (T-1), (T-2), and (T-3) can be mentioned.

formula (T-1): $*—W—(X{=}Y)_j—C(R^{81})R^{82}—**$ formula (T-2): $*—W—CO—**$ formula (T-3): $*—W—LINK—E—**$ In the above formulae, * represents the position (site) where it is bonded to Cp of formula (II), ** represents the position where it is bonded to the PUG of formula (I), W represents an oxygen atom, a sulfur atom, or $>N—R^{83}$; X and Y each represent a methine or a nitrogen atom; j is 0, 1, or 2; $R^{81}$, $R^{82}$, and $R^{83}$ each represent a hydrogen atom or a substituent; and when X and Y each represent a substituted methine, any two of these substituents and the substituents represented by $R^{81}$, $R^{82}$, and $R^{83}$ may or may not bond together to form a ring structure (e.g. a benzene ring and a pyrazole ring). In formula (T-3), E represents an electrophilic group, and LINK represents a linking group that relates sterically W and E, so that W and E may undergo an intramolecular nucleophilic substitution reaction. Specific examples of Time include:

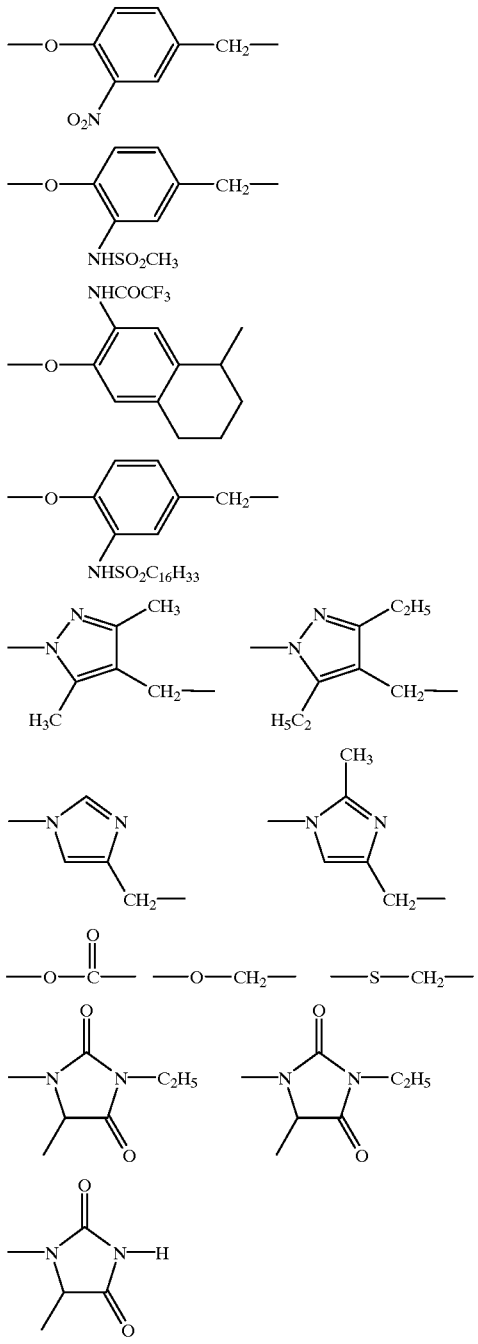

-continued

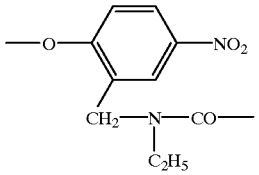

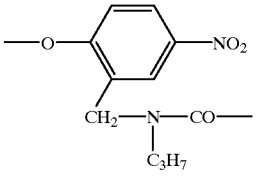

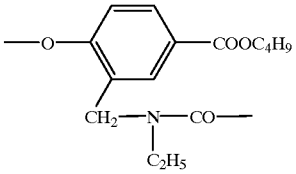

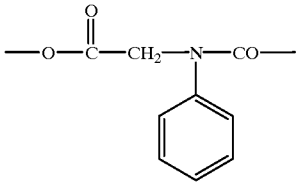

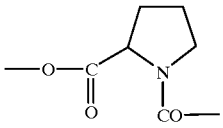

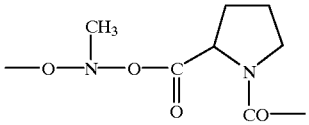

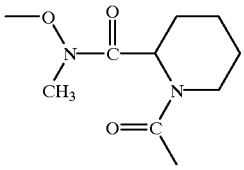

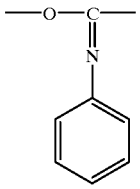

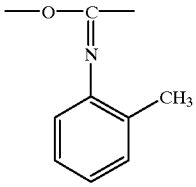

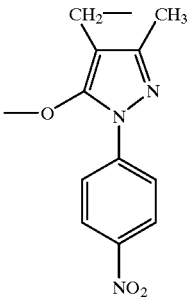

-continued

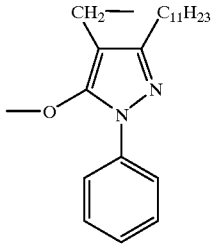

PUG represents a photographically useful group. PUG is specifically described below. Particularly PUG includes residues obtained from a development inhibitor, a dye, a nucleator, a developing agent, a coupler, a bleach accelerator, a bleach inhibitor, a fixation accelerator, a development accelerator, a silver halide solvent, an image toner, an image dye stabilizer, a surface-active agent, a hardener, a desensitizer, a chelating agent, and a fluorescent whitening agent, or precursors of these. Preferable examples of the photographically useful group include photographically useful groups described in U.S. Pat. No. 4,248,962 (those represented by formula PUG in that patent), dyes described in JP-A-62-49353 (the parts of coupling split-off groups releasable from a coupler shown in that specification), development inhibitors described in U.S. Pat. No. 4,477,563, bleach accelerators described, for example, in JP-A-61-201247 and 2-55 (the parts of coupling split-off groups releasable from a coupler), and the parts of coupling split-off groups described, for example, in XIV. DI (A) Rs of Research Disclosure No. 37 038 (February 1995).

In the present invention, preferable photographically useful groups are development inhibitors, dyes, developing agents, and bleach accelerators, and particularly preferably they are development inhibitors and dyes. These preferable examples are described below specifically.

Examples of the development inhibitors are compounds having a mercapto group bonded to a heterocyclic ring, such as substituted or unsubstituted mercaptoazoles (specifically 1-phenyl-5-mercaptotetrazole, 1-(4-carboxyphenyl)-5-mercaptotetrazole, 1-(3-hydroxyphenyl-5-mercaptotetrazole), 1-(4-sulfophenyl)-5-mercaptotetrazole, 1-(3-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadiazole, 3-methyl-4-phenyl-5-mercapto-1,2,4-triazole, 2-(2-dimethylaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-{3-(3-methylureido) phenyl}-5-mercaptotetrazole, 1-(4-nitrophenyl)-5-mercaptotetrazole, and 1-butyl-5-mercaptotetrazole), substituted or unsubstituted mercaptoazaindenes (specifically 6-methyl-4-mercapto-1,3,3a,7-tetraazaindene, 6-methyl-2-benzyl-4-mercapto-1,3,3a,7-tetraazaindene, 6-phenyl-4-mercaptotetraazaindene, and 4,6-dimethyl-2-mercapto-1,3,3a,7-tetraazaindene), and substituted or unsubstituted mercaptopyrimidines (specifically 2-mercaptopyrimidine, 2-mercapto-4-methyl-6-hydroxypyrimidine, and 2-mercapto-4-propylpyrimidine).

Heterocyclic compounds capable of producing iminosilver can also be mentioned, such as substituted or unsubstituted benzotriazoles (specifically benzotriazole, 5-nitrobenzotriazole, 5-methylbenzotriazole, 5,6-dichlorobenzotriazole, 5-bromobenzotriazole, 5-methoxybenzotriazole, 5-n-butylbenzotriazole, 5-nitro-6-chlorobenzotriazole, 5,6-dimethylbenzotriazole, and 4,5,6,7-tetrachlorobenzotriazole), substituted or unsubstituted indazoles (specifically indazole, 5-nitroindazole, 3-cyanoindazole, 3-chloro-5-nitroindazole, and 3-nitroindazole), and substituted or unsubstituted benzimidazoles (specifically 5-nitrobenzimidazole, 4-nitrobenzimidazole, 5,6-dichlorobenzimidazole, 5-cyano-6-chlorobenzimidazole, and 5-trifluoromethyl-6-chiorobenzimidazole).

Further, the development inhibitors may be those that may be released in the development processing step to be converted to compounds having development-inhibiting properties, which in turn are changed into compounds having substantially no development-inhibiting properties or extremely low development-inhibiting properties.

Specifically, the following can be mentioned: 1-(3-phenoxycarbonylphenyl)-5-mercaptotetrazole, 1-(4-phenoxycarbonylphenyl)-5-mercaptotetrazole, 1-(3-maleimidophenyl)-5-mercaptotetrazole, 5-(phenoxycarbonyl)benzotriazole, 5-(p-cyanophenoxycarbonyl)benzotriazole, 2-phenoxycarbonylmethylthio-5-mercapto-1,3,4-thiadiazole, 5-phenoxycarbonyl-2-mercaptobenzimidazole, 5-(2,3-dichloropropyloxycarbonyl)benzotriazole, 5-(butylcarbamoylmethoxycarbonyl))benzotriazole, 5-(butoxycarbonymethoxycarbonyl))benzotriazole, 1-(4-benzoyloxyphenyl)-5-mercaptotetrazole, 5-(2-methanesulfonylethoxycarbonyl)-2-mercaptobenzothiazole, 1-{4-(2-chloroethoxycarbonyl)phenyl}-2-mercaptoimidazole, 5-cinnamoylaminobenzotriazole, 1-(3-vinylcarbonylphenyl)-5-mercaptotetrazole, 5-succinimidomethylbenzotriazole, 2-(4-succinimidophenyl)-5-mercapto-1,3,4-oxadiazole, 6-phenoxycarbonyl-2-mercaptobenzoxazole, and the like.

If PUG is a dye, the dye may be a diffusion dye or a nondiffusion dye, and it may or may not be soluble in water, depending on the application. Preferable dyes are, for example, azo dyes, azomethine dyes, indoaniline dyes, indophenol dyes, anthraquinone dyes, triarylmethane dyes, alizarin dyes, nitro dyes, quinoline dyes, indigo dyes, phthalocyanine dyes, oxonol dyes, cyanine dyes, and merocyanine dyes. Their loyco products, or those wherein the absorption wavelength is temporarily shifted, or those that can be changed to dyes by a redox reaction, such as tetrazolium salts, may also be used. Further, those dyes may be in the form of chelate dyes with suitable metals, or they may be dyes that form metal chelates during the development processing or in a step after the development processing.

These dyes include dye parts of compounds described, for example, in U.S. Pat. Nos. 3,880,658, 3,931,144, 3,932,380, 3,932,381, and 3,942,987, and dye parts of compounds described in JP-A-7-152123, 3-223750, and 4-24633 and EP-A-603 964.

As the dyes and the dye precursors, azo dyes, azomethine dyes, indoaniline dyes, and indophenol dyes, and their precursors are preferable.

If PUG is a developing agent, the developing agent may be a color-developing agent. As preferable developing agents, para-phenylenediamine developing agents, para-aminophenol developing agents, para-sulfonamidophenol developing agents, dihydroxybenzene developing agents, para-alkylaminophenol developing agents, and 3-pyrazolidone developing agents can be mentioned.

If PUG is a bleach accelerator, the bleach accelerator is preferably a compound represented by HS-R-(Z)p, wherein R represents a saturated or unsaturated aliphatic group, an aromatic group, or a heterocyclic group; Z represents an amino group, a hydroxyl group, a carboxyl group, or a sulfo group; and p is an integer of 1 or more. Z is preferably a hydroxyl group or a carboxyl group, and p is preferably 1, 2, or 3.

For other PUGs, reference may be made to JP-A-61-230135 and U.S. Pat. No. 4,248,962.

Specific examples of the compound represented by formula (II) that can be used in the present invention are shown below, which of course do not limit the present invention.

(C-1)

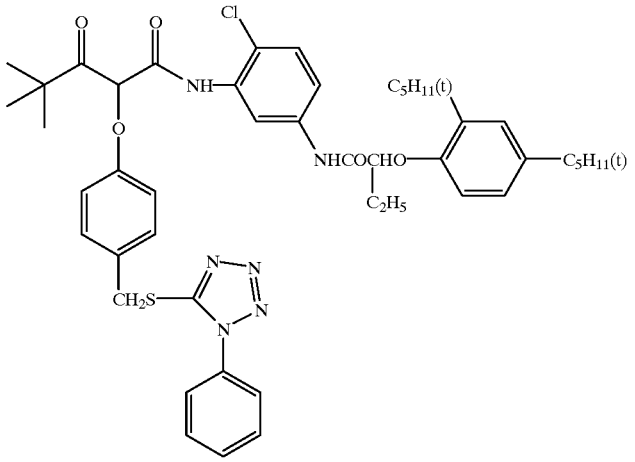

-continued
(C-2)
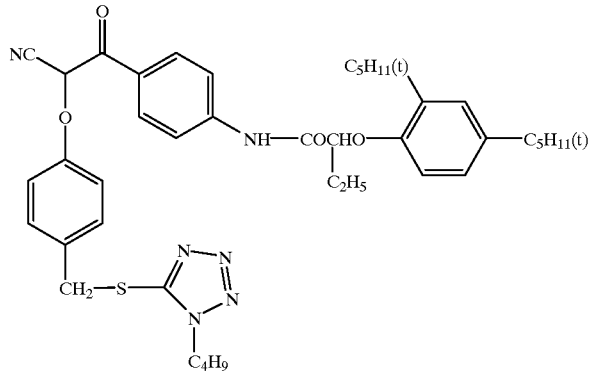
(C-3)
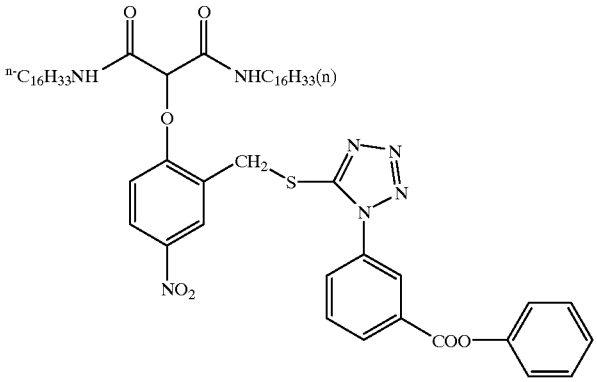
(C-4)
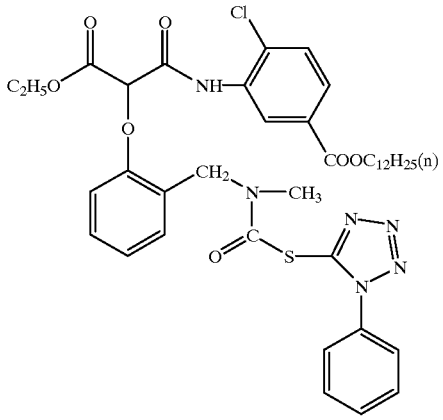
(C-5)
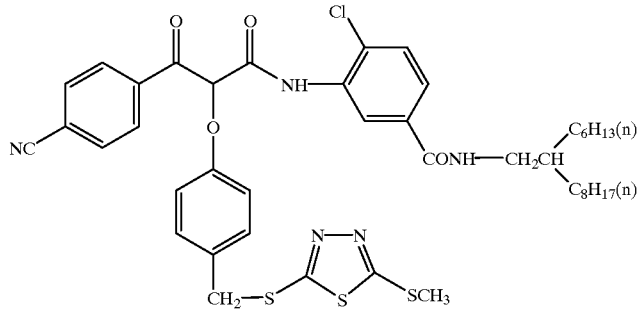

-continued
(C-6)
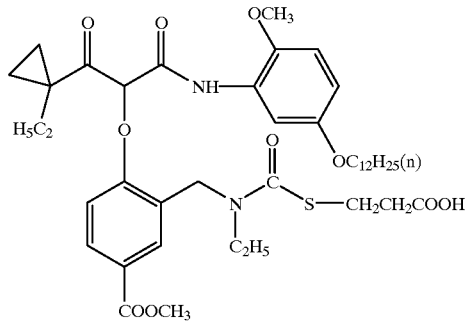
(C-7)
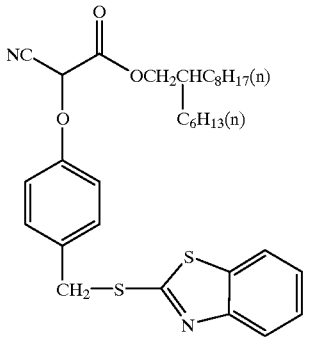
(C-8)
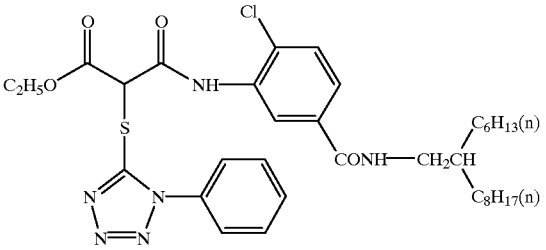
(C-9)
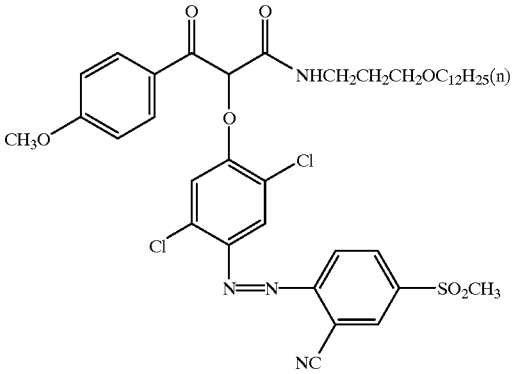

-continued
(C-10)
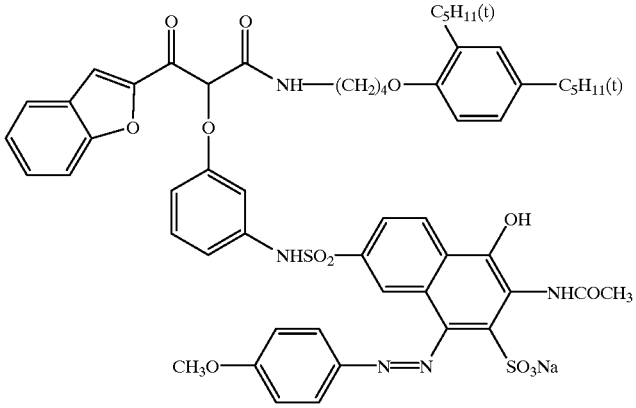
(C-11)
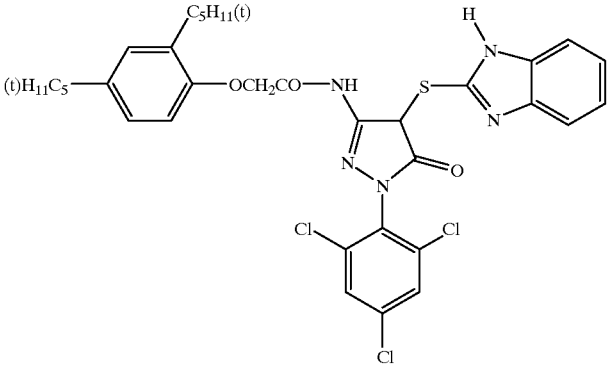
(C-12)
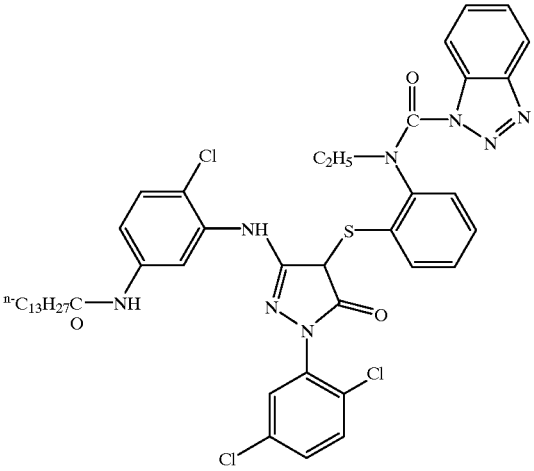

-continued
(C-13)
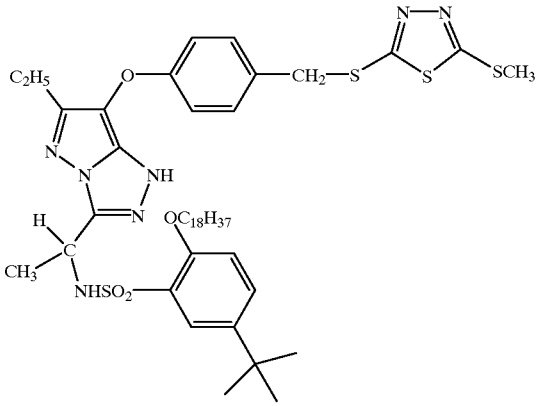
(C-14)
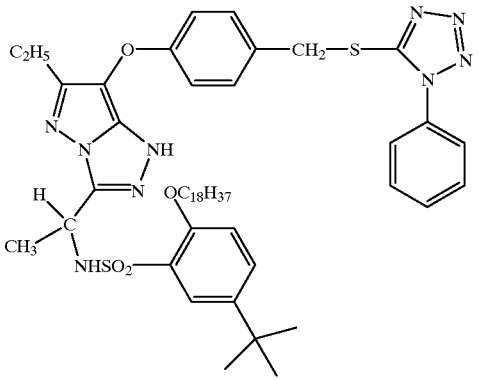
(C-15)
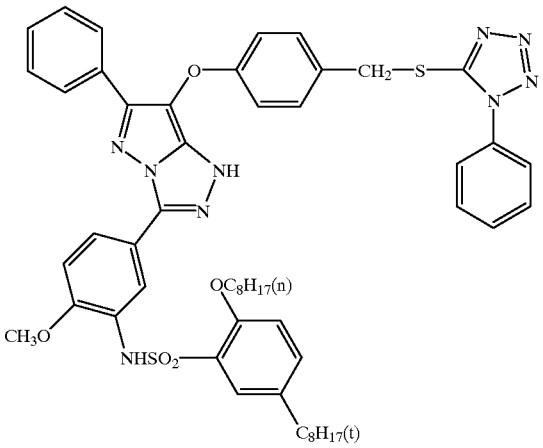

-continued
(C-16)
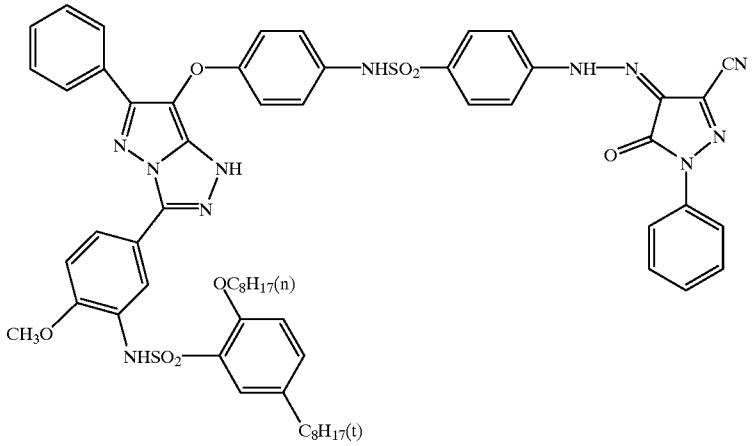
(C-17)
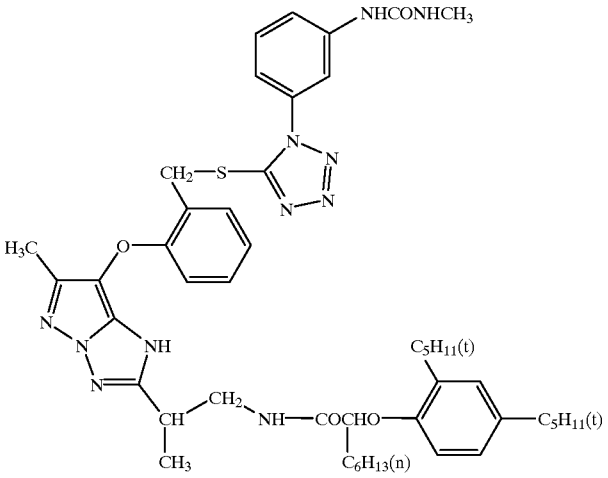
(C-18)
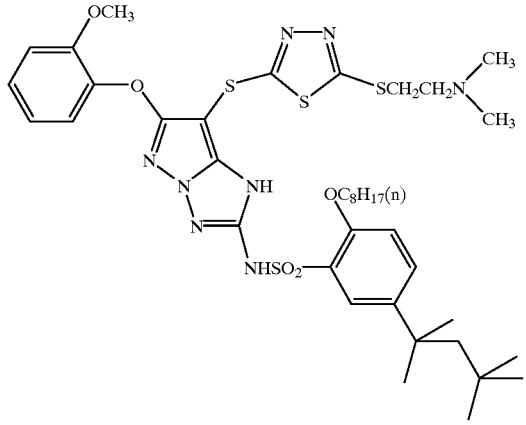

-continued
(C-19)
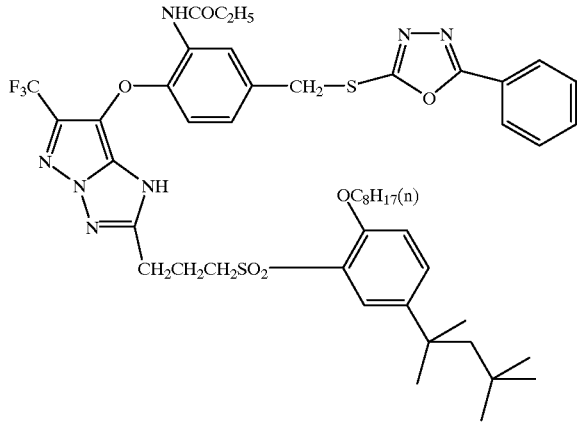
(C-20)
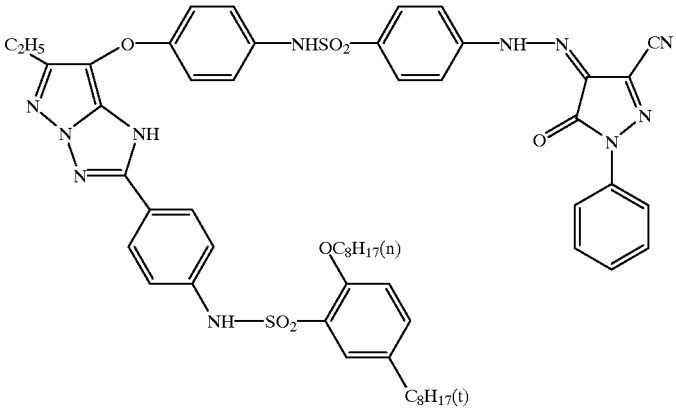
(C-21)
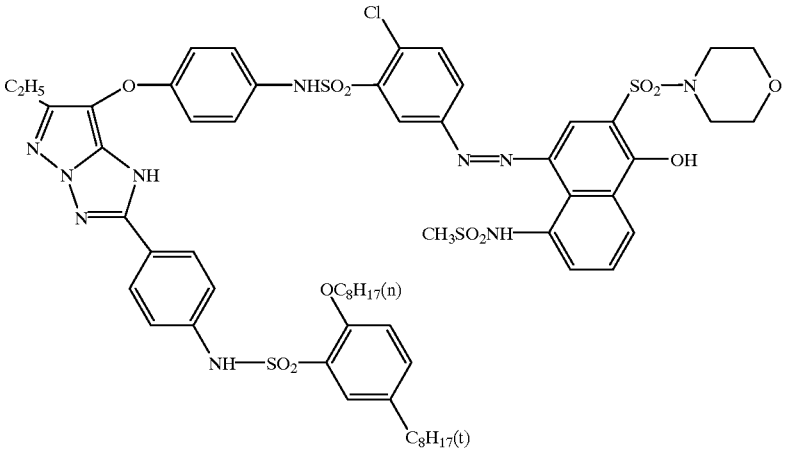

-continued
(C-22)
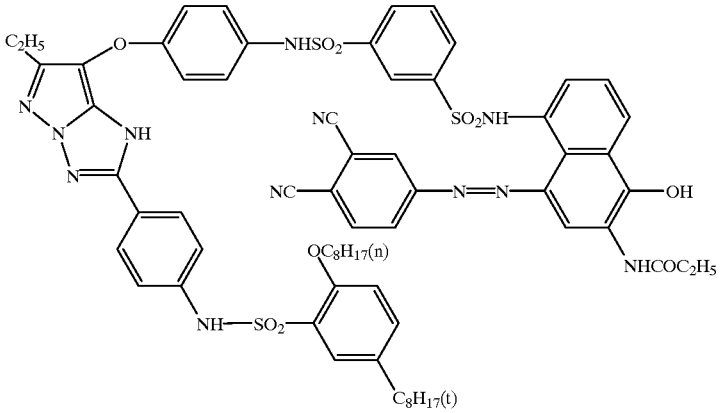
(C-23)
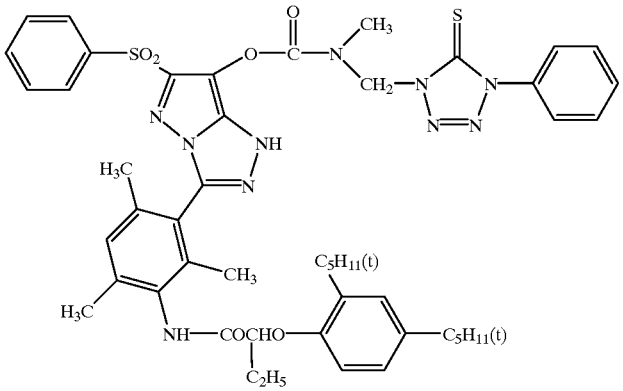
(C-24)
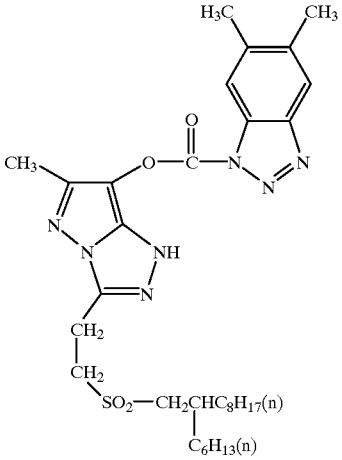

-continued
(C-25)
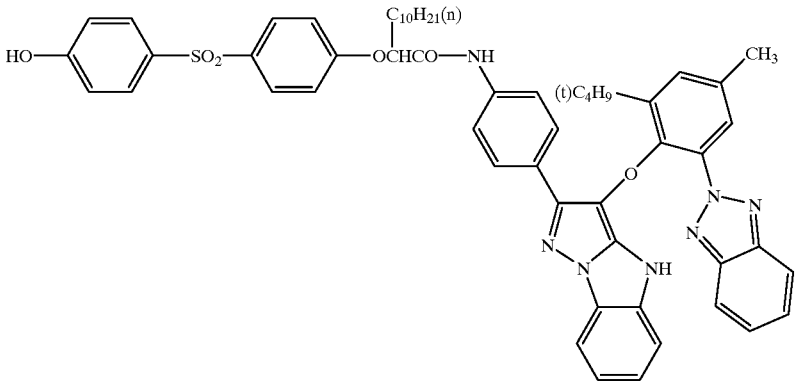
(C-26)
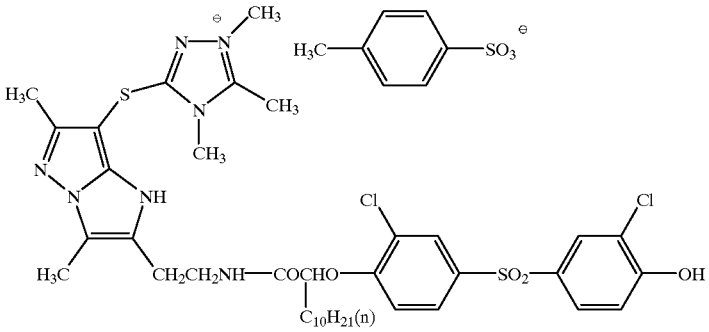
(C-27)
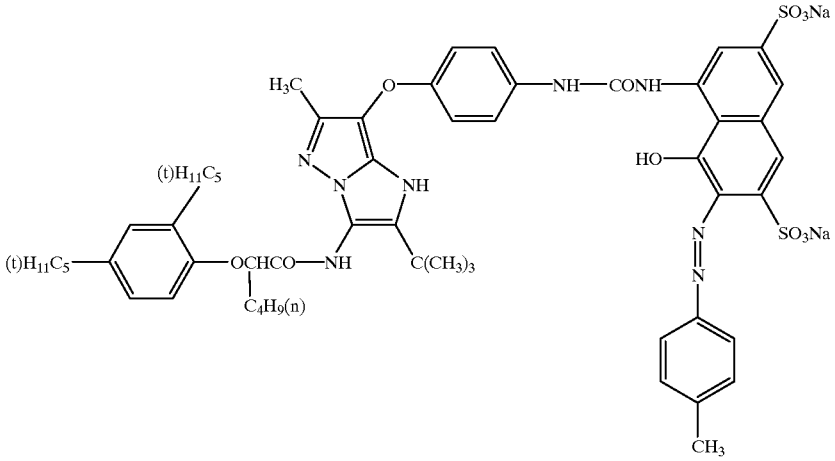
(C-28)
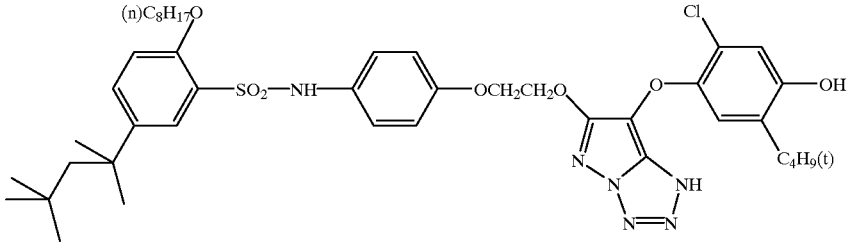

-continued
(C-29)
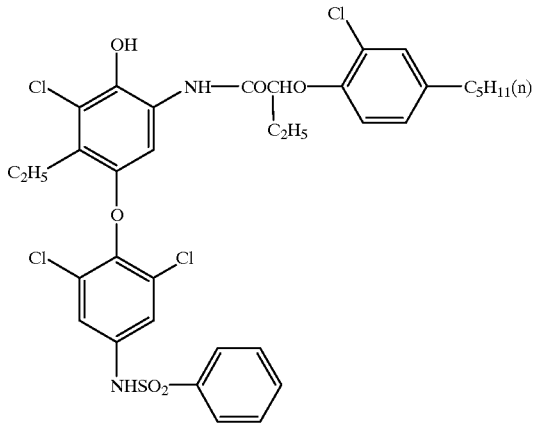
(C-30)
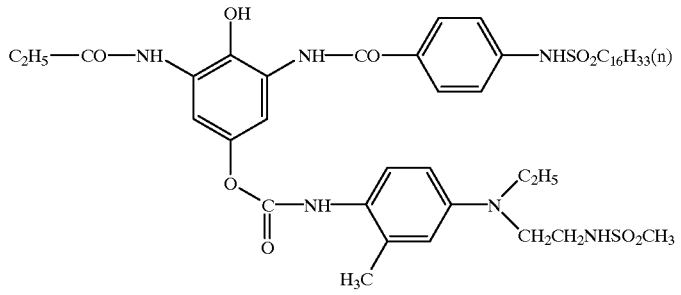
(C-31)
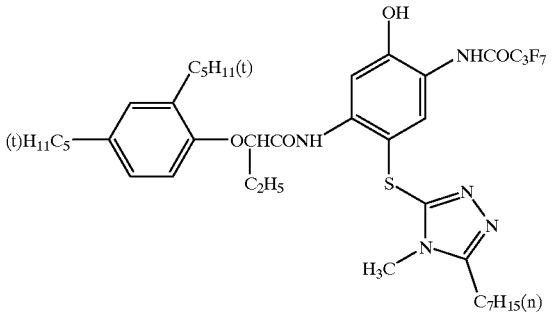
(C-32)
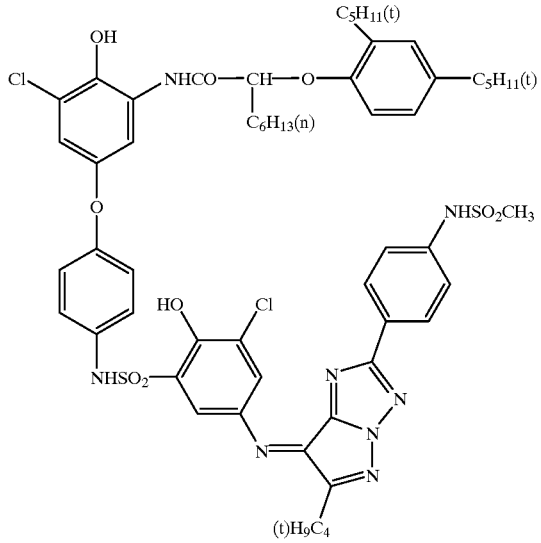

-continued
(C-33)
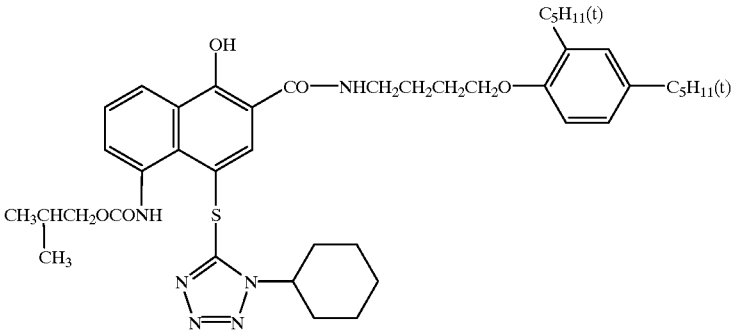
(C-34)
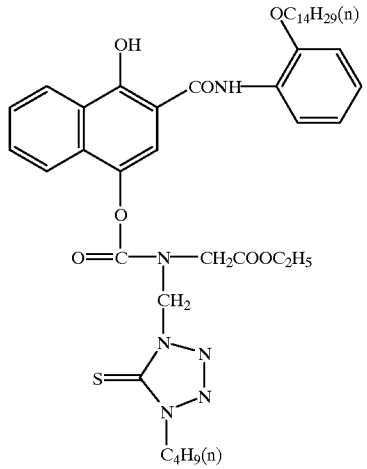
(C-35)
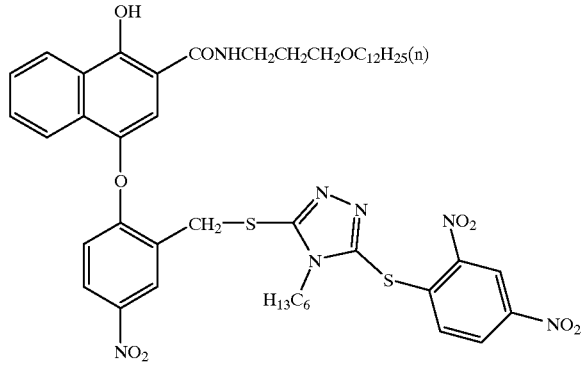
(C-36)
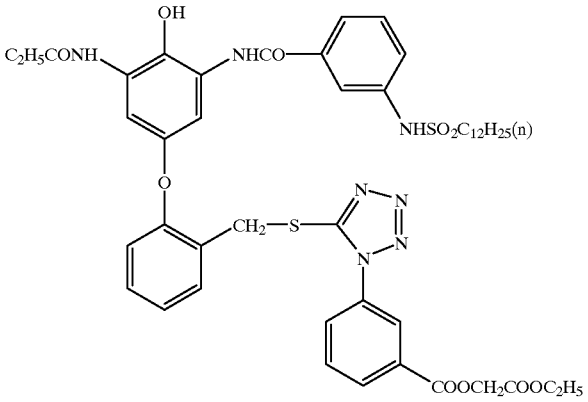

-continued
(C-37)
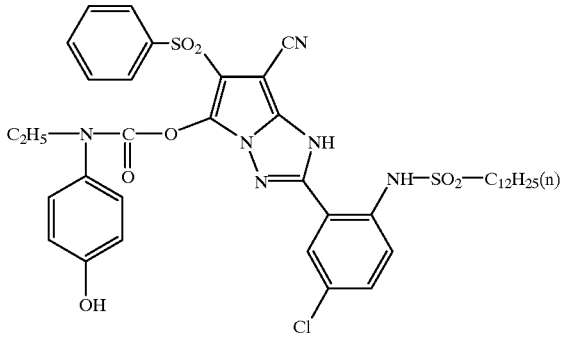
(C-38)
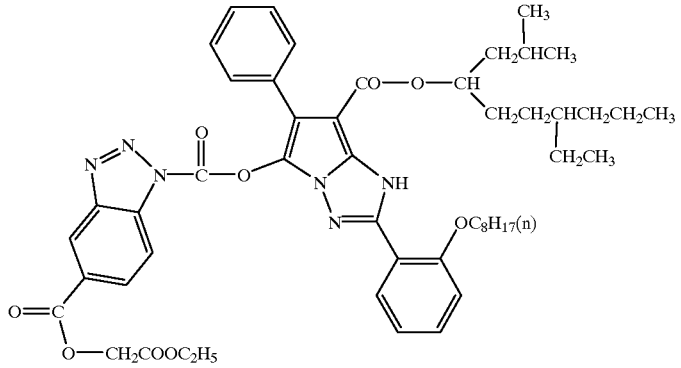
(C-39)
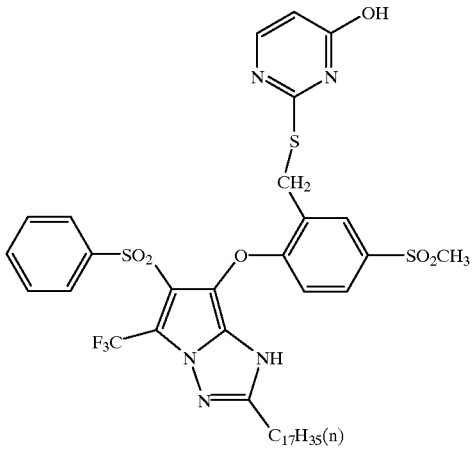
(C-40)
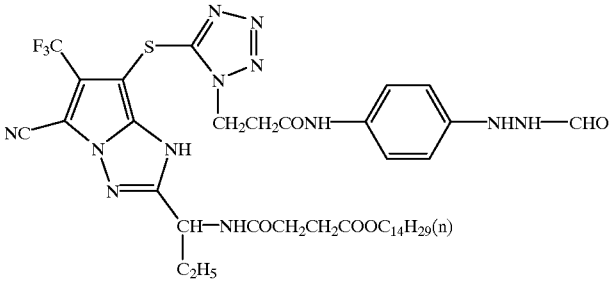

-continued
(C-41)
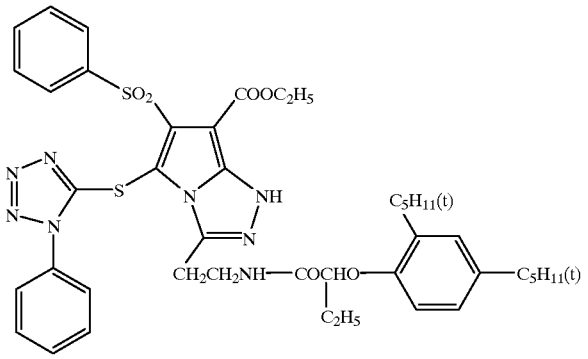
(C-42)
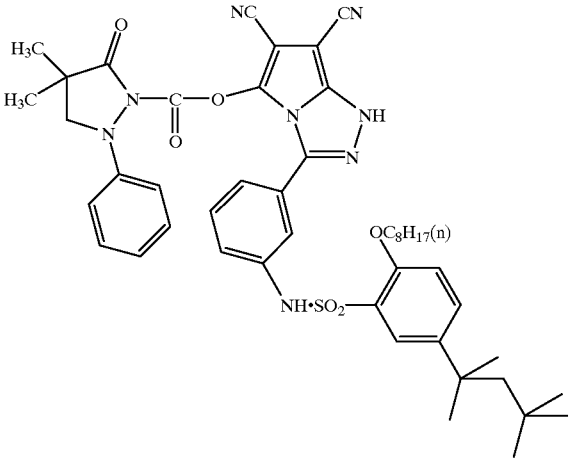
(C-43)
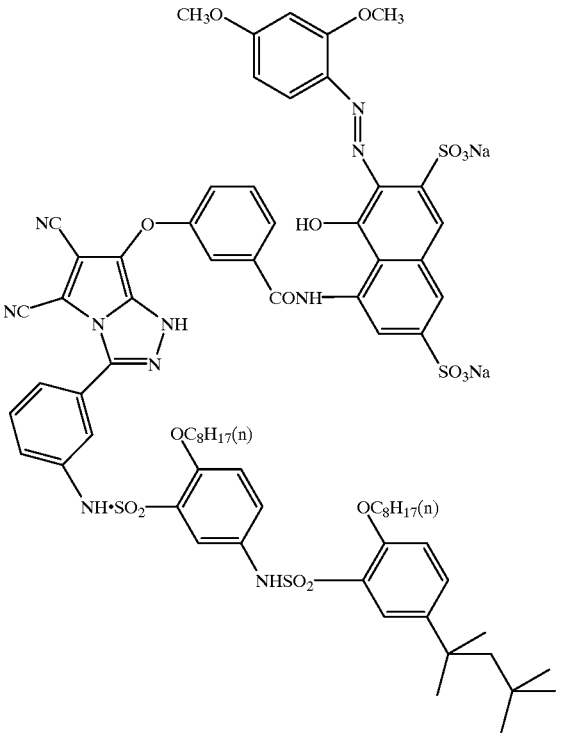

-continued
(C-44)
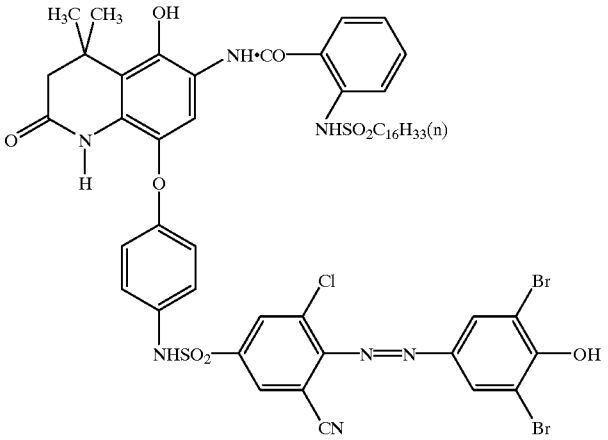
(C-45)
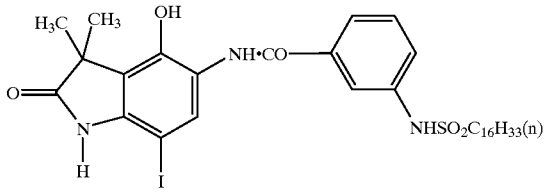
(C-46)
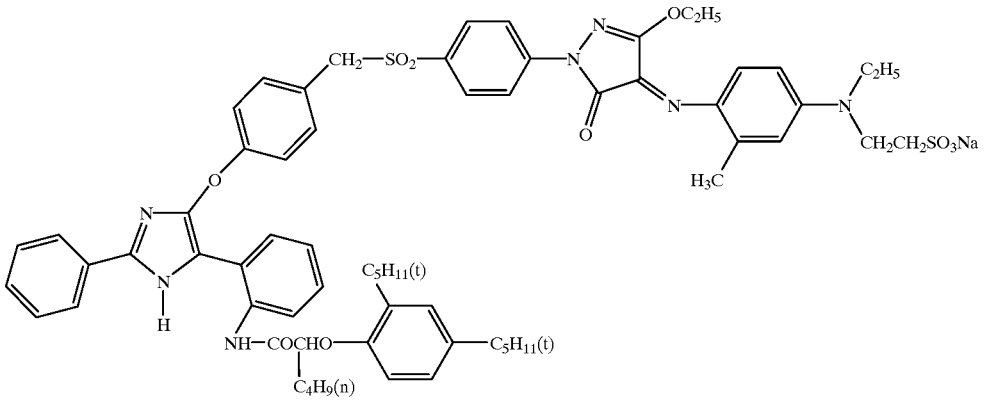
(C-47)
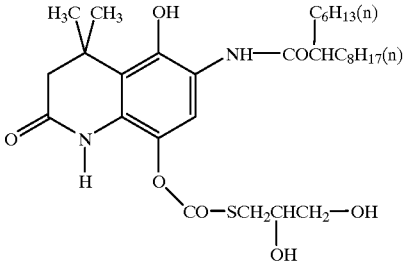

-continued
(C-48)
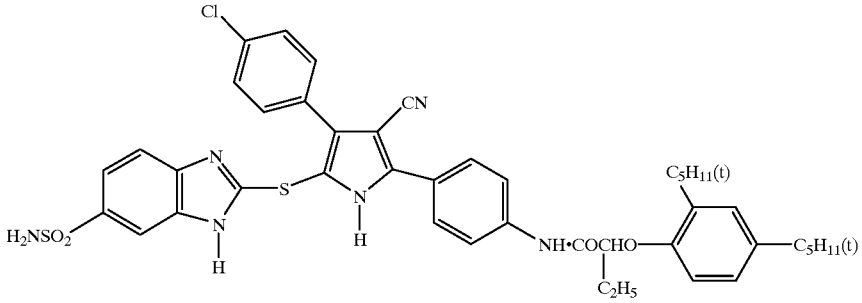
(C-49)
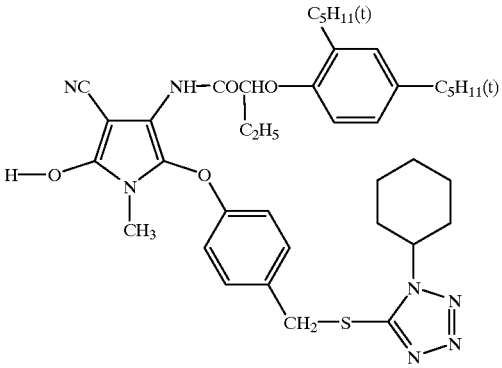
(C-50)
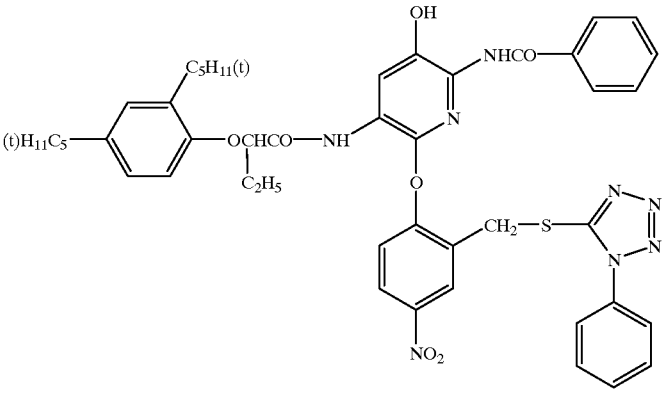
(C-51)
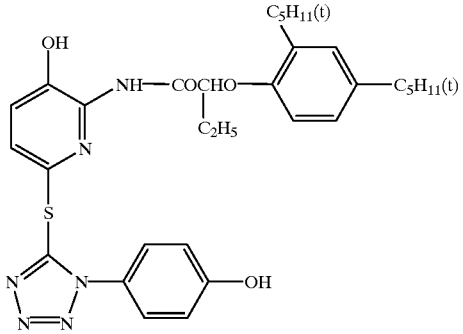

-continued
(C-52)
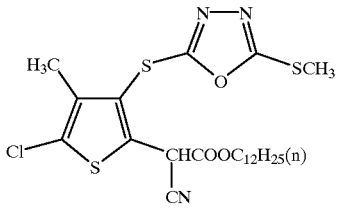
(C-53)
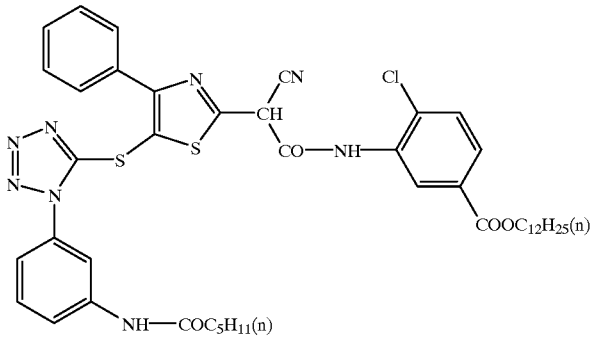
(C-54)
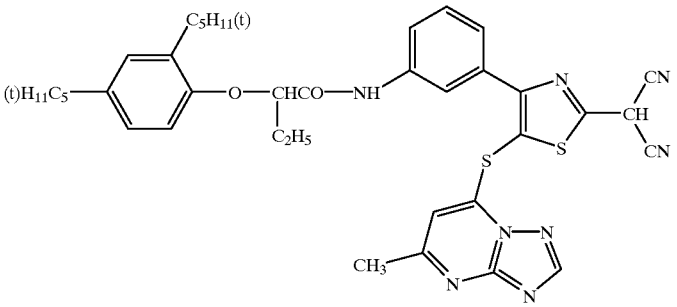
(C-55)
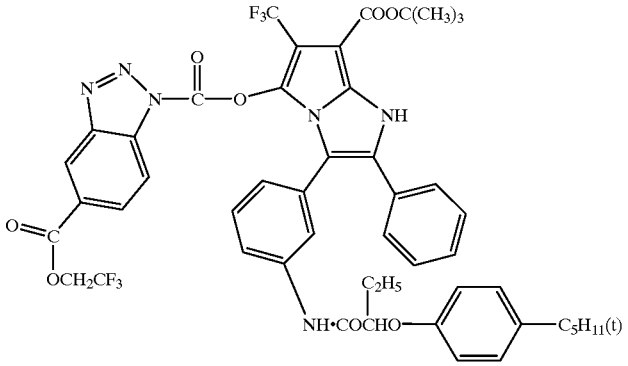

-continued (C-56)

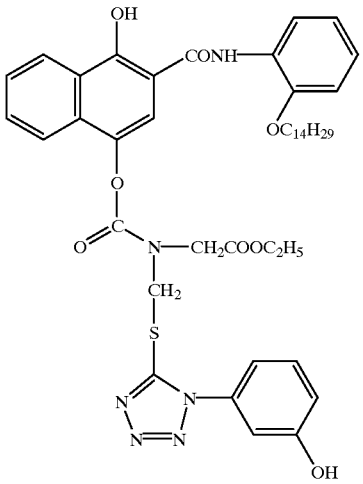

Suitable amount to be added, of the couplers represented by formula (II) that are used in the present invention, is generally of the order of $1\times10^{-4}$ to 100 mmol/$m^2$, preferably $1\times10^{-3}$ to 10 mmol/$m^2$, and more preferably $5\times10^{-3}$ to 5 mmol/$m^2$, in terms of the coated amount.

The amount of the color-developing agent represented by formula (I) for use in the present invention (preferably in the first invention) to be added, is generally 0.01 to 100 times, preferably 0.1 to 10 times, and more preferably 0.2 to 5 times, the amount of all the couplers used, in terms of mol.

A dye-forming coupler that forms dye image accompanied with the coupling reaction with a oxidation product of a color-developing agent represented by formula (I) for use in the present invention preferably in the second invention (hereinafter referred to as a dye-forming coupler) is explained. The dye-forming coupler for use in the present invention is preferably what called a two-equivalent coupler in the system in which a phenylendiamine-series color-developing agent is employed, and a combination of two or more couplers may be added to the same layer.

The dye-forming couplers that can be used in the present invention are preferably compounds represented by one of the above formulae (1) to (12). In formulae (1) to (12), Y is bonded at the site where a coupler residue (Cp) causes coupling reaction with an oxidation product of the color-developing agent represented by formula (I), and Y is a group capable of being split-off (removed) during a dye-formation process after the coupling reaction. Specific examples and preferable examples of Y are the same as those mentioned for the above formulae (1) to (12). In the second invention, at least one dye-forming coupler is used.

Specific examples of the dye-forming coupler for use in the present invention are shown below, but of course the scope of the present invention is not limited to these.

(D-1)

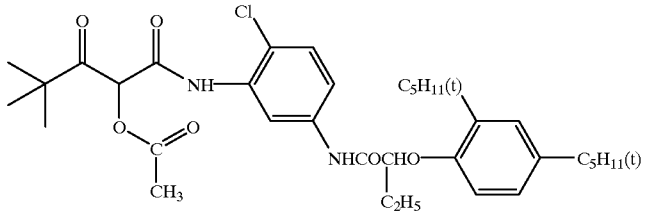

(D-2)

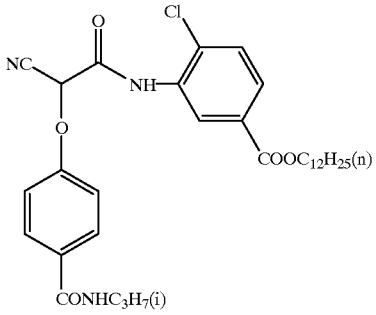

-continued
(D-3)
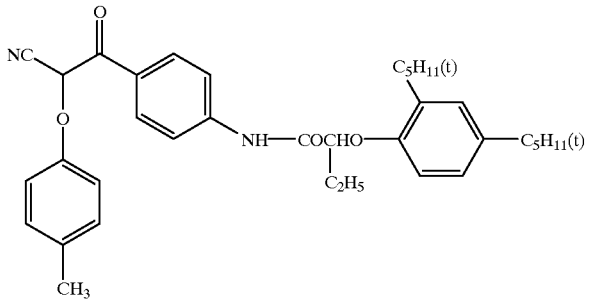
(D-4)
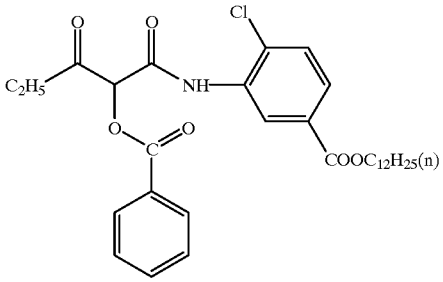
(D-5)
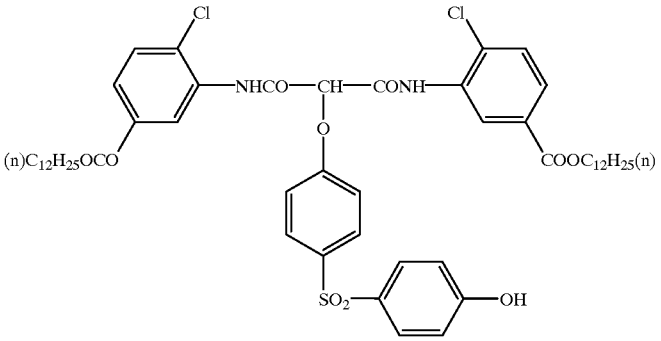
(D-6)
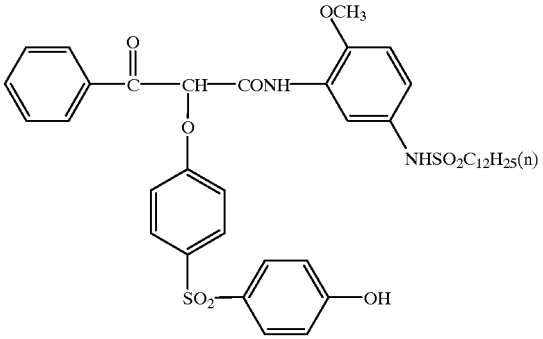

-continued
(D-7)
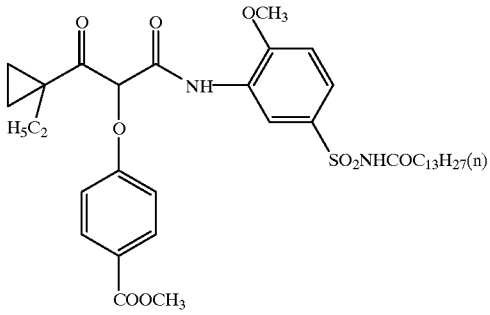
(D-8)
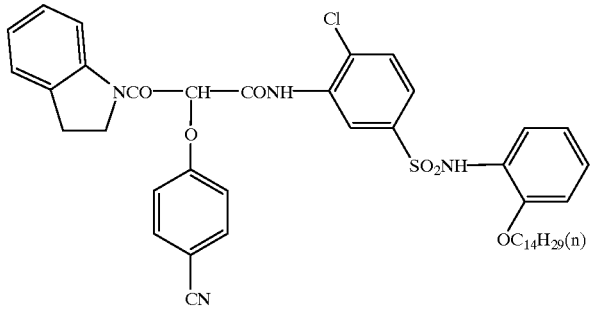
(D-9)
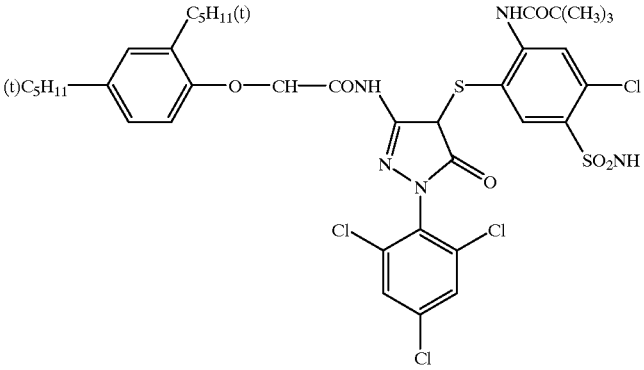
(D-10)
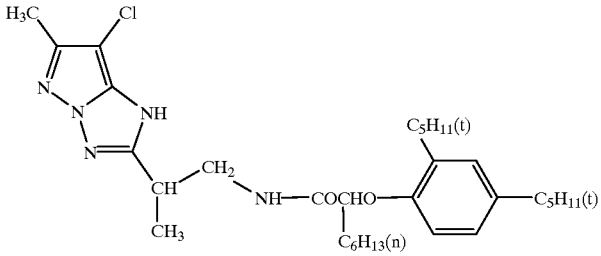

-continued
(D-11)
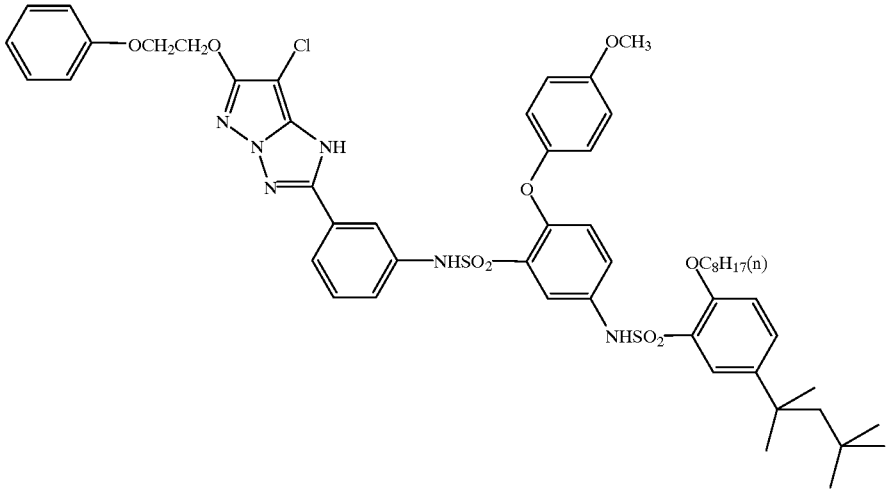
(D-12)
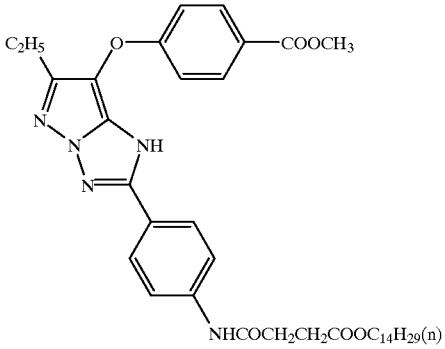
(D-13)
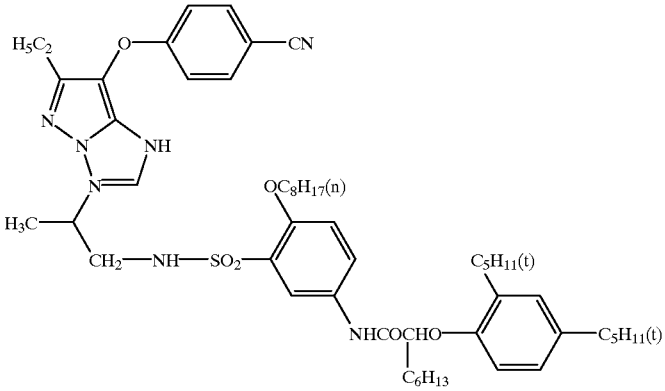
(D-14)
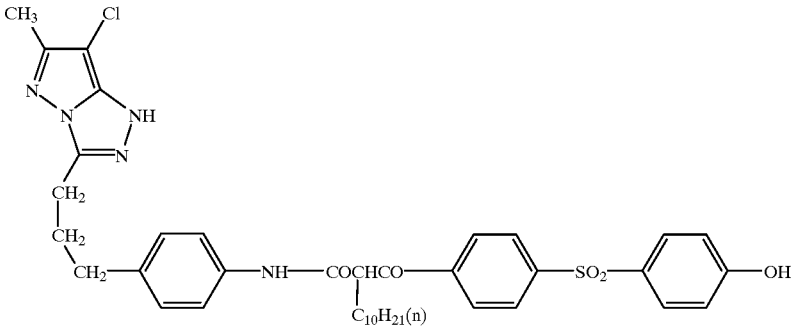

-continued
(D-15)
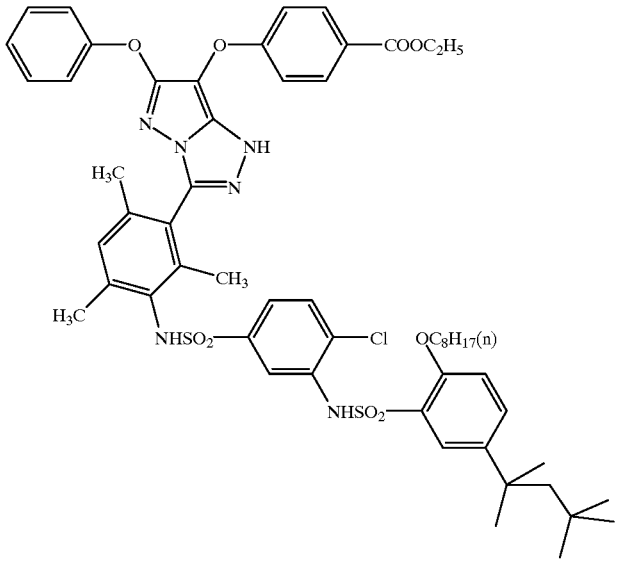
(D-16)
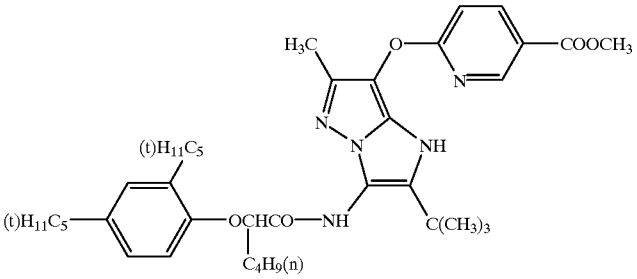
(D-17)
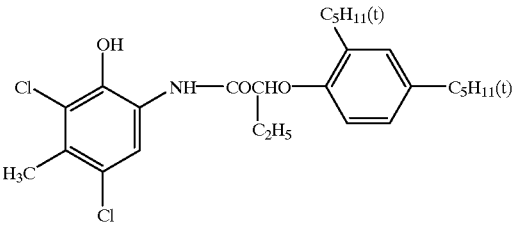
(D-18)
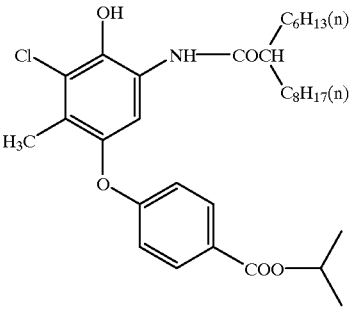

-continued
(D-19)
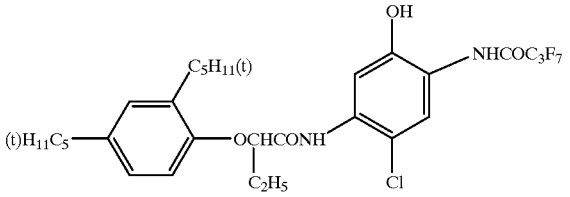
(D-20)
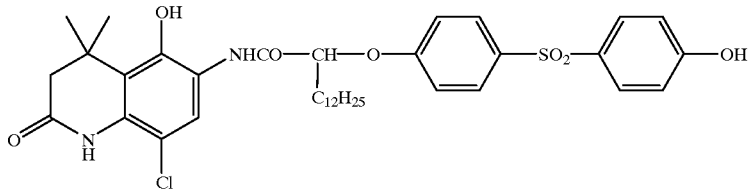
(D-21)
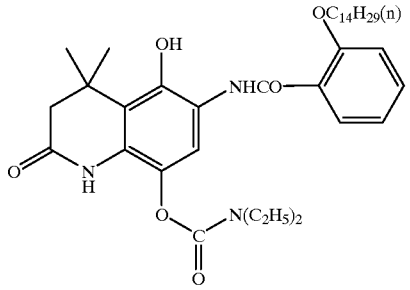
(D-22)
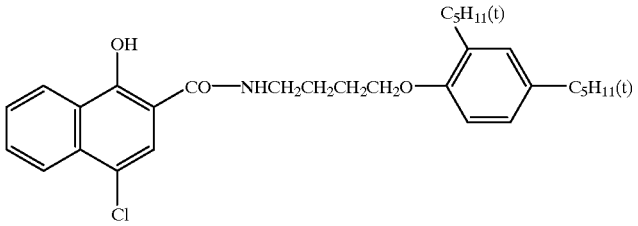
(D-23)
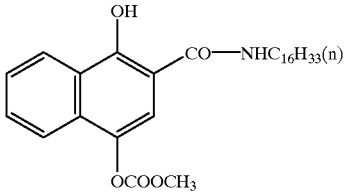
(D-24)
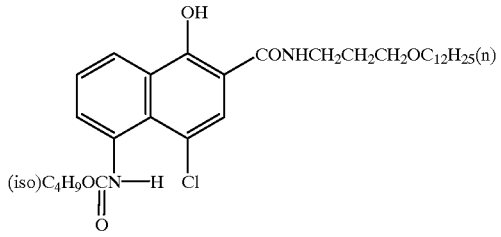

-continued (D-25)

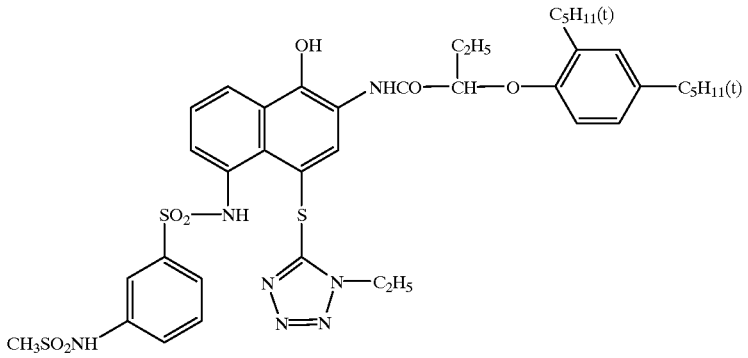

(D-26)

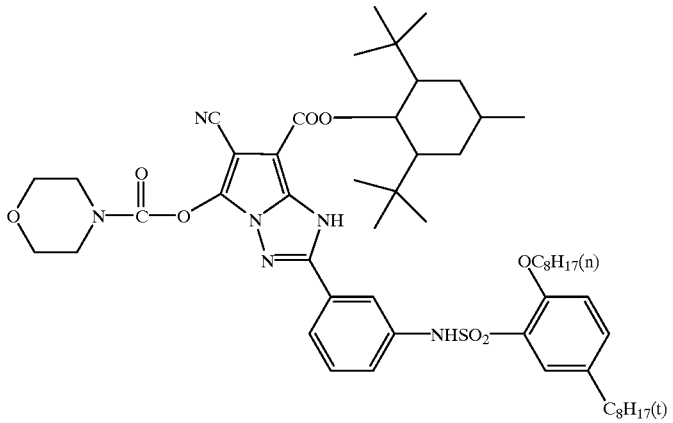

(D-27)

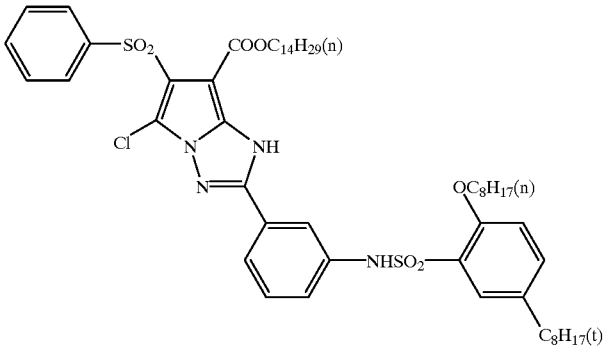

Now, the non-dye-forming coupler that is used in combination with the dye-forming coupler in the present invention is described. In the second invention, at least one non-dye-forming coupler is used.

The non-dye-forming coupler in the present invention is preferably a coupler whose active site is unsubstituted. The non-dye-forming coupler may be added into the same layer as the dye-forming coupler or into the layer adjacent to the layer of the dye-forming coupler, but preferably the non-dye-forming coupler is added to the same layer as the dye-forming coupler.

In the present invention, the rate of the coupling reaction of the coupler, whose active site is unsubstituted, with the oxidation product of the color-developing agent represented by formula (I), is preferably a relative rate at least 0.1 times, more preferably at least 1.0 times, further more preferably at least 5.0 times, and most preferably at least 10.0 times, greater than the rate of the dye-forming coupler having the fastest coupling-reaction rate present in the same light-sensitive layer or the adjacent layer. The greater the value of this ratio of the coupling reaction rates is, the more preferable it is, and there is no particular upper limit, but the upper limit is preferably about $10^8$ or less. The coupling reaction rate is a value that is measured in a THF/water (volume ratio: 6:4) system under conditions having a pH of 11.

As the coupler for use in the present invention whose active site is unsubstituted, out of the above dye-forming couplers, those wherein Y is replaced by hydrogen can be used. Since the couplers whose active site is unsubstituted do not contribute to the image density, ones that may have the same skeleton as that of the dye-forming coupler, or ones that have a skeleton different from that of the dye-forming coupler, can be used, and they may be used singly or as a combination of two or more.

Specific examples of the couplers whose active site is unsubstituted and that are used in the present invention are shown below, which do not limit the scope of the present invention.
(N-1)
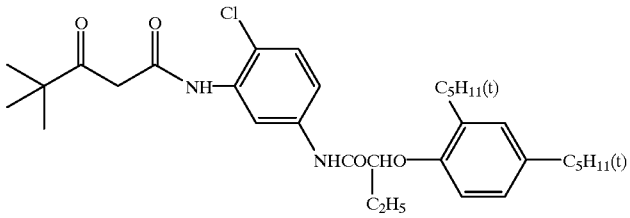
(N-2)
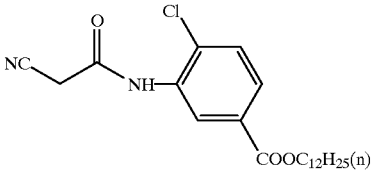
(N-3)
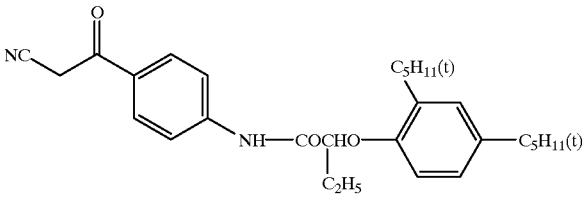
(N-4)
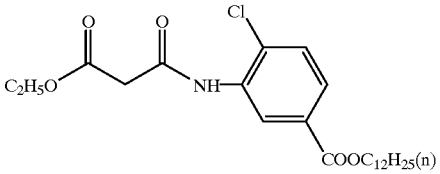
(N-5)
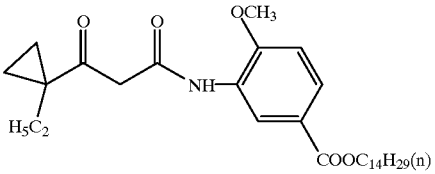
(N-6)
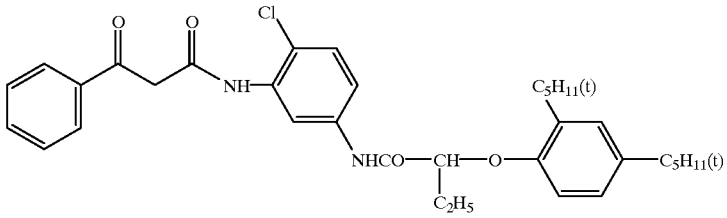

-continued
(N-7)
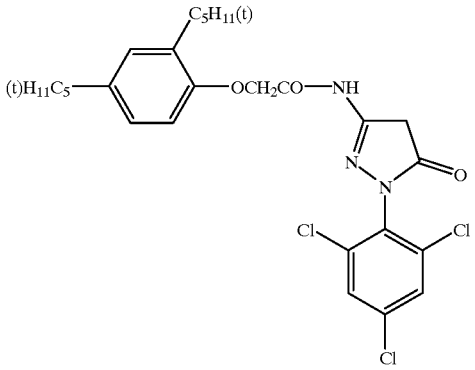
(N-8)
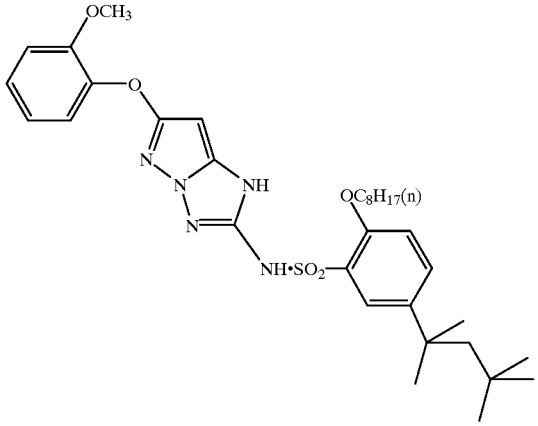
(N-9)
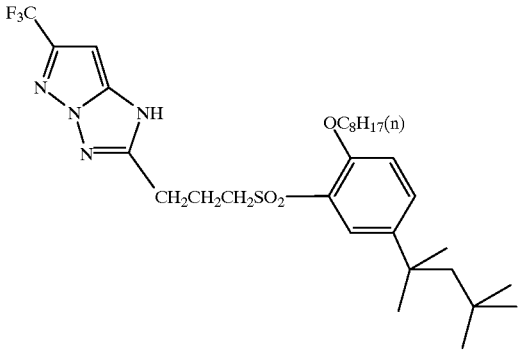
(N-10)
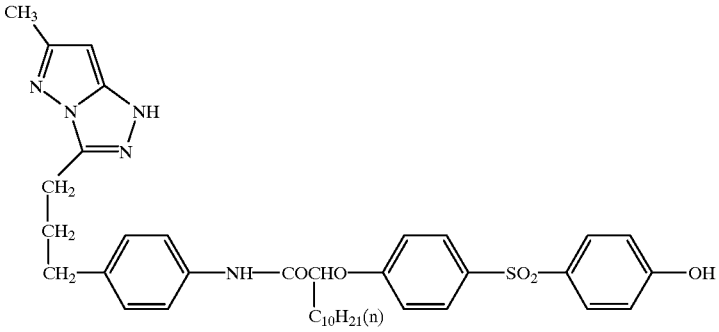

-continued
(N-11)
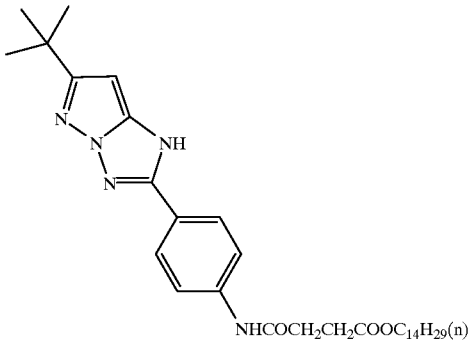
(N-12)
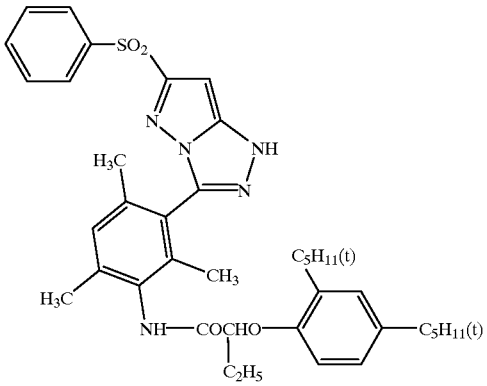
(N-13)
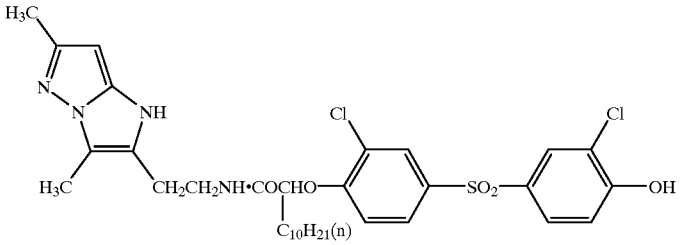
(N-14)
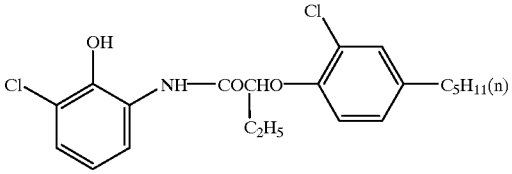
(N-15)
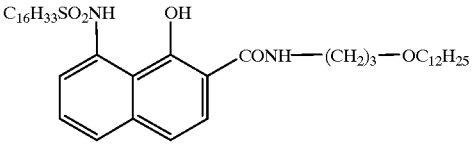
(N-16)
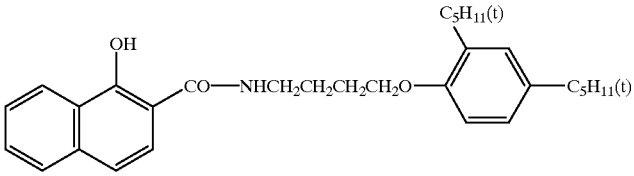

-continued
(N-17)
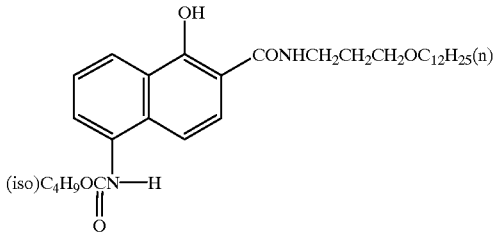
(N-18)
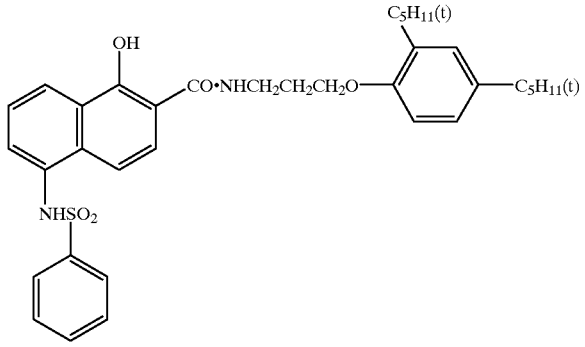
(N-19)
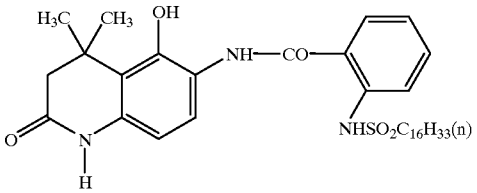
(N-20)
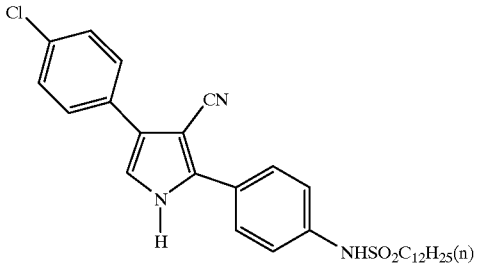
(N-21)
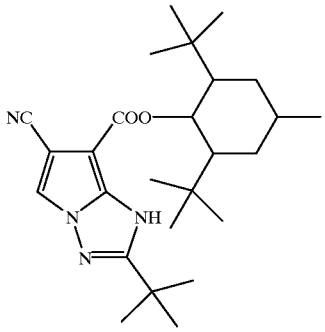

-continued (N-22)

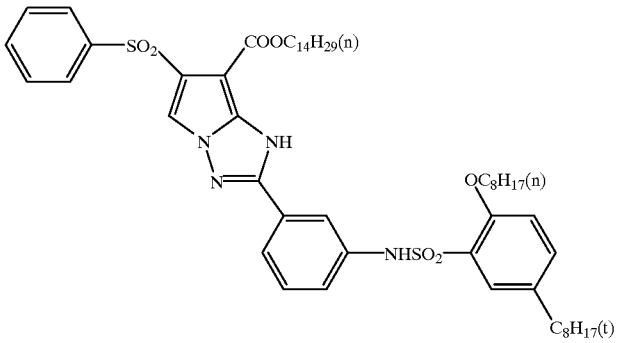

(N-23)

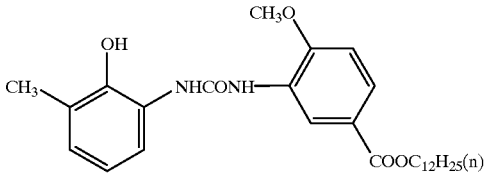

(N-24)

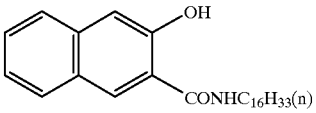

(N-25)

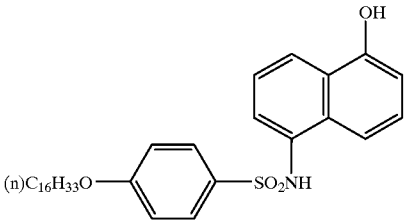

The amount to be added of the dye-forming coupler that is used in the present invention preferably in the second invention, varies depending on the molar extinction coefficient ($\epsilon$) of the dye that will be formed. In order to secure an image density of 1.0 or more in terms of reflection density, suitably the amount to be added in the case of a coupler that will undergo coupling to produce a dye whose $\epsilon$ is on the order of 5,000 to 500,000, is generally about 0.001 to 100 mmol/m$^2$, preferably about 0.01 to 10 mmol/m$^2$, and more preferably about 0.05 to 5 mmol/m$^2$, in terms of the coating amount.

The amount to be added of the coupler whose active site is unsubstituted and that is used in the present invention preferably in the second invention, is generally about 0.0001 to 10 times, preferably 0.001 to 5 times, more preferably 0.01 to 1 times, and further more preferably 0.02 to 0.5 times, the amount of the dye-forming coupler.

The amount of the color-developing agent represented by formula (I) for use in the present invention (preferably in the second invention) to be added, is generally 0.01 to 100 times, preferably 0.1 to 10 times, and more preferably 0.2 to 5 times, the total amount of the dye-forming couplers and the non-dye-forming couplers which are used in combination with each color-developing agent, in terms of mol.

In the present invention, an auxiliary developing agent can be preferably used. Herein the term "an auxiliary developing agent" means a substance that promotes the transfer of electrons from the color-developing agent to silver halides in the development process of the silver halide development; and in the present invention, preferably the auxiliary developing agent is a compound capable of releasing electrons according to the Kendall-Pelz rule, which compound is represented preferably by formula (B-1) or (B-2), with particular preference given to those of formula (B-1).

formula (B-1)

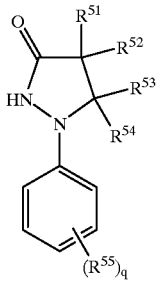

formula (B-2)

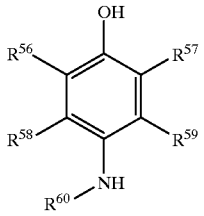

In formulae (B-1) and (B-2), $R^{51}$ to $R^{54}$ each represent a hydrogen atom, an alkyl group, a cycloalkyl group, an alkenyl group, an aryl group, or a heterocyclic group.

$R^{55}$ to $R^{59}$ each represent a hydrogen atom, a halogen atom, a cyano group, an alkyl group, a cycloalkyl group, an alkenyl group, an aryl group, a heterocyclic group, an alkoxy group, a cycloalkyloxy group, an aryloxy group, a heterocyclicoxy group, a silyloxy group, an acyloxy group, an amino group, an anilino group, a heterocyclicamino group, an alkylthio group, an arylthio group, a heterocyclicthio group, a silyl group, a hydroxyl group, a nitro group, an alkoxycarbonyloxy group, a cycloalkyloxycarbonyloxy group, an aryloxycarbonyloxy group, a carbamoyloxy group, a sulfamoyloxy group, an alkanesulfonyloxy group, an arenesulfonyloxy group, an acyl group, an alkoxycarbonyl group, a cycloalkyloxycarbonyl group, an aryloxycarbonyl group, a carbamoyl group, a carbonamido group, a ureido group, an imido group, an alkoxycarbonylamino group, an aryloxycarbonylamino group, a sulfonamide group, a sulfamoylamino group, an alkylsulfinyl group, an arenesulfinyl group, an alkanesulfonyl group, an arenesulfonyl group, a sulfamoyl group, a sulfo group, a phosphinoyl group, or a phosphinoylamino group.

q is an integer of 0 to 5, and when q is 2 or more, $R^{55}$'s may be different. $R^{60}$ represents an alkyl group or an aryl group.

Compounds represented by formula (B-1) or (B-2) are shown specifically below, but the auxiliary developing agent used in the present invention is not limited to these specific examples.

(ETA-1)

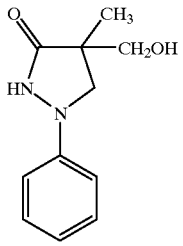

-continued (ETA-2)

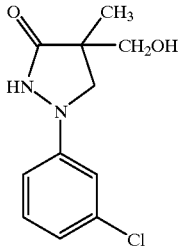

(ETA-3)

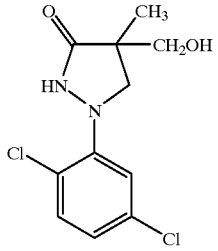

(ETA-4)

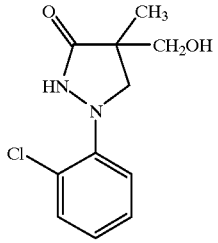

(ETA-5)

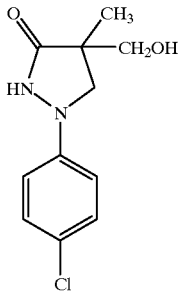

(ETA-6)

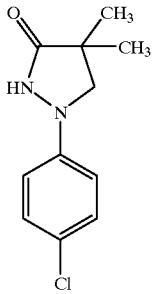

-continued
(ETA-7)
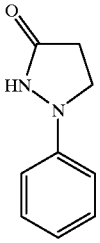
(ETA-8)
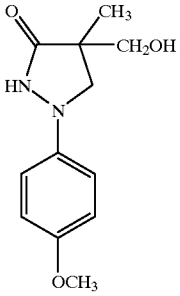
(ETA-9)
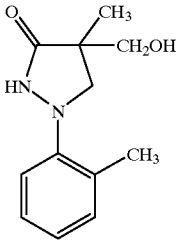
(ETA-10)
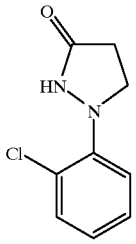
(ETA-11)
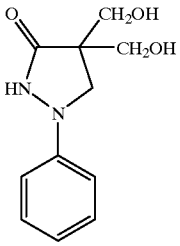
-continued
(ETA-12)
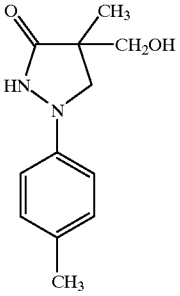
(ETA-13)
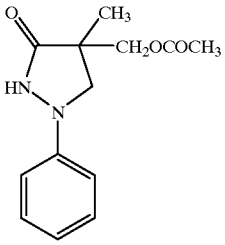
(ETA-14)
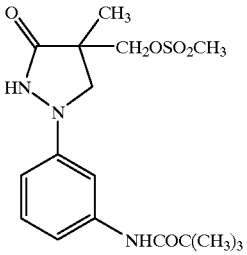
(ETA-15)
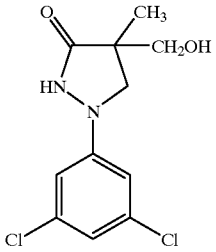
(ETA-16)
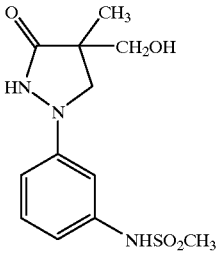

-continued
(ETA-17)
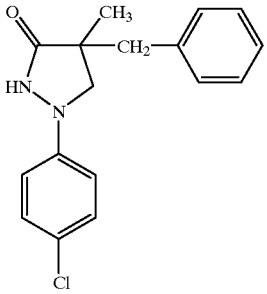
(ETA-18)
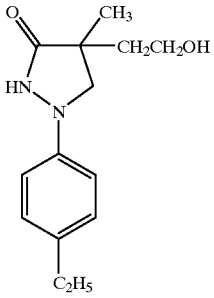
(ETA-19)
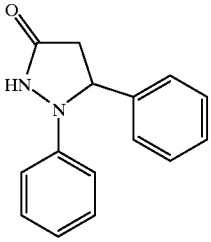
(ETA-20)
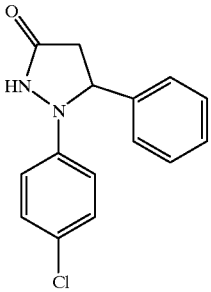
(ETA-21)
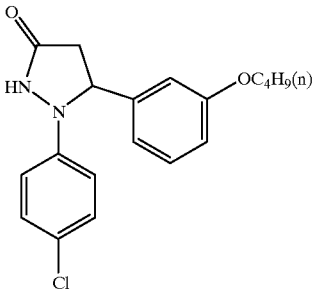
-continued
(ETA-22)
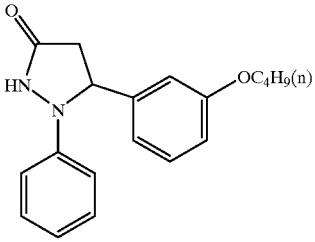
(ETA-23)
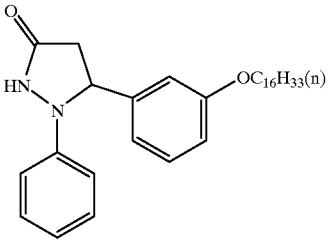
(ETA-24)
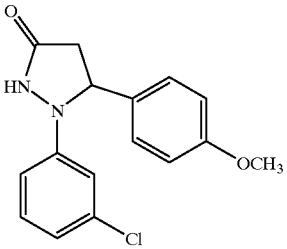
(ETA-25)
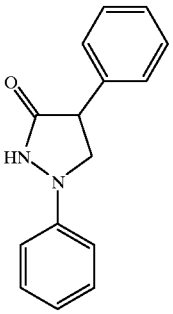
(ETA-26)
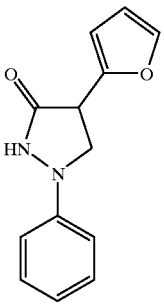

-continued
(ETA-27)
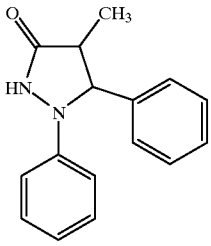
(ETA-28)
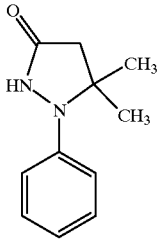
(ETA-29)
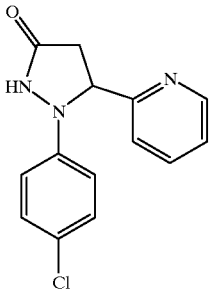
(ETA-30)
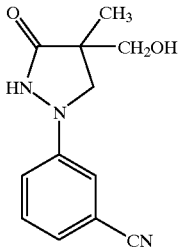
(ETA-31)
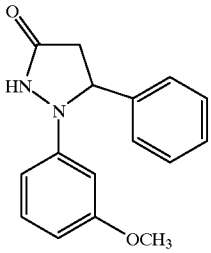
-continued
(ETA-32)
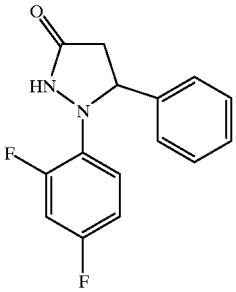
(ETA-33)
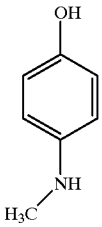
(ETA-34)
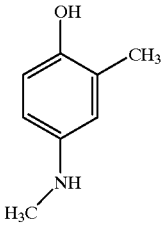
(ETA-35)
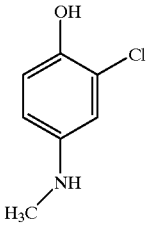
(ETA-36)
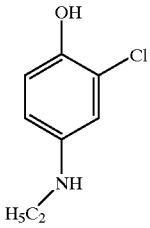
In the present invention (both the first and second inventions, preferably the second invention), a blocked photographic reagent, represented by formula (A), that will release a photographically useful group at the time of processing, can be used:

$A—(L)_n—PUG(1)$ Formula (A)

A represents a blocking group whose bond to $(L)_n$—PUG (1) will be split off at the time of development processing; L represents a linking group whose right bond (in the above formula (A)) will be split off after the bond on the left of L is split off; n is an integer of 0 to 3; and PUG(1) represents a photographically useful group.

Groups represented by formula (A) will now be described.

As the blocking group represented by A, the following already known groups can be used: blocking groups described, for example, in JP-B-48-9968, JP-A-52-8828 and 57-82834, U.S. Pat. No. 3,311,476, and JP-B-47-44805 (U.S. Pat. No. 3,615,617), such as an acyl group and a sulfonyl group; blocking groups that use the reverse Michael reaction, as described, for example, in JP-B-55-17369 (U.S. Pat. No. 3,888,677), 55-9696 (U.S. Pat. No. 3,791,830), and 55-34927 (U.S. Pat. No. 4,009,029), and JP-A-56-77842 (U.S. Pat. No. 4,307,175), 59-105640, 59-105641, and 59-105642; blocking groups that use the formation of quinone methide, or a compound similar to quinone methide, by intramolecular electron transfer, as described, for example, in JP-B-54-39727, U.S. Pat. Nos. 3,674,478, 3,932,480, and 3,993,661, and JP-A-57-135944, 57-135945 (U.S. Pat. No. 4,420,554), 57-136640, 61-196239, 61-196240 (U.S. Pat. No. 4,702,999), 61-185743, 61-124941 (U.S. Pat. No. 4,639,408), and 2-280140; blocking groups that use intramolecular nucleophilic substitution reaction, as described, for example, in U.S. Pat. Nos. 4,358,525 and 4,330,617, and JP-A-55-53330 (U.S. Pat. No. 4,310,612), 59-121328, 59-218439, and 63-318555 (EP-0 295 729); blocking groups that use ring cleavage of a 5-membered ring or 6-membered ring, as described, for example, in JP-A-57-76541 (U.S. Pat. No. 4,335,200), 57-135949 (U.S. Pat. No. 4,350,752), 57-179842, 59-137945, 59-140445, 59-219741, 59-202459, 60-41034 (U.S. Pat. No. 4,618,563), 62-59945 (U.S. Pat. No. 4,888,268), 62-65039 (U.S. Pat. No. 4,772,537), 62-80647, 3-236047, and 3-238445; blocking groups that use the addition reaction of a nucleophilic reagent to a conjugated unsaturated bond, as described, for example, in JP-A-59-201057 (U.S. Pat. No. 4,518,685), 61-95346 (U.S. Pat. No. 4,690,885), 61-95347 (U.S. Pat. No. 4,892,811), 64-7035, 1-42650 (U.S. Pat. No. 5,066,573), 1-245255, 2-207249, 2-235055 (U.S. Pat. No. 5,118,596), and 4-186344; blocking groups that use the β-elimination reaction, as described, for example, in JP-A-59-93442, 61-32839, and 62-163051, and JP-B-5-37299; blocking groups that use the nucleophilic substitution reaction of diarylmethanes, as described in JP-A-61-188540; blocking groups that uses the Lossen rearrangement reaction, as described in JP-A-62-187850; blocking groups that use the reaction between the N-acylated product of thiazolidin-2-thion and amines, as described in JP-A-62-80646, 62-144163, and 62-147457; and blocking groups that have two nucleophilic groups to react with two nucleophilic agents, as described in JP-A-2-296240 (U.S. Pat. No. 5,019,492), 4-177243, 4-177244, 4-177245, 4-177246, 4-177247, 4-177248, 4-177249, 4-179948, 4-184337, and 4-184338, WO-A-92/21064, JP-A-4-330438, WO-A-93/03419, and JP-A-5-45816, as well as JP-A-3-236047 and 3-238445.

The group represented by L in the compound represented by formula (A) may be any linking group that can be split off from the group represented by A, at the time of development processing, and that then can split $(L)_{n-1}$—PUG(1). Examples are groups that use the split of a hemi-acetal ring, as described in U.S. Pat. Nos. 4,146,396, 4,652,516, and 4,698,297; timing groups that bring about an intramolecular nucleophilic substitution reaction, as described in U.S. Pat. Nos. 4,248,962, 4,847,185, or 4,857,440; timing groups that use an electron transfer reaction to bring about a cleavage reaction, as described in U.S. Pat. No. 4,409,323 or U.S. Pat. No. 4,421,845; groups that use the hydrolysis reaction of an iminoketal to bring about a cleavage reaction, as described in U.S. Pat. No. 4,546,073; groups that use the hydrolysis reaction of an ester to bring about a cleavage reaction, as described in West German Publication Patent No. 2 626 317; or groups that use a reaction with sulfite ions to bring about a cleavage reaction, as described in EP-0 572 084.

PUG(1) in formula (A) will now be described.

PUG(1) in formula (A) represents a group photographically useful for an antifoggant, a photographic dye, and the like, and in the present invention the auxiliary developing agents represented by formula (B-1) or (B-2) are particularly preferably used for PUG(1).

When the auxiliary developing agents represented by formula (B-1) or (B-2) correspond to PUG(1) of formula (A), the bonding position is at the oxygen atom or nitrogen atom of the auxiliary developing agent.

The photographic light-sensitive material of the present invention, basically, has on a base, a light-sensitive silver halide, a color-developing agent, couplers, a binder, and, if required, an organic metal salt oxidant, and the like. In many cases, these components are added to the same layer (light-sensitive layer or non-light-sensitive layer), but they can be separately added to different layers if they are in reactive states.

Hydrophobic additives used in the present invention, such as couplers and the color-developing agent, can be introduced into layers (hydrophilic colloid layers, such as emulsion layers) of a light-sensitive material by a known method, such as the one described in U.S. Pat. No. 2,322,027. In this case, use is made of a high-boiling organic solvent as described, for example, in U.S. Pat. Nos. 4,555,470, 4,536,466, 4,536,467, 4,587,206, 4,555,476, and 4,599,296, and JP-B-3-62256, if necessary, in combination with a low-boiling organic solvent having a boiling point of 50 to 160° C. These couplers, color reducing agents, nondiffusion reducing agents, high-boiling organic solvents, and the like can be used in the form of a combination of two or more.

The high-boiling organic solvent is used in an amount of generally 10 g or less, preferably 5 g or less, and more preferably 1 g to 0.1 g, per g of the compound for forming a color image. The amount is also preferably 1 cc or less, particularly 0.5 cc or less, and more particularly 0 or more but 0.3 cc or less, per g of the binder.

A dispersion method that use a polymer, as described in JP-B-51-39853 and JP-A-51-59943, and a method wherein the addition is made with them in the form of a dispersion of fine particles, as described, for example, in JP-A-62-30242 and 63-271339, can also be used.

If the hydrophobic additives are compounds substantially insoluble in water, besides the above methods, a method can be used wherein the compounds may be made into fine particles to be dispersed and contained in a binder.

In dispersing the hydrophobic compound in a hydrophilic colloid, various surface-active agents can be used; examples are listed in JP-A-59-157636, pages 37 to 38, and in the RD publication shown in a table below.

In the light-sensitive material of the present invention, use can be made of a compound that can activate the development and make the image stable. Preferable specific compounds for use are described in U.S. Pat. No. 4,500,626, the 51st column to the 52nd column.

In order to obtain colors ranging widely on the chromaticity diagram by using three primary colors: yellow, magenta, and cyan, use is made of a combination of at least three silver halide emulsion layers photosensitive to respectively different spectral regions. For examples, a combination of three layers of a blue-sensitive layer, a green-sensitive layer, and a red-sensitive layer, and a combination of a green-sensitive layer, a red-sensitive layer, and an infrared-sensitive layer, can be mentioned. The photosensitive layers can be arranged in various orders known generally for color light-sensitive materials. Further, each of these photosensitive layers can be divided into two or more layers if necessary.

In the light-sensitive material, various auxiliary layers can be provided, such as a protective layer, an underlayer, an intermediate layer, an antihalation layer, and a backing layer. Further, in order to improve the color separation, various filter dyes can be added.

The silver halide emulsion that can be used in the present invention may be made of any of silver chloride, silver bromide, silver iodobromide, silver chlorobromide, silver chloroiodide, and silver chloroiodobromide.

The silver halide emulsion that is used in the present invention may be a surface-latent-image-type emulsion or an internal-latent-image-type emulsion. The internal-latent-image-type emulsion is used in combination with a nucleator or a light-fogging agent to be used as a direct reversal emulsion. A so-called core-shell emulsion, wherein the grain inside and the grain surface layer have different phases, and an emulsion wherein silver halides different in composition are joined epitaxially, may be used. The silver halide emulsion may be a monodisperse or a polydisperse emulsion. A technique is preferably used wherein the gradation is adjusted by mixing monodisperse emulsions, as described in JP-A-1-167743 or 4-223643. The grain size is preferably 0.1 to 2 $\mu$m, and particularly preferably 0.2 to 1.5 $\mu$m. The crystal habit of the silver halide grains may be any of regular crystals, such as cubic crystals, octahedral crystals and tetradecahedral crystals; irregular crystals, such as spherical crystals and tabular crystals having a high aspect ratio; crystals having crystal defects, such as twin planes, or other composite crystals of these.

Specifically, any of silver halide emulsions can be used that are prepared by methods described, for example, in U.S. Pat. No. 4,500,626, column 50; U.S. Pat. No. 4,628,021, Research Disclosure (hereinafter abbreviated to as RD) No. 17,029 (1978), RD No. 17,643 (December 1978), pages 22 to 23;. RD No. 18,716 (November 1979), page 648; RD No. 307,105 (November 1989), pages 863 to 865; JP-A-62-253159, 1-13546, 2-236546, and 3-110555; by P. Glafkides in *Chemie et Phisique Photographique*, Paul Montel (1967); by G. F. Duffin in Photographic Emulsion Chemistry, Focal Press, 1966; and by V. L. Zelikman et al., in *Making and Coating Photographic Emulsion*, Focal Press, 1964.

When tabular grains are used, such merits are obtained that the covering power is increased and the color sensitization efficiency due to a sensitizing dye is increased, as described in detail in U.S. Pat. No. 4,434,226. The average aspect ratio of 80% or more of all the projected areas of grains is desirably 1 or more but less than 100, more preferably 2 or more but less than 20, and particularly preferably 3 or more but less than 10. As the shape of tabular grains, a triangle, a hexagon, a circle, and the like can be chosen. A regular hexagonal shape having six approximately equal sides, described in U.S. Pat. No. 4,798,354, is a preferable mode.

In many cases, the grain size of tabular grains is expressed by the diameter of the projected area assumed to be a circle, and grains having an average diameter of 0.6 microns or below, as described in U.S. Pat. No. 4,748,106, are preferable, because the quality of the image is made high. An emulsion having a narrow grain size distribution, as described in U.S. Pat. No. 4,775,617, is also preferable. It is preferable to restrict the shape of tabular grains so that the thickness of the grains may be 0.5 microns or below, and more preferably 0.3 microns or below, because the sharpness is increased. Further, an emulsion in which the grains are highly uniform in thickness, with the deviation coefficient of grain thickness being 30% or below, is also preferable. Grains in which the thickness of the grains and the plane distance between twin planes are defined, as described in JP-A-63-163451, are also preferable.

In the case of tabular grains, it is possible to observe dislocation lines under a transmission-type electron microscope. In accordance with the purpose, it is preferable to choose grains having no dislocation lines, grains having several dislocation lines, or grains having many dislocation lines. Dislocation introduced straight in a special direction in the crystal orientation of grains, or curved dislocation, can be chosen, and it is possible to choose from, for example, dislocation introduced throughout grains, dislocation introduced in a particular part of grains, and dislocation introduced limitedly to a particular part such as fringes of grains. In addition to the case of introduction of dislocation lines into tabular grains, also preferable is the case of introduction of dislocation lines into regular crystalline grains or irregular grains, represented by potato grains. In this case, a preferable mode is that introduction is limited to a particular part of grains, such as vertexes and edges.

The light-sensitive silver halide emulsion that is used in the present invention may contain a heavy metal, such as iridium, rhodium, platinum, cadmium, zinc, thallium, lead, iron, osmium, and chromium, for various purposes. The compounds of the heavy metal may be used singly or in the form of a combination of two or more. Further, these compounds may be added in the form of a salt, such as a chloride, a bromide, and a cyanide, as well as in the form of various complex salts. The amount to be added varies depending on the purpose of the application; but the amount is generally on the order of $10^{-9}$ to $10^{-3}$ mol per mol of the silver halide. When they are incorporated, they may be incorporated uniformly in the grains, or they may be localized in the grains or on the surface of the grains. Specifically, emulsions described, for example, in JP-A-2-236542, 1-116637, and 5-181246 are preferably used.

Further, to quicken the growth of the crystals, the concentrations, the amounts, and the speeds of the silver salt and the halide to be added may be increased (e.g. JP-A-55-142329 and 55-158124, and U.S. Pat. No. 3,650,757). As the method of stirring the reaction liquid, any of known stirring methods may be used. The temperature and the pH of the reaction liquid during the formation of the silver halide grains may be set arbitrarily to meet the purpose. Preferably the pH range is 2.2 to 8.5, and more preferably 2.5 to 7.5.

In the case of a heat-development light-sensitive material, the light-sensitive silver halide emulsion may be used together with an organosilver salt oxidizing agent. As the organic compounds that can be used to form it, benzotriazoles, aliphatic acids, and other compounds, as described in U.S. Pat. No. 4,500,626, columns 52 to 53, can be mentioned. Acetylene silver, described in U.S. Pat. No. 4,775,613, is also useful. Organosiliver salts may be used in the form of a combination of two or more.

The above organosilver salts may be used additionally in an amount of generally 0.01 to 10 mol, and preferably 0.01 to 1 mol, per mol of the light-sensitive silver halide. Suitably the total coating amount of the light-sensitive silver halide emulsion plus the organosilver salt is generally 0.05 to 10 $g/m^2$, and preferably 0.1 to 4 $g/m^2$, in terms of silver.

The light-sensitive silver halide emulsion is generally a chemically sensitized silver halide emulsion. To chemically sensitize the light-sensitive silver halide emulsion for use in the present invention, for example, a known chalcogen sensitization method, such as the sulfur sensitization method, the selenium sensitization method, and the tellurium sensitization method; the noble metal sensitization method, wherein gold, platinum, or palladium is used; and the reduction sensitization method, can be used alone or in combination (e.g. JP-A-3-110555 and 5-241267).

As the tellurium sensitizer, compounds described in CA-800 958, GB-1 295 462 and 1 396 696, and Japanese patent application Nos. 2-333819 and 3-131598 can be used, and specific tellurium sensitizers include colloidal tellurium, telluroureas (e.g. tetramethyltellurourea, N-carboxyethyl-N', N'-dimethyltellurourea, and N,N'-dimethylethylenetelluorourea), isotellurocyanates, telluroketones, telluroamides, tellurohydrazides, telluroesters, phosphine tellurides (e.g. tributylphosphine telluride and butyldiisopropylphosphine telluride), and other tellurium compounds (e.g. potassium tellurocyanate and sodium telluropentathionate).

The amount to be added of the tellurium sensitizer is generally on the order of $10^{-7}$ to $5\times10^{-2}$ mol, and preferably $5\times10^{-7}$ to $10^{-3}$ mol, per mol of the silver halide.

Further, during the process of the production of the silver halide emulsion, an oxidizing agent for silver is preferably used.

Preferable oxidizing agents are ozone, hydrogen peroxide and its adducts, halogen elements, inorganic oxidizing agents of thiosulfonates, and organic oxidizing agents of quinones. The use of a combination of the above reduction sensitization with the oxidizing agent for silver is a preferable mode. After the use of the oxidizing agent, reduction sensitization may be carried out, or the order may be reversed, or a method wherein both are present simultaneously can be chosen to use. These methods can be selectively used in the step of forming grains or in the chemical sensitizing step. These chemical sensitizations can be carried out in the presence of a nitrogen-containing heterocyclic compound (JP-A-62-253159). Further, the below-mentioned antifoggant can be added after the completion of the chemical sensitization. Specifically, methods described in JP-A-5-45833 and 62-40446 can be used.

At the time of the chemical sensitization, the pH is preferably 5.3 to 10.5, and more preferably 5.5 to 8.5, and the pAg is preferably 6.0 to 10.5, and more preferably 6.8 to 9.0.

The coating amount of the light-sensitive silver halide emulsion used in the present invention is preferably in the range of 1 mg to 10 $g/m^2$ in terms of silver.

When the photosensitive silver halide used in the present invention is made to have color sensitivities of green sensitivity, red sensitivity, and infrared sensitivity, the photosensitive silver halide emulsion is spectrally sensitized with methine dyes or the like. If required, the blue-sensitive emulsion may be spectrally sensitized in the blue region.

Dyes that can be used include cyanine dyes, merocyanine dyes, composite cyanin dyes, composite merocyanine dyes, halopolar cyanine dyes, hemicyanine dyes, styryl dyes, and hemioxonol dyes.

Specifically, sensitizing dyes described, for example, in U.S. Pat. No. 4,617,257 and JP-A-59-180550, 1-13546, 5-45828, and 5-45834 can be mentioned.

These sensitizing dyes can be used singly or in combination, and a combination of these sensitizing dyes is often used, particularly for the purpose of adjusting the wavelength of the spectral sensitivity, and for the purpose of supersensitization.

Together with the sensitizing dye, a dye having no spectral sensitizing action itself, or a compound that does not substantially absorb visible light and that exhibits supersensitization, may be included in the emulsion (e.g. those described, for example, in U.S. Pat. No. 3,615,641 and JP-A-63-23145).

The time when these sensitizing dyes are added to the emulsion may be at a time of chemical ripening or before or after chemical ripening. Further, the sensitizing dye may be added before or after the formation of nuclei of the silver halide grains, in accordance with U.S. Pat. Nos. 4,183,756 and 4,225,666. Further, these sensitizing dyes and supersensitizing dyes may be added in the form of a solution of an organic solvent, such as methanol, or in the form of a dispersion of gelatin, or in the form of a solution of a surface-active agent. Generally the amount of the sensitizing dye to be added is of the order of $10^{-5}$ to $10^{-2}$ mol per mol of the silver halide.

These additives used in the above process, and conventionally known additives for photography that can be used in light-sensitive materials and dye-fixing materials, are described in more detail in Research Disclosure No. 17643; Research Disclosure No. 18176; and Research Disclosure No. 307105, and the particular parts are given below in a Table.

| Additive | RD 17643 | RD 18716 | RD 307105 |
|---|---|---|---|
| 1 Chemical sensitizers | p. 23 | p. 648 (right column) | p. 866 |
| 2 Sensitivity-enhancing agents | — | p. 648 (right column) | — |
| 3 Spectral sensitizers and Supersensitizers | pp. 23–24 | pp. 648 (right column)–649 (right column) | pp. 866–868 |
| 4 Brightening agents | p. 24 | p. 648 (right column) | p. 868 |
| 5 Antifogging agents and Stabilizers | pp. 24–25 | p. 649 (right column) | pp. 868–870 |
| 6 Light absorbers, Filter dyes, and UV Absorbers | pp. 25–26 | pp. 649 (right column)–650 (left column) | p. 873 |
| 7 Stain-preventing agents | p. 25 (right column) | p. 650 (left to right column) | p. 872 |
| 8 Image dye stabilizers | p. 25 | p. 650 (left column) | p. 872 |
| 9 Hardeners | p. 26 | p. 651 (left column) | pp. 874–875 |
| 10 Binders | p. 26 | p. 651 (left column) | pp. 873–874 |
| 11 Plasticizers and Lubricants | p. 27 | p. 650 (right column) | p. 876 |
| 12 Coating aids and Surface-active agents | pp. 26–27 | p. 650 (right column) | pp. 875–876 |
| 13 Antistatic agents | p. 27 | p. 650 (right column) | pp. 876–877 |
| 14 Matting agents | — | — | pp. 878–879 |

As the binder of the constitutional layers of the light-sensitive material, one that is hydrophilic is preferably used. Examples thereof include those described in the above-mentioned Research Disclosures and JP-A-1-13546, pages 71 to 75. Specifically, transparent or semitransparent hydrophilic binders are preferable, such as gelatin and gelatin derivatives.

As the gelatin, lime-processed gelatin, acid-processed gelatin, or so-called delimed gelatin, wherein the contents of calcium and the like are reduced, may be selected to meet the purpose, and a combination of these gelatins is also preferably used.

Other techniques and inorganic or organic materials that can also be used for color photographic light-sensitive materials of the present invention are described in the below-shown sections in EP-A-436 938 and the below-shown patents cited therein.

| | |
|---|---|
| 1) Layer structures | page 146, line 34 to page 147, line 25 |
| 2) Yellow couplers | page 137, line 35 to page 146, line 33 and page 149, lines 21 to 23 |
| 3) Magenta couplers | page 149, lines 24 to 28; and EP-A-421 453, page 3, line 5 to page 25, line 55 |
| 4) Cyan couplers | page 149, lines 29 to 33; and EP-A-432 804, page 3, line 28 to page 40, line 2 |
| 5) Polymer couplers | page 149, lines 34 to 38; and EP-A-435 334, page 113, line 39 to page 123, line 37 |
| 6) Colored couplers | page 53, line 42 to page 137, line 34 and page 149, lines 39 to 45 |
| 7) Other functional couplers | page 7, line 1 to page 53, line 41 and page 149, line 46 to page 150, line 3; and EP-A-435 334, page 3, line 1 to page 29, line 50 |
| 8) Antiseptics and mildewproofing agents | page 150, lines 25 to |
| 9) Formalin scavengers | page 149, lines 15 to 17 |
| 10) Other additives | page 153, lines 38 to 47; and EP-A-421 453, page 75, line 21 to page 84, line 56, and page 27, line 40 to page 37, line 40 |
| 11) Dispersion methods | page 150, lines 4 to 24 |
| 12) Supports | page 150, lines 32 to 34 |
| 13) Film thickness and film physical properties | page 150, lines 35 to 49 |
| 14) Desilvering step | page 151, line 48 to page 152, line 53 |
| 15) Automatic processors | page 152, line 54 to page 153, line 2 |
| 16) Washing/stabilizing steps | page 153, lines 3 to 37 |

Preferable base precursors used in heat-development light-sensitive materials of the present invention include salts of a base with an organic acid that are decarboxylated when heated; compounds that are decomposed by such a reaction as an intramolecular nucleophilic substitution reaction, Lossen rearrangement, or Beckmann rearrangement, to release amines; compounds that undergoe some reaction when heated, to release a base; and compounds that undergoe hydrolysis (electrolysis) or a complex formation reaction, to generate a base. Examples of the above base precursor that generates a base when heated include bases of trichloroacetic acid described, for example, in GB-998 959; bases of α-sulfonylacetic acid that are further improved in stability, as described in U.S. Pat. No. 4,060,420; bases of propiolic acid described in JP-A-58-55700; 2-carboxycarbodiamide derivatives described in U.S. Pat. No. 4,088,496; salts of heat-decomposable acids that are formed using, in addition to an organic base, an alkali metal or an alkali earth metal as base components (JP-A-58-69597); hydroxamcarbamates that use Lossen rearrangement, as described in Japanese patent application No. 58-43860; and aldoximecarbamates that produce nitrile when heated, as described in Japanese patent application No. 58-31614.

Also useful are base precursors described, for example, in GB-998 945 and 2 079 480, JP-A-50-226225, U.S. Pat. Nos. 3,220,846, 4,514,493, and 4,657,848, and Kochi Gijutsu No. 5 (published by Azutekku Yugen-kaisha, Mar. 22, 1991), pages 55 to 86.

In the light-sensitive material of the present invention, an image-formation-accelerating agent can be used. Image-formation-accelerating agents have, for example, a function of accelerating the redox reaction of silver salt oxidizing agents and reducing agents, of producing or decomposing dyes from dye-donating substances, or of accelerating the reaction, for example, of releasing diffusion dyes, and the agents are classified based on physicochemical functions, for example, into nucleophilic compounds, high-boiling organic solvents (oils), heat solvents, surface-active agents, and compounds having interactions with silver or silver ions. However, compounds of this group generally have complex functions, and usually each compound has some of the above accelerating effects in combination. Details of these compounds are described in U.S. Pat. No. 4,678,739, columns 38 to 40.

In a photographic material of the present invention, in order to obtain a constant image all the time against changes in the processing temperature and the processing time at the time of development, various development arrestors can be used.

Herein, the term "a development arrestor" means a compound that neutralizes bases quickly or reacts quickly with bases after suitable development, to lower the base concentration in the film, to stop the development; or a compound that interacts with silver and silver salts, to inhibit the development.

Specific examples include acid precursors that release an acid when heated, electrophilic compounds that undergo a substitution reaction with coexisting bases when heated, nitrogen-containing heterocyclic compounds, mercapto compounds, and their precursors. Details are described in JP-A-62-253159, pages 31 to 32.

Examples methods of exposing the photographic material of the present invention with light and recording the image, include a method wherein a landscape, a man, or the like is directly photographed by a camera or the like; a method wherein a reversal film or a negative film is exposed to light using, for example, a printer, or an enlarging apparatus; a method wherein an original picture is subjected to scanning exposure through a slit by using an exposure system of a copying machine or the like; a method wherein light-emitting diodes and various lasers (e.g. laser diodes and gas lasers) are allowed to emit light, to carry out scanning exposure through image information and electrical signals (methods described, for example, in JP-A-2-129625, 5-176144, 5-199372, 6-127021); and a method wherein image information is outputted to an image display apparatus, such as a CRT, a liquid crystal display, an electroluminescence display, and a plasma display, and exposure is carried out directly or through an optical system.

Light sources that can be used for recording an image on the photographic material, as mentioned above, include natural light and light sources and exposure methods described in U.S. Pat. No. 4,500,626, 56th column, and JP-A-2-53378 and 2-54672, such as a tungsten lamp, a light-emitting diode, a laser light source, and a CRT light source. Image-wise exposure can be carried out by using a wavelength-converting element that uses a nonlinear optical material and a coherent light source, such as laser rays, in combination. Herein the term "nonlinear optical material" refers to a material that can develop nonlinearity of the electric field and the polarization that appears when subjected to a strong photoelectric field, such as laser rays, and inorganic compounds, represented by lithium niobate, potassium dihydrogenphosphate (KDP), lithium iodate, and $BaB_2O_4$; urea derivatives, nitroaniline derivatives, nitropyridine-N-oxide derivatives, such as 3-methyl-4-nitropyridine-N-oxide (POM); and compounds described in JP-A-61-53462 and 62-210432 can be preferably used. As the form of the wavelength-converting element, for example, a single crystal optical waveguide type and a fiber type are known, both of which are useful.

The above image information can employ, for example, image signals obtained from video cameras, electronic still cameras, and the like; television signals, represented by Nippon Television Singo Kikaku (NTSC); image signals obtained by dividing an original picture into a number of picture elements by a scanner or the like; and an image signals produced by a computer, represented by CG or CAD.

In addition, with respect to heating means (methods), conditions, solvents, heat-development apparatuses, etc. for the heated development and the diffusion transfer of dyes, applied to heat development light-sensitive materials, for example, those described in JP-A-8-122995, page 21, column 40, line 3, to page 22, column 42, line 6, are preferably used.

As a method of developing the light-sensitive material of the present invention, in which a color-developing agent is built in, after exposure to light, an activator process, wherein the light-sensitive material is developed with an alkali processing solution that does not contain a color-developing agent; a method wherein development is carried out using a processing solution containing an auxiliary development agent/base; a method in which the said alkali processing solution in the diffusion transfer reversal system is developed (applied) on the light-sensitive material; and a method in which development is carried out by heat development, may be used.

The term "activator process" means a process wherein a color-developing agent is built in a light-sensitive material and the light-sensitive material is subjected to a development process with a processing solution free from any color-developing agent. In the present invention, "the activator solution" is characterized by substantially not containing any p-phenylenediamine-series color-developing agent that is conventionally used, and it may contain other components (e.g. alkalis, halogens, and chelating agents). In some cases, preferably the activator solution does not contain any reducing agent, in order to keep the processing stability, and in that case the activator solution preferably does not substantially contain any auxiliary developing agents, hydroxyamines, sulfites, and the like.

Herein, the term "does not substantially contain" means that preferably the content is 0.5 mmol/liter or less, more preferably 0.1 mmol/liter or less, and particularly preferably not containing at all. The pH of the alkali processing solution is preferably 9 to 14, and particularly preferably 10 to 13.

Light-sensitive materials that are used in activator process and the processings thereof are described, for example, in Japanese patent application Nos. 7-63572, 7-334190, 7-334192, 7-334197, and 7-344396.

Further, in the present invention, when a light-sensitive material is subjected to development with a developing solution, a compound that functions as a developing agent of the silver halide and/or that works to allow the oxidization product of the developing agent resulting from silver development to cross-oxidize the reducing agent (color-developing agent) for color formation built in the light-sensitive material, can be used in the developing solution. Preferably, pyrazolidones, dihydroxybenzenes, reductones, and aminophenols are used, and particularly preferably pyrazolidones are used. In addition, with respect to additives, processing procedures (methods), processing conditions, etc., used in the development processing, the bleaching, the fixing, and the washing (stabilization), those described in JP-A-8-101484, page 13, column 24, line 33, to page 19, column 35, line 28, are preferably applied.

If the amount of the silver halide to be used is small, the desilvering process can be omitted. The actual processing time by a developing apparatus using processing solutions is generally determined based on the linear velocity and the volume of the processing bath, and it is suggested that in the present invention the linear velocity is, for example, 500 to 4,000 mm/min. Particularly in the case of a small-sized developing apparatus, the linear velocity is preferably 500 to 2,500 mm/min.

The processing time of all the processing steps; that is, the processing time from the developing step to the drying step, is preferably 360 sec or less, more preferably 120 sec or less, and particularly preferably 90 to 30 sec. Herein, the term "processing time" means the time from the dipping of the light-sensitive material in the developing solution to the emergence of the light-sensitive material from the drying part of the processor.

The term "development (applied) process of an alkali processing solution in the diffusion transfer reversal system", means a process which is known in the art as an instant processing system, in which process an alkali processing solution is developed (applied) to form a liquid film that is generally about 500 $\mu$m or less, and preferably 50 to 200 $\mu$m, in thickness onto a light-sensitive material having, on the same support or separate supports, a light-sensitive element comprising at least one light-sensitive layer/dye-forming layer (preferably the light-sensitive layer and the dye-forming layer constituting the same layer) and an image-receiving element having a mordant layer for capturing/mordanting the diffusion dye produced from the light-sensitive layer/dye-forming layer, to process the light-sensitive material.

When an auxiliary developing agent is built in, preferably the alkali processing solution does not contain an auxiliary developing agent, in view of the production and the preservation of the processing solution.

In the case of the diffusion transfer system, the pH of the alkali processing solution is preferably 10 to 14, and particularly preferably 12 to 14.

The process for instant light-sensitive materials is described by T. H. James in *The Theory of Photographic Process*," 4th edition (1977, Macmillan), and the constitution of specific film units is described in JP-A-63-226649. Examples of materials contained in the film units and various layers containing the materials are described below.

Dye-image-receiving layers and mordants contained therein are described in JP-A-61-252551 and U.S. Pat. Nos. 2,548,564, 3,756,814, 4,124,386, and 3,652,694. Neutralizing layers used for lowering the pH of the light-sensitive material after the development (application) of the alkali processing solution are described in JP-B-7-122753, U.S.

Pat. No. 4,139,383, and RD No. 16102, and timing layers that are used in combination with the neutralizing layers are described in JP-A-59-136328 and U.S. Pat. Nos. 4,267,262, 4,009,030, and 4,268,604. As the silver halide emulsion, any emulsion can be used, and as preferable autopositive emulsions for light-sensitive materials for photographing, those described in JP-A-7-333770 and 7-333771 can be mentioned.

In addition, if required, light-shielding layers, reflective layers, intermediate layers, separating layers, ultraviolet-absorbing layers, filter layers, overcoat layers, adhesion-improving layers, and the like can be provided.

The processing solution for processing the above light-sensitive materials contains processing components required for the development, and generally a thickening agent is incorporated in the processing components, to cause them to be developed (applied) uniformly on the light-sensitive material. As the thickening agent, a thixotropic one, such as carboxymethylcellulose and hydroxyethylcellulose, is preferable.

Details of the light-sensitive layer and the processing solution are described in JP-A-7-333771.

The heating treatment in heat development of photographic materials is known in the art, and it may be applied for the light-sensitive material of the present invention. The heat-development photographic materials and the process thereof are described, for example, in "Shashin Kogaku no Kiso" (published by Corona-sha, 1979), pages 553 to 555; "Eizo Joho" (published April 1978), page 40; "Nebletts Handbook of Photography and Reprography," 7th edition (Van Nostrand and Reinhold Company), pages 32 to 33; U.S. Pat. Nos. 3,152,904, 3,301,678, 3,392,020, and 3,457,075, GB-1 131 108 and 1 167 777, and Research Disclosure (June 1978), pages 9 to 15 (RD-17029).

For the purpose of accelerating the silver development and the dye-forming reaction, to the light-sensitive material of the present invention are preferably applied basic precursors described, for example, in U.S. Pat. Nos. 4,514,493 and 4,657,848, and in *Known Technique* (Kochi Gijutsu), No. 5 (Mar. 22, 1991, published by Azutech Yugen-kaisha), pages 55 to 86; and base-generating methods described in EP-A-210 660 and U.S. Pat. No. 4,740,445.

For the purpose of accelerating the heat development, to the light-sensitive material of the present invention may be added heat solvents described in U.S. Pat. Nos. 3,347,675 and 3,667,959.

When the light-sensitive material of the present invention is processed by heating, in order to accelerate the development and/or to perform the diffusion transfer of the material for the processing, also preferably the light-sensitive material or the processing sheet is impregnated with water, an aqueous solution containing an inorganic alkali metal salt or an organic base, a low-boiling solvent, or a mixed solvent of a low-boiling solvent with water, or with the aqueous basic solution containing an inorganic alkali metal salt or an organic base, and the light-sensitive material or the processing sheet is processed by heating. The method wherein water is used is described, for example, in JP-A-63-144354, 63-144355, 62-38460, 3-210555, 62-253159, and 63-85544, EP-A-210 660, and U.S. Pat. No. 4,740,445.

The present invention can also be applied to heat development image-forming methods and heat development light-sensitive materials, as described, for example, in JP-A-7-261336, 7-268045, 8-30103, 8-46822, and 8-97344.

The heating temperature in the heat development step is generally about 50 to 200° C., and particularly usefully the heating temperature in the heat development step is 60 to 150° C. If any solvent is used, preferably the heat development is carried out at a temperature below the solvent's boiling point.

According to the present invention, by building a color-developing agent into a light-sensitive material, the processing can be made rapid and the load on the waste liquor processing can be reduced, and further, photographic characteristics, such as graininess and sharpness of images, can be remarkably improved.

Further, according to the present invention, the minimum density (fogging) can be lowered substantially without impairing the maximum density of dye images.

The present invention will now be described in detail with reference to the following examples. However, the invention is to limited to the examples.

EXAMPLE

Example 1

Method of Preparing Light-Sensitive Silver Halide Emulsion

To a well-stirred aqueous gelatin solution (containing 30 g of inert gelatin and 2 g of potassium bromide in 1,000 ml of water), were added ammonia•ammonium nitrate as a solvent for silver halide, the temperature was kept at 75° C., and then 1000 ml of an aqueous solution containing 1 mol of silver nitrate, and 1,000 ml of an aqueous solution containing 1 mol of potassium bromide and 0.03 mol of potassium iodide, were simultaneously added thereto, over 78 min. After washing with water and desalting, inert gelatin was added, for redispersion, thereby preparing a silver iodobromide emulsion having an average diameter of the grain volume equivalent to a sphere, of 0.76 $\mu$m, and an iodine content of 3 mol %. The average diameter of the grain volume equivalent to a sphere was measured by a Model TA-II, manufactured by Coulter Counter Co.

To the above emulsion were added potassium thiocyanate, chloroauric acid, and sodium thiosulfate, at 56° C., to achieve optimal chemical sensitization. To this emulsion, each sensitizing dye corresponding to each of the spectral sensitivities was added at the time of preparation of the coating solution, to provide color sensitivities.

Preparation Method of Zinc Hydroxide Dispersion 31 g of zinc hydroxide powder, whose primary particles had an average grain size of 0.2 $\mu$m, 1.6 g of carboxylmethyl cellulose and 0.4 g of sodium polyacrylate, as a dispersant, 8.5 g of lime-processed ossein gelatin, and 158.5 ml of water were mixed together, and the mixture was dispersed by a mill containing glass beads for 1 hour. After the dispersion, the glass beads were filtered off, to obtain 188 g of a dispersion of zinc hydroxide.

Preparation Method of Emulsified Dispersion of Coupler

The oil-phase components and the aqueous-phase components of each composition shown in Table 1 were dissolved, respectively, to obtain uniform solutions at 60° C. The oil-phase components and the aqueous-phase components were combined together and were dispersed in a 1-liter stainless steel vessel, by a dissolver equipped with a disperser having a diameter of 5 cm, at 10,000 rpm for 20 min. Warm water (as an additional water) was added thereto in the amount shown in Table 1, followed by stirring at 2,000 rpm for 10 min. Thus, emulsified dispersion containing three couplers, that is, cyan, magenta, and yellow couplers, was prepared.

TABLE 1

| | | Cyan | Magenta | Yellow |
|---|---|---|---|---|
| Oil phase | Cyan coupler (1) | 7.52 g | — | — |
| | Magenta coupler (2) | — | 6.87 g | — |
| | Yellow coupler (3) | — | — | 7.86 g |
| | Developing agent (4) | 5.11 g | 5.11 g | 5.11 g |
| | Antifoggant (5) | 3.0 mg | 1.0 mg | 10.0 mg |
| | High-boiling solvent (6) | 5.37 g | 5.99 g | 6.49 g |

TABLE 1-continued

| | | Cyan | Magenta | Yellow |
|---|---|---|---|---|
| | Ethyl acetate | 24.0 ml | 24.0 ml | 24.0 ml |
| Aqueous phase | Lime-processed gelatin | 12.0 g | 12.0 g | 12.0 g |
| | Surface-active agent (7) | 0.60 g | 0.60 g | 0.60 g |
| | Water | 138.0 ml | 138.0 ml | 138.0 ml |
| | Additional water | 180.0 ml | 180.0 ml | 180.0 ml |

Cyan coupler (1)

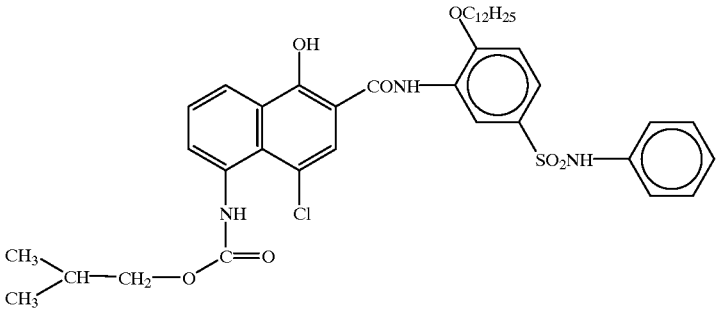

Magenta coupler (2)

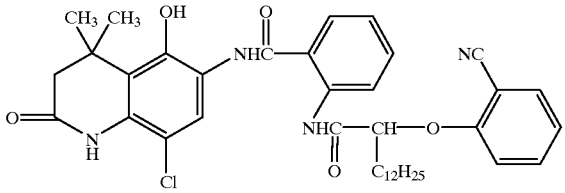

Yellow coupler (3)

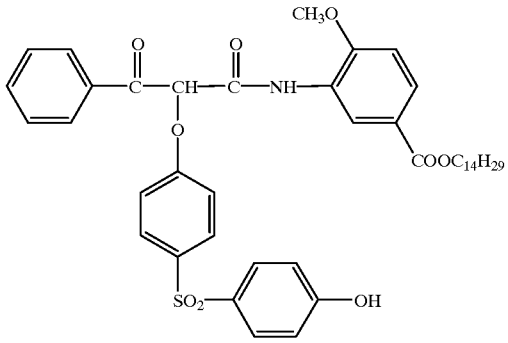

Developing agent (4)

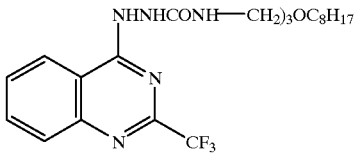

Antifoggant (5)

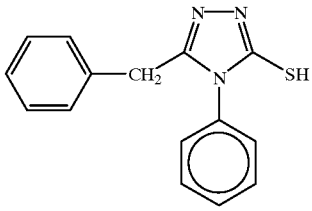

Exemplified Compound (56)

High-boiling solvent (6)

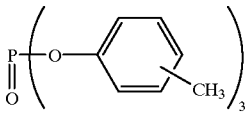

-continued

Surface-active agent (7)

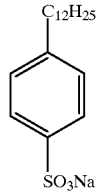

By using the thus obtained materials, a heat-development color light-sensitive material 101, having the multi-layer constitution shown in Table 2, was produced.

TABLE 2

Constitution of light-sensitive material 101

| Layer constitution | Additive | Added amount (mg/m$^2$) |
|---|---|---|
| Seventh layer | Lime-processed gelatin | 1000 |
| Protective layer | Matting agent (silica) | 50 |
| | Surface-active agent (8) | 100 |
| | Surface-active agent (9) | 300 |
| | Water-soluble polymer (10) | 15 |
| Sixth layer | Lime-processed gelatin | 375 |
| Interlayer | Surface-active agent (9) | 15 |
| | Zinc hydroxide | 1130 |
| | Water-soluble polymer (10) | 15 |
| Fifth layer | Lime-processed gelatin | 2920 |
| Yellow color-forming layer | Light-sensitive silver halide emulsion (in terms of silver) | 2768 |
| | Sensitizing dye (12) | 14.60 |
| | Yellow coupler (13) | 629 |
| | Developing agent (4) | 409 |
| | Antifoggant (5) | 6.86 |
| | High-boiling solvent (6) | 519 |
| | Surface-active agent (7) | 48 |
| | Water-soluble polymer (10) | 20 |
| Forth layer | Lime-processed gelatin | 1000 |
| Interlayer | Surface-active agent (9) | 8 |
| | Water-soluble polymer (10) | 5 |
| | Hardener (11) | 65 |
| Third layer | Lime-processed gelatin | 1992 |
| Magenta color-forming layer | Light-sensitive silver halide emulsion (in terms of silver) | 1900 |
| | Sensitizing dye (13) | 0.28 |
| | Sensitizing dye (14) | 2.84 |
| | Sensitizing dye (15) | 0.76 |
| | Magenta coupler (2) | 378 |
| | Developing agent (4) | 281 |
| | Antifoggant (5) | 3.43 |
| | High-boiling solvent (6) | 330 |
| | Surface-active agent (7) | 33 |
| | Water-soluble polymer (10) | 14 |
| Second layer | Lime-processed gelatin | 1000 |
| Interlayer | Surface-active agent (9) | 8 |
| | Zinc hydroxide | 1130 |
| | Water-soluble polymer (10) | 5 |
| First layer | Lime-processed gelatin | 1440 |
| Cyan color-forming layer | Light-sensitive silver halide emulsion (in terms of silver) | 1384 |
| | Sensitizing dye (16) | 6.08 |
| | Sensitizing dye (17) | 4.12 |
| | Sensitizing dye (18) | 0.20 |
| | Cyan coupler (1) | 300 |
| | Developing agent (4) | 204 |
| | Antifoggant (5) | 4.12 |
| | High-boiling solvent (6) | 215 |
| | Surface-active agent (7) | 24 |
| | Water-soluble polymer (10) | 10 |
| | Transparent PET base (102 μm) | |

Surface-active agent (8)

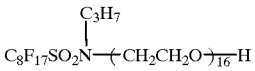

Surface-active agent (9)

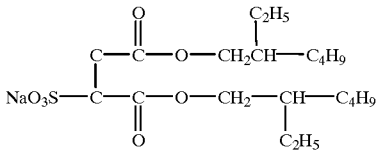

Water-soluble polymer (10)

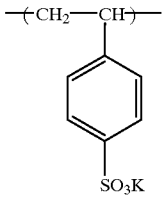

Hardner (11)

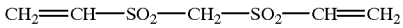

Sensitizing dye (12)

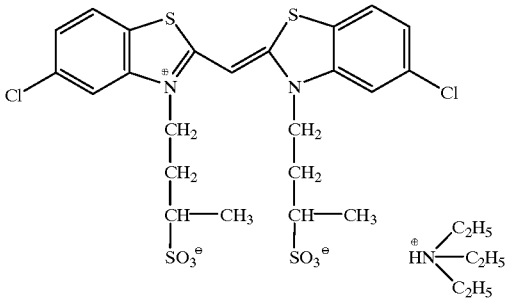

Sensitizing dye (13)

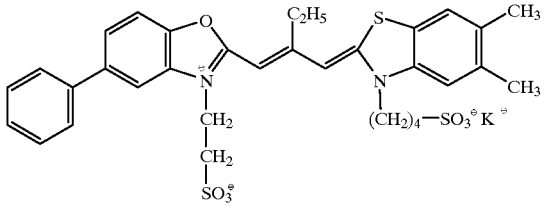

Sensitizing dye (14)

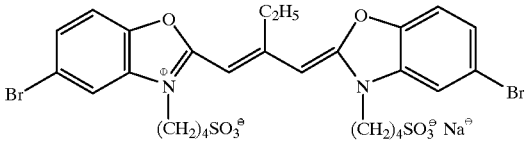

-continued

Sensitizing dye (15)

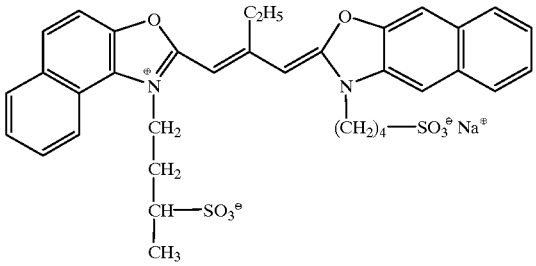

Sensitizing dye (16)

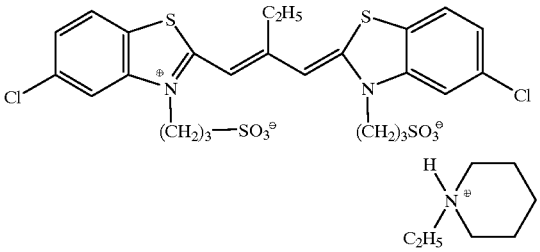

Sensitizing dye (17)

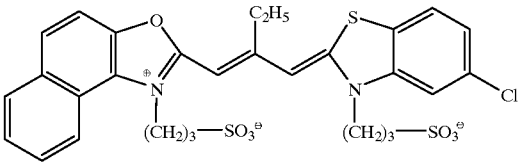

Sensitizing dye (18)

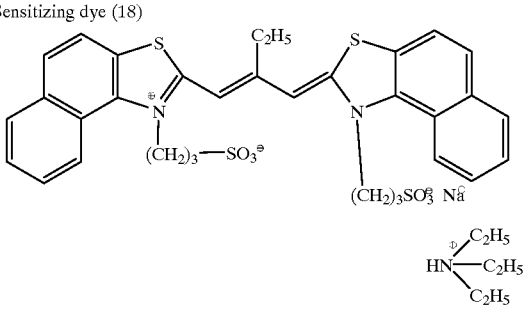

Further, Processing Material R-1, having the contents shown in Tables 3 and 4, was prepared.

TABLE 3

Constitution of processing material R-1

| Layer constitution | Additive | Added amount (mg/m$^2$) |
|---|---|---|
| Forth layer | Acid-processed gelatin | 220 |
| Protective layer | Water-soluble polymer (19) | 60 |
| | Water-soluble polymer (20) | 200 |
| | Additive (21) | 80 |
| | Potassium nitrate | 12 |
| | Matting agent (22) | 10 |
| | Surface-active agent (9) | 7 |
| | Surface-active agent (23) | 7 |
| | Surface-active agent (24) | 10 |
| Third layer | Lime-processed gelatin | 240 |
| Interlayer | Water-soluble polymer (20) | 24 |
| | Hardener (25) | 180 |
| | Surface-active agent (7) | 9 |
| Second layer | Lime-processed gelatin | 4800 |
| Base-producing | Water-soluble polymer (20) | 720 |
| layer | Water-soluble polymer (26) | 1400 |

TABLE 3-continued

Constitution of processing material R-1

| Layer constitution | Additive | Added amount (mg/m$^2$) |
|---|---|---|
| | Water-soluble polymer (27) | 1200 |
| | High-boiling solvent (28) | 2000 |
| | Guanidine picolinate | 5820 |
| | Potassium quinolinate | 450 |
| | Sodium quinolinate | 360 |
| | Surface-active agent (7) | 24 |
| First layer | Lime-processed gelatin | 280 |
| Undercoat layer | Water-soluble polymer (19) | 12 |
| | Surface-active agent (9) | 14 |
| | Hardener (25) | 185 |
| | Transparent base A (63 $\mu$m) | |

TABLE 4

Constitution of Base A

| Name of layer | Composition | Weight (mg/m$^2$) |
|---|---|---|
| Undercoat layer of surface | Lime-processed gelatin | 100 |
| Polymer layer | Polyethylene terephthalate | 62500 |
| Undercoat layer of back surface | Polymer (Methyl methacrylate /styrene/2-ethylhexyl acrylate /methacrylic acid copolymer) PMMA latex | 1000 |
| | | 120 |

Water-soluble polymer (19)
(kappa) κ-Carrageenan
Water-soluble polymer (20)
Sumikagel L-5H (trade name: manufactured by Sumitomo Kagaku Co.)
Additive (21)

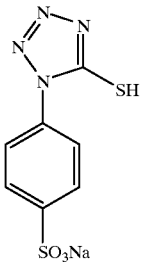

Matting agent (22)
SYLOID79 (trade name: manufactured by Fuji Davisson Co.)
Surface-active agent (23)

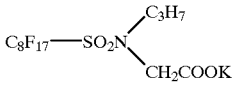

Surface-active agent (24)

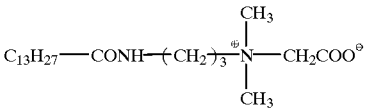

-continued

Hardner (25)

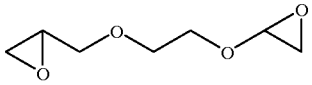

Water-soluble polymer (26)
Dextran
(molecular weight 70,000)
Water-soluble polymer (27)
MP polymer MP102 (trade name: manufactured by Kurare Co.)
High-boiling solvent (28)
EMPARA 40 (trade name: manufactured by Ajinomoto K.K.)

In the same manner as for the emulsions shown in Table 1, cyan coupler emulsions wherein couplers for use in the present invention were added as shown in Table 5 were prepared. Light-sensitive materials 102 to 105 having the same composition as that of the light-sensitive material 101 were prepared by using the resulting emulsions, except that the couplers for use in the present invention were added to the first layers. The compositions of the first layers of the light-sensitive materials 102 to 105 are shown in Table 6.

The thus prepared light-sensitive materials 101 to 105 were exposed to light at 2,000 lux for 0.01 sec through B, G, and R optical filters, whose densities were changed continuously.

Warm water at 40° C. was applied to each of the exposed light-sensitive materials, in an amount of 15 ml/square meter; the light-sensitive material and the processing material R-1 were put together with the coated surfaces in contact with each other; they were heated at 83° C. for 17 sec using a heat drum, to carry out heat development, and then the processing material R-1 was separated quickly.

Each separated light-sensitive material had respectively bright cyan, magenta, and yellow color images.

TABLE 5

| | | Cyan 2 | Cyan 3 | Cyan 4 | Cyan 4 |
|---|---|---|---|---|---|
| Oil phase | Cyan coupler (1) | 7.52 g | 7.52 g | 7.52 g | 7.52 g |
| | Coupler for use in the present invention (C-34) | 0.39 g | 1.17 g | — | — |
| | Coupler for use in the present invention (C-5) | — | — | 0.83 g | — |
| | Coupler for use in the present invention (C-17) | — | — | — | 0.88 g |
| | Developing agent (4) | 5.11 g | 5.11 g | 5.11 g | 5.11 g |
| | Antifoggant (5) | 3.00 mg | 3.00 mg | 3.00 mg | 3.00 mg |
| | High-boiling solvent (6) | 5.37 g | 5.37 g | 5.37 g | 5.37 g |
| | Ethyl acetate | 24 ml | 24 ml | 24 ml | 24 ml |
| Aqueous phase | Lime-processed gelatin | 12.0 g | 12.0 g | 12.0 g | 12.0 g |
| | Surface-active agent (7) | 0.60 g | 0.60 g | 0.60 g | 0.60 g |
| | Water | 136 ml | 136 ml | 136 ml | 136 ml |
| | Additional water | 180 ml | 180 ml | 180 ml | 180 ml |

TABLE 6

| | | Added amount (mg/m$^2$) | | | |
|---|---|---|---|---|---|
| | Additive | 102 | 103 | 104 | 105 |
| First layer | Lime-processed gelatin | 1440 | 1440 | 1440 | 1440 |
| | Light-sensitive silver halide emulsion* | 1384 | 1384 | 1384 | 1384 |
| Cyan color-forming layer | Sensitizing dye (16) | 6.08 | 6.08 | 6.08 | 6.08 |
| | Sensitizing dye (17) | 4.12 | 4.12 | 4.12 | 4.12 |
| | Sensitizing dye (18) | 0.20 | 0.20 | 0.20 | 0.20 |
| | Cyan coupler (1) | 300 | 300 | 300 | 300 |
| | Coupler for use in the present invention (C-34) | 15.6 | 46.7 | — | — |
| | Coupler for use in the present invention (C-5) | — | — | 33.1 | — |
| | Coupler for use in the present invention (C-17) | — | — | — | 35.1 |
| | Developing agent (4) | 225 | 225 | 225 | 225 |
| | Antifoggant (5) | 4.12 | 4.12 | 4.12 | 4.12 |
| | High-boiling solvent (6) | 215 | 215 | 215 | 215 |
| | Surface-active agent (7) | 24 | 24 | 24 | 24 |
| | Water-soluble polymer (10) | 10 | 10 | 10 | 10 |

*The amount of the emulsion is in terms of silver.

In the same way, the light-sensitive materials 101 to 105 were exposed to light at 2,000 lux for 0.01 sec through a neutral-gray optical filter, whose density was changed continuously, and then they were subjected to heat development. Immediately after the processing, the transmission densities of B, G, and R of the light-sensitive materials 101 to 105 were measured, to obtain so-called characteristic curves. In the characteristic curves of the R densities, the reciprocal of the exposure amount giving a density 0.15 higher than the fog density was designated as the relative R sensitivity, and assuming the relative R density of the light-sensitive material 101 to be 100, the relative values are shown in Table 7. Further, the value of the logarithm of the difference between the exposure amount giving a density 0.2 higher than the fog density and the exposure amount giving a density 1.5 higher than the fog density, was designated as the R gradation. The fog densities, the relative R sensitivities, and the R gradations are shown in Table 7.

To investigate the graininess of the light-sensitive materials 101 to 105, they were exposed to white light giving an R density 1.0 higher than the fog density, and then they were color-formed by the similar heat development, and the RMS granularity was measured using a diffused light source with an aperture size of 48 microns. The results are shown in Table 7.

TABLE 7

| | 101 | 102 | 103 | 104 | 105 |
|---|---|---|---|---|---|
| Fogging density | 1.2 | 1.1 | 1.1 | 1.2 | 1.2 |
| Relative R sensitivity | 3.8 | 3.4 | 3.0 | 3.3 | 3.5 |
| R gradation | 0.87 | 0.96 | 1.04 | 0.99 | 0.89 |
| RMS Granularity | 0.015 | 0.012 | 0.010 | 0.013 | 0.012 |

Summarizing the results shown in Table 7, the light-sensitive materials 102 to 105, wherein the couplers for use in the present invention were added, are lower in relative sensitivity in comparison with the light-sensitive material 101, and it can be presumed that the couplers for use in the present invention reacted with the development agent to release development inhibitors. The granularity of the light-sensitive materials 102 to 105, wherein the couplers for use in the present invention were added, is apparently reduced in comparison with the light-sensitive material 101 containing no such coupler, which clearly indicates the effect of the couplers for use in the present invention that release a photographically useful group.

Example 2

Layers having the constitutions shown in Table 8 were applied to a base of transparent polyethylene terephthalate film 150 μm in thickness, to prepare a comparative light-sensitive material 201.

TABLE 8

Constitution of light-sensitive element 201

| Layer number | Number of Layer | Additive | Coating amount (g/m$^2$) |
|---|---|---|---|
| 21st layer | Protective layer | Gelatin | 1.00 |
| | | Matting agent (1) | 0.25 |
| 20th layer | Ultra violet absorbing layer | Gelatin | 0.50 |
| | | Ultra violet absorbing agent (1) | 0.09 |
| | | Ultra violet absorbing agent (2) | 0.08 |
| 19th layer | Blue-sensitive layer (high sensitivity) | Internal latent image-type direct positive emulsion (octahedron; grain size: 1.7 μm) (in terms of silver) | 0.50 |
| | | Sensitizing dye (3) | $1.4 \times 10^{-3}$ |
| | | Nucleating agent (1) | $8.0 \times 10^{-6}$ |
| | | Additive (2) | 0.03 |
| | | Gelatin | 0.70 |
| 18th layer | Blue-sensitive layer (low sensitivity) | Internal latent image-type direct positive emulsion (octahedron; grain size: 1.1 μm) (in terms of silver) | 0.20 |
| | | Sensitizing dye (3) | $9.0 \times 10^{-4}$ |
| | | Nucleating agent (1) | $3.0 \times 10^{-6}$ |
| | | Additive (2) | $4.5 \times 10^{-2}$ |
| | | Gelatin | 0.40 |
| 17th layer | White reflecting layer | Titanium dioxide | 0.70 |
| | | Gelatin | 0.18 |
| 16th layer | Yellow-dye donating layer | Yellow-dye donating compound (1) | 0.55 |
| | | High-boiling organic solvent (1) | 0.26 |
| | | Additive (1) | $1.4 \times 10^{-2}$ |
| | | Gelatin | 0.70 |
| 15th layer | Interlayer | Gelatin | 0.30 |
| 14th layer | Color-mixing inhibiting layer | Additive (1) | 0.75 |
| | | Polymethyl methacrylate | 0.80 |
| | | Gelatin | 0.45 |
| 13th layer | Green-sensitive layer (high sensitivity) | Internal latent image-type direct positive emulsion (octahedron; grain size: 1.6 μm) (in terms of silver) | 0.64 |
| | | Sensitizing dye (2) | $2.1 \times 10^{-3}$ |
| | | Nucleating agent (1) | $4.0 \times 10^{-6}$ |
| | | Additive (2) | 0.80 |
| | | Gelatin | 1.00 |
| 12th layer | Green-sensitive layer (low sensitivity) | Internal latent image-type direct positive emulsion (octahedron; grain size: 1.0 μm) (in terms of silver) | 0.20 |
| | | Sensitizing dye (2) | $1.1 \times 10^{-3}$ |
| | | Nucleating agent (1) | $3.0 \times 10^{-6}$ |
| | | Additive (2) | 0.03 |
| | | Gelatin | 0.50 |
| 11th layer | White reflecting layer | Titanium dioxide | 1.00 |
| | | Gelatin | 0.25 |
| 10th layer | Magenta-dye donating layer | Magenta-dye donating compound (1) | 0.52 |
| | | High-boiling organic solvent (1) | 0.20 |
| | | Additive (1) | $9.0 \times 10^{-3}$ |
| | | Gelatin | 0.70 |
| 9th layer | Interlayer | Gelatin | 0.30 |
| 8th layer | Color-mixing inhibiting layer | Additive (1) | 1.10 |
| | | Polymethyl methacrylate | 1.20 |
| | | Gelatin | 0.70 |
| 7th layer | Red-sensitive layer (high sensitivity) | Internal latent image-type direct positive emulsion (octahedron; grain size: 1.6 μm) (in terms of silver) | 0.40 |
| | | Sensitizing dye (1) | $6.2 \times 10^{-4}$ |
| | | Nucleating agent (1) | $8.5 \times 10^{-6}$ |
| | | Additive (2) | 0.04 |
| | | Gelatin | 1.80 |
| 6th layer | Red-sensitive layer | Internal latent image-type direct positive emulsion | 0.12 |

TABLE 8-continued

Constitution of light-sensitive element 201

| Layer number | Number of Layer | Additive | Coating amount (g/m$^2$) |
|---|---|---|---|
| | (low sensitivity) | (octahedron; grain size: 1.0 $\mu$m) (in terms of silver) | |
| | | Sensitizing dye (1) | $3.0 \times 10^{-4}$ |
| | | Nucleating agent (1) | $1.0 \times 10^{-5}$ |
| | | Additive (2) | 0.02 |
| | | Gelatin | 0.40 |
| 5th layer | White reflecting layer | Titanium dioxide | 3.00 |
| | | Gelatin | 0.80 |
| 4th layer | Cyan-dye donating layer | Cyan-dye donating compound (1) | 0.52 |
| | | High-boiling organic solvent (1) | 0.20 |
| | | Additive (1) | 0.10 |
| | | Gelatin | 1.0 |
| 3rd layer | Opaque layer | Carbon black | 1.70 |
| | | Gelatin | 1.70 |
| 2nd layer | White reflecting layer | Titanium dioxide | 22.0 |
| | | Gelatin | 2.75 |
| 1st layer | Image receiving layer | Polymer mordant | 3.00 |
| | | Gelatin | 3.00 |
| | | Base (polyethylene terephthalate 150 $\mu$m) | |

Polymer Mordant (1)

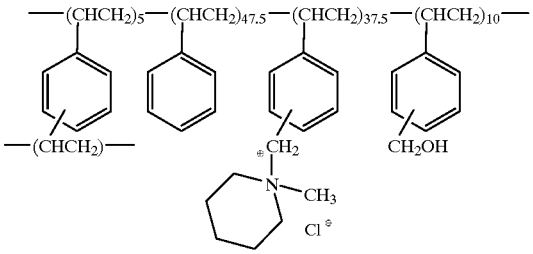

Ultraviolet Absorbent (1)

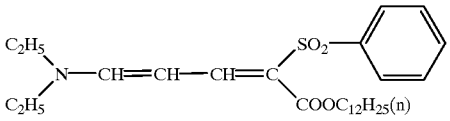

Ultraviolet Absorbent (2)

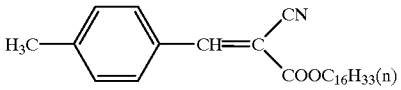

Matting Agent

Poly(methyl methacrylate) Sphere Latex (Average grain diameter 4 $\mu$m)

Cyan-dye Donating Compound (1)

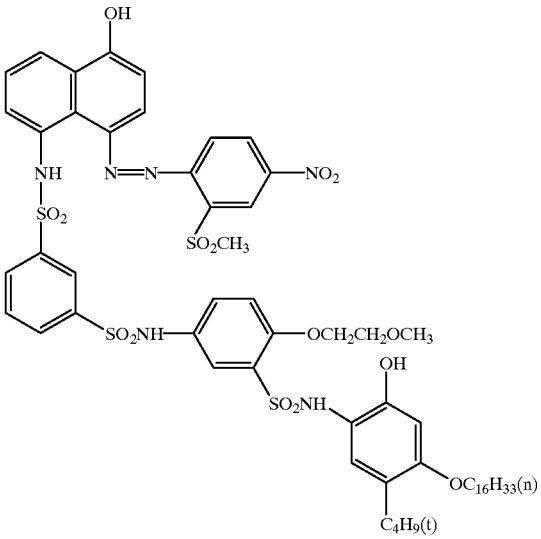

Magenta-dye Donating Compound (1)

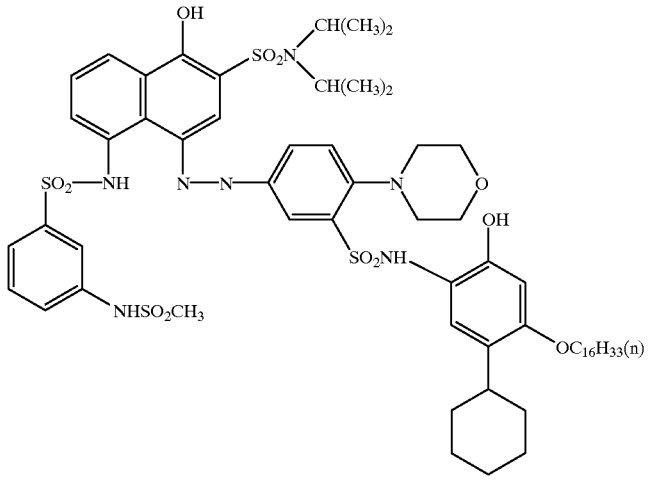
Yellow-dye Donating Compound (1)
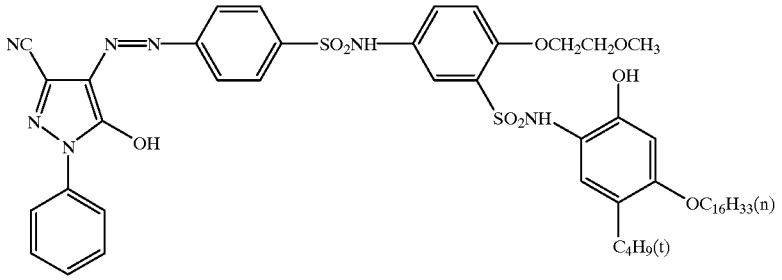
Additive (1)
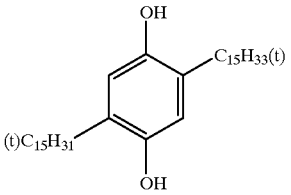
Additive (2)
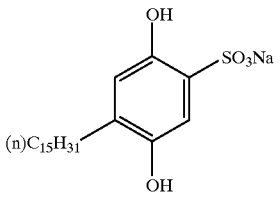
High-boiling Organic Solvent (1)
Tricyclohexyl phosphate
Nucleating Agent (1)

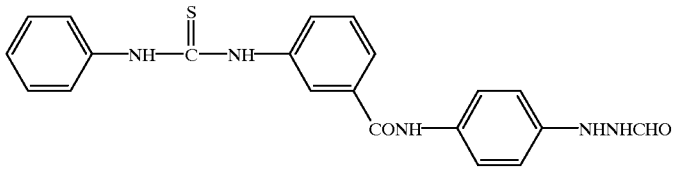

Sensitizing Dye (1)

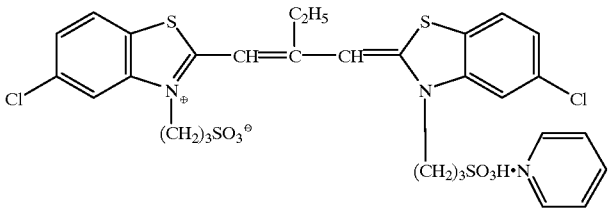

Sensitizing Dye (2)

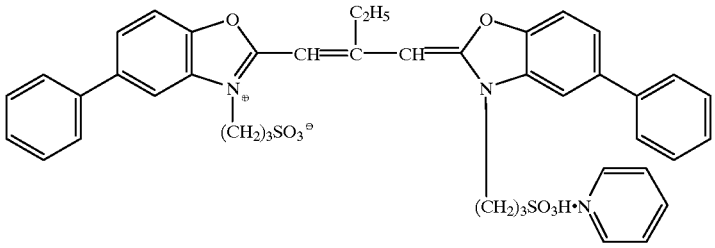

Sensitizing Dye (3)

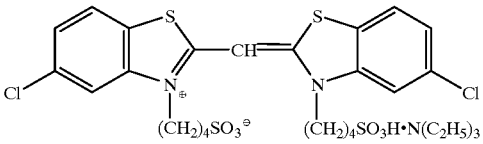

In the same manner as in the light-sensitive material 201, light-sensitive materials 202 to 205 of the present invention were prepared, except that the dye-donating substances in the 16th layer, the 10th layer, and the 4th layer were replaced as shown in Table 9.

TABLE 9

| Number of light-sensitive material | Color-forming layer | Number of color-developing agent | Number of coupler | Yellow Dmax | Yellow Dmin | Yellow (Dmax/Dmin) | Magenta Dmax | Magenta Dmin | Magenta (Dmax/Dmin) | Cyan Dmax | Cyan Dmin | Cyan (Dmax/Dmin) | Remarks |
|---|---|---|---|---|---|---|---|---|---|---|---|---|---|
| 201 | Yellow | Yellow-dye donating compound 1 | | 1.85 | 0.23 | 8.04 | — | | | — | | | Comparative example |
| | Magenta | Magenta-dye donating compound 1 | | — | | | 2.07 | 0.24 | 8.63 | — | | | |
| | Cyan | Cyan-dye donating compound 1 | | — | | | — | | | 2.15 | 0.32 | 6.72 | |

TABLE 9-continued

| Number of light-sensitive material | Color-forming layer | Number of color-developing agent | Number of coupler | Yellow Dmax | Yellow Dmin | Yellow (Dmax/Dmin) | Magenta Dmax | Magenta Dmin | Magenta (Dmax/Dmin) | Cyan Dmax | Cyan Dmin | Cyan (Dmax/Dmin) | Remarks |
|---|---|---|---|---|---|---|---|---|---|---|---|---|---|
| 202 | Yellow | (7) | (C-20) | 1.90 | 0.21 | 9.05 | — | | | — | | | This invention |
| | Magenta | (7) | (C-21) | — | | | 2.11 | 0.21 | 10.0 | — | | | |
| | Cyan | (7) | (C-22) | — | | | — | | | 2.20 | 0.27 | 8.15 | |
| 203 | Yellow | (64) | (C-16) | 1.78 | 0.19 | 9.34 | — | | | — | | | This invention |
| | Magenta | (64) | (C-21) | — | | | 1.95 | 0.21 | 9.14 | — | | | |
| | Cyan | (64) | (C-22) | — | | | — | | | 2.00 | 0.27 | 7.41 | |
| 204 | Yellow | (36) | (C-20) | 1.80 | 0.20 | 9.00 | — | | | — | | | This invention |
| | Magenta | (36) | (C-21) | — | | | 2.02 | 0.20 | 10.1 | — | | | |
| | Cyan | (36) | (C-22) | — | | | — | | | 2.06 | 0.28 | 7.34 | |
| 205 | Yellow | (35) | (C-20) | 1.84 | 0.20 | 9.20 | — | | | — | | | This invention |
| | Magenta | (35) | (C-32) | — | | | 2.08 | 0.21 | 9.90 | — | | | |
| | Cyan | (35) | (C-22) | — | | | — | | | 2.13 | 0.28 | 7.61 | |

A cover sheet was prepared as follows.

On a polyethylene terephthalate transparent base containing a light-piping-preventive dye and having a gelatin undercoat applied, were coated the following layers:

(1) A neutralizing layer containing an acrylic acid/butyl acrylate (molar ratio: 8:3) copolymer having an average molecular weight of 50,000, in an amount of 10.4 g/m$^2$, and 1,4-bis(2,3-epoxypropoxy)butane, in an amount of 0.1 g/m$^2$.

(2) A neutralizing timing layer containing acetylcellulose having a degree of oxidation of 51%, in an amount of 4.3 g/m$^2$, and poly(methyl vinyl ether comonomethyl maleide), in an amount of 0.2 g/m$^2$.

(3) A layer of a blend, consisting of a polymer latex obtained by emulsion polymerization of styrene/butyl acrylate/acrylic acid-N-methylol acrylamide, in a weight ratio of 49.7/42.3/8, and a polymer latex obtained by emulsion polymerization of methyl methacrylate/acrylic acid/N-methylol acrylamide, in a weight ratio of 93/3/4, with the solids ratio of the first latex to the second latex being 6:4, and the total solids being 1.0 g/m$^2$.

The formulation of the alkali process composition used is shown below.

| | |
|---|---|
| methyl-3-pyrazolidone | 10.0 g |
| Methylhydroquinone | 0.18 g |
| 5-Methylbenzotriazole | 3.0 g |
| Sodium sulfite (anhydrous) | 0.2 g |
| Benzylalcohol | 1.5 ml |
| Carboxymethyl cellulose Na salt | 58 g |
| Carbon black | 150 g |
| Potassium hydroxide (28% aq solution) | 200 ml |
| Water | 680 ml |

0.8 g of each of the processing solutions having the above composition was loaded into "a vessel that can be broken under pressure."

The above light-sensitive material was exposed to light from the emulsion layer side through a gray filter, and then it was placed on the above cover sheet, and the above processing solution was developed (applied) between these materials using a press roll at 25° C., so that the thickness might be 75 μm.

One day after the processing, photographic evaluation was made by measuring the minimum reflection density (Dmin) and the maximum reflection density (Dmax) from the transparent base side.

The measurement of the density was carried out using a Fuji-type densitometer (F.S.D). The results are shown in Table 9.

As is apparent from the results shown in Table 9, it can be understood that the light-sensitive materials 202 to 205, wherein the compounds for use in the present invention were used, give satisfactorily high image densities; they are particularly low in Dmin, in comparison with the light-sensitive material 201, and they are remarkably large in the Dmax/Dmin ratio, which is an indication of the discrimination of an image; and therefore the compounds for use in the present invention are excellent as compounds for forming an image.

EXAMPLE 3

Method of Preparing Light-Sensitive Silver Halide Emulsion

To a well-stirred aqueous gelatin solution (containing 30 g of inert gelatin and 2 g of potassium bromide in 1,000 ml of water), were added ammonia-ammonium nitrate as a solvent for silver halide, the temperature was kept at 75° C., and then 1000 ml of an aqueous solution containing 1 mol of silver nitrate, and 1,000 ml of an aqueous solution containing 1 mol of potassium bromide and 0.03 mol of potassium iodide, were simultaneously added thereto, over 78 min. After washing with water and desalting, inert gelatin was added, for redispersion, thereby preparing a silver iodobromide emulsion having a diameter of the grain volume equivalent to a sphere, of 0.76 μm, and an iodine content of 3 mol %. The diameter of the grain volume equivalent to a sphere was measured by a Model TA-II, manufactured by Coulter Counter Co.

To the above emulsion were added potassium thiocyanate, chloroauric acid, and sodium thiosulfate, at 56° C., to achieve optimal chemical sensitization. To this emulsion, each sensitizing dye corresponding to each of the spectral sensitivities was added at the time of preparation of the coating solution, to provide color sensitivities.

Preparation Method of Zinc Hydroxide Dispersion 31 g of zinc hydroxide powder, whose primary particles had a grain size of 0.2 μm, 1.6 g of carboxymethyl cellulose and 0.4 g of sodium polyacrylate, as a dispersant, 8.5 g of lime-processed ossein gelatin, and 158.5 ml of water were mixed together, and the mixture was dispersed by a mill containing glass beads for 1 hour. After the dispersion, the glass beads were filtered off, to obtain 188 g of a dispersion of zinc hydroxide.

Preparation Method of Emulsified Dispersion of Coupler

The oil-phase components and the aqueous-phase components of each composition shown in Table 10 were dissolved, respectively, to obtain uniform solutions at 60 C. The oil-phase components and the aqueous-phase components were combined together and were dispersed in a 1-liter stainless steel vessel, by a dissolver equipped with a disperser having a diameter of 5 cm, at 10,000 rpm for 20 min. Warm water (as an additional water) was added thereto in the amount shown in Table 10, followed by stirring at 2,000 rpm for 10 min. Thus, emulsified dispersions containing one of three couplers, that is, cyan, magenta, and yellow couplers, were prepared.

TABLE 10

| | | Cyan | Magenta | Yellow |
|---|---|---|---|---|
| Oil phase | Cyan coupler (1) | 5.63 g | — | — |
| | Magenta coupler (2) | — | 6.57 g | — |
| | Yellow coupler (3) | — | — | 6.55 g |
| | Developing agent (4) | 5.30 g | 5.30 g | 5.30 g |
| | Antifoggant (5) | 2.0 mg | 0.05 mg | 6.0 mg |
| | High-boiling solvent (6) | 6.69 g | 5.52 g | 4.77 g |
| | Ethyl acetate | 24.0 ml | 24.0 ml | 24.0 ml |
| Aqueous phase | Lime-processed gelatin | 12.0 g | 12.0 g | 12.0 g |
| | Surface-active agent (7) | 0.60 g | 0.60 g | 0.60 g |
| | Water | 138.0 ml | 138.0 ml | 138.0 ml |
| | Additional water | 180.0 ml | 180.0 ml | 180.0 ml |

Cyan Coupler (1)

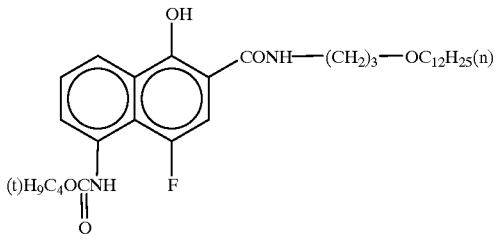

Magenta Coupler (2)

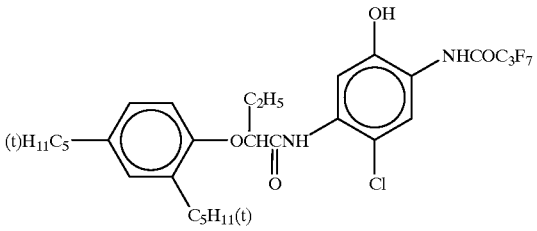

Yellow Coupler (3)

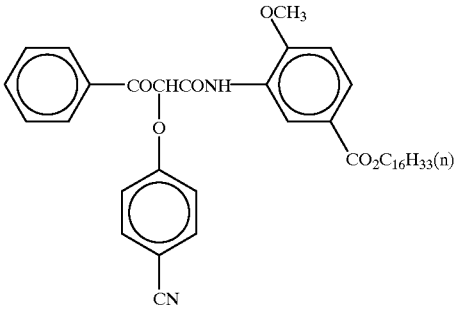

Developing Agent (4)

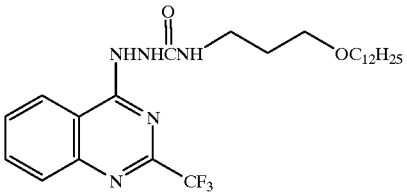

Antifoggant (5)

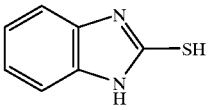

High-boiling Solvent (6)

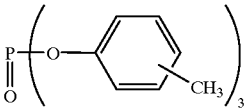

Surface-active Agent (7)

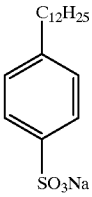

By using the thus obtained materials, a heat-development color light-sensitive material 301, having the multi-layer constitution shown in Table 11, was produced.

TABLE 11

Constitution of light-sensitive material 301

| Layer constitution | Additive | Added amount (mg/m$^2$) |
|---|---|---|
| Seventh layer | Lime-processed gelatin | 1000 |
| Protective layer | Matting agent (silica) | 50 |
| | Surface-active agent (8) | 100 |
| | Surface-active agent (9) | 300 |
| | Water-soluble polymer (10) | 15 |
| Sixth layer | Lime-processed gelatin | 375 |
| Interlayer | Surface-active agent (9) | 15 |
| | Zinc hydroxide | 1130 |
| | Water-soluble polymer (10) | 15 |
| Fifth layer | Lime-processed gelatin | 1450 |
| Yellow color-forming layer | Light-sensitive silver halide emulsion (in terms of silver) | 692 |
| | Sensitizing dye (12) | 3.65 |
| | Yellow coupler (3) | 524 |
| | Developing agent (4) | 424 |
| | Antifoggant (5) | 0.48 |
| | High-boiling solvent (6) | 382 |
| | Surface-active agent (7) | 48 |
| | Water-soluble polymer (10) | 20 |
| Forth layer | Lime-processed gelatin | 1000 |
| Interlayer | Surface-active agent (9) | 8 |
| | Water-soluble polymer (10) | 5 |
| | Hardener (11) | 65 |
| Third layer | Lime-processed gelatin | 993 |
| Magenta color-forming layer | Light-sensitive silver halide emulsion (in terms of silver) | 475 |
| | Sensitizing dye (13) | 0.07 |
| | Sensitizing dye (14) | 0.71 |
| | Sensitizing dye (15) | 0.19 |
| | Magenta coupler (2) | 361 |
| | Developing agent (4) | 292 |
| | Antifoggant (5) | 0.033 |
| | High-boiling solvent (6) | 304 |
| | Surface-active agent (7) | 33 |
| | Water-soluble polymer (10) | 14 |
| Second layer | Lime-processed gelatin | 1000 |
| Interlayer | Surface-active agent (9) | 8 |
| | Zinc hydroxide | 1130 |
| | Water-soluble polymer (10) | 5 |
| First layer | Lime-processed gelatin | 720 |
| Cyan color-forming layer | Light-sensitive silver halide emulsion (in terms of silver) | 346 |
| | Sensitizing dye (16) | 1.52 |
| | Sensitizing dye (17) | 1.03 |
| | Sensitizing dye (18) | 0.05 |
| | Cyan coupler (1) | 225 |
| | Developing agent (4) | 212 |
| | Antifoggant (5) | 0.08 |
| | High-boiling solvent (6) | 268 |
| | Surface-active agent (7) | 24 |
| | Water-soluble polymer (10) | 10 |
| | Transparent PET base (102 μm) | |

Surface-active Agent (8)

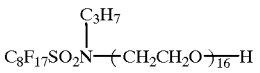

Surface-active Agent (9)

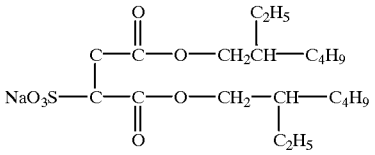

Water-soluble Polymer (10)

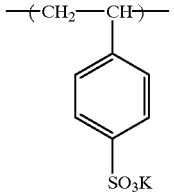

Hardner (11)

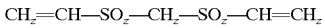

Sensitizing Dye (12)

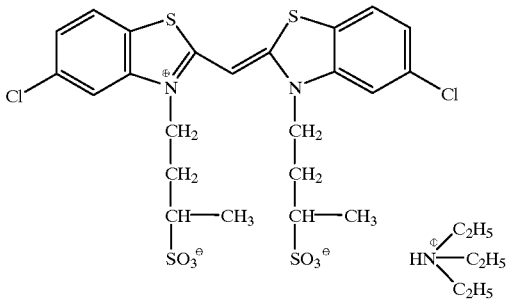

Sensitizing Dye (13)

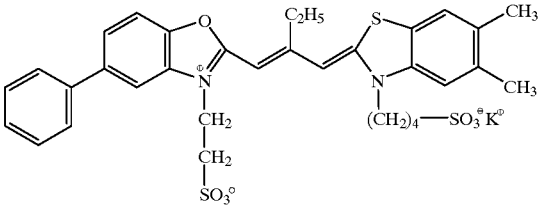

Sensitizing Dye (14)

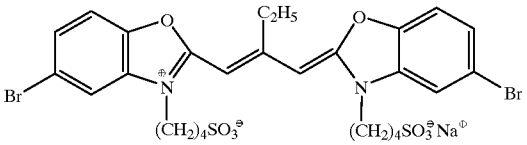

Sensitizing Dye (15)

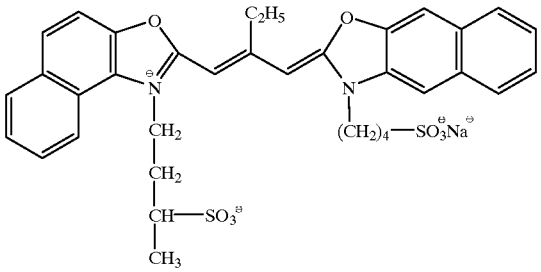

Sensitizing Dye (16)

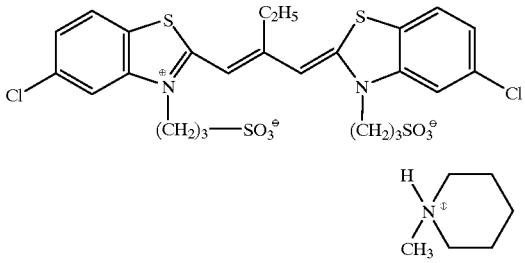

Sensitizing Dye (17)

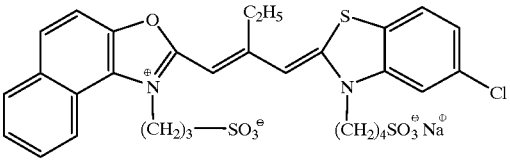

Sensitizing Dye (18)

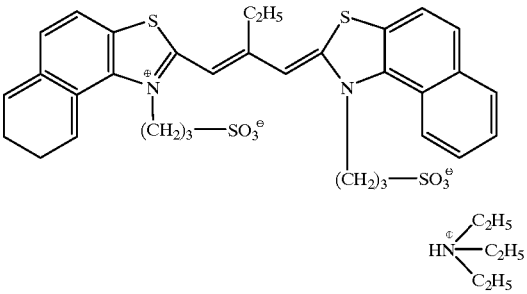

Further, Processing Material R-2, having the contents shown in Tables 12 and 13, was prepared.

TABLE 12

Constitution of processing material R-2

| Layer constitution | Additive | Added amount (mg/m$^2$) |
|---|---|---|
| Forth layer | Acid-processed gelatin | 220 |
| Protective layer | Water-soluble polymer (19) | 60 |

TABLE 12-continued

Constitution of processing material R-2

| Layer constitution | Additive | Added amount (mg/m$^2$) |
|---|---|---|
| | Water-soluble polymer (20) | 200 |
| | Additive (21) | 80 |
| | Palladium sulfide | 3 |
| | Potassium nitrate | 12 |
| | Matting agent (22) | 10 |
| | Surface-active agent (9) | 7 |
| | Surface-active agent (23) | 7 |
| | Surface-active agent (24) | 10 |
| Third layer | Lime-processed gelatin | 240 |
| Interlayer | Water-soluble polymer (20) | 24 |
| | Hardener (25) | 180 |
| | Surface-active agent (7) | 9 |
| Second layer | Lime-processed gelatin | 2400 |
| Base-producing | Water-soluble polymer (20) | 360 |
| layer | Water-soluble polymer (26) | 700 |
| | Water-soluble polymer (27) | 600 |
| | High-boiling solvent (28) | 2000 |
| | Additive (29) | 20 |
| | Potassium hydantoinate | 260 |
| | Guanidine picolinate | 2910 |
| | Potassium quinolinate | 225 |
| | Sodium quinolinate | 180 |
| | Surface-active agent (7) | 24 |
| First layer | Lime-processed gelatin | 280 |
| Undercoat layer | Water-soluble polymer (19) | 12 |
| | Surface-active agent (9) | 14 |
| | Hardener (25) | 185 |
| | Transparent base B (63 μm) | |

TABLE 13

Constitution of Base B

| Name of layer | Composition | Weight (mg/m$^2$) |
|---|---|---|
| Undercoat layer of surface | Lime-processed gelatin | 100 |
| Polymer layer | Polyethylene terephthalate | 62500 |
| Undercoat layer of back surface | Polymer (Methyl meth-acrylate/styrene/2-ethylhexyl acrylate/methacrylic acid copolymer) PMMA latex | 1000<br>120 |

Water-soluble Polymer (19)

(kappa) κ-Carrageenan

Water-soluble Polymer (20)

Sumikagel L-5H (trade name: manufactured by Sumitomo Kagaku Co.)

Additive (21)

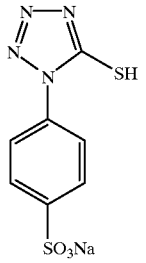

Matting Agent (22)

SYLOID79 (trade name: manufactured by Fuji Davisson Co.)

Surface-active Agent (23)

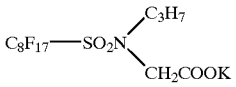

Surface-active Agent (24)

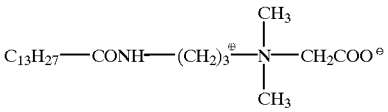

Hardner (25)

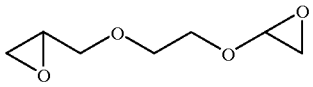

Water-soluble Polymer (26)

Dextran (molecular weight 70,000)

Water-soluble Polymer (27)

MP polymer MP102 (trade name: manufactured by Kurare Co.)

High-boiling Solvent (28)

EMPARA 40 (trade name: manufactured by Ajinomoto K.K.)

Additive (29)

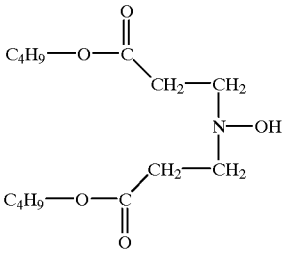

Light-sensitive materials 302 to 312 having the same composition as that of the light-sensitive material 301 were prepared, except that the couplers and the developing agents were changed, as shown in Table 14. The thus prepared light-sensitive materials 301 to 312 were exposed to light at 2,500 lux for 0.01 sec through B, G, and R filters, whose densities were changed continuously. Warm water at 40° C. was applied to each surface of the exposed light-sensitive materials, in an amount of 15 ml/m$^2$; the light-sensitive material and the processing sheet were put together with the coated surfaces in contact with each other; they were heated at 83° C. for 30 sec using a heat drum, to carry out heat development. After the processing, the image-receiving material was peeled off, to obtain respectively bright cyan, magenta, and yellow color images on the side of the light-sensitive material, which images correspond to each filter used to exposure. Immediately after the processing, the maximum density part (Dmax) and the minimum density part (Dmin) of yellow-dye image at B exposed part, magenta-dye image at G exposed part, and cyan-dye image at R exposed part, respectively, of these samples were measured by an X-rite density-measuring apparatus, and the results are shown in Table 15.

TABLE 14

| Light-sensitive material No. | Yellow coupler (mmol/m$^2$) | Coupler whose active-site is unsubstituted (mmol/m$^2$) | Developing agent (mmol/m$^2$) | Magenta coupler (mmol/m$^2$) | Coupler whose active-site is unsubstituted (mmol/m$^2$) | Developing agent (mmol/m$^2$) | Cyan coupler (mmol/m$^2$) | Coupler whose active-site is unsubstituted (mmol/m$^2$) | Developing agent (mmol/m$^2$) |
|---|---|---|---|---|---|---|---|---|---|
| 301 | Yellow coupler (3) (0.80) | — | Developing agent (4) (0.80) | Magenta coupler (2) (0.55) | — | Developing agent (4) (0.55) | Cyan coupler (1) (0.40) | — | Developing agent (4) (0.40) |
| 302 | Yellow coupler (3) | — | Developing agent (4) | Magenta coupler (2) | — | Developing agent (4) | Cyan coupler (1) | — | Developing agent (4) |

TABLE 14-continued

| Light-sensitive material No. | Yellow coupler (mmol/m$^2$) | Coupler whose active-site is unsubstituted (mmol/m$^2$) | Developing agent (mmol/m$^2$) | Magenta coupler (mmol/m$^2$) | Coupler whose active-site is unsubstituted (mmol/m$^2$) | Developing agent (mmol/m$^2$) | Cyan coupler (mmol/m$^2$) | Coupler whose active-site is unsubstituted (mmol/m$^2$) | Developing agent (mmol/m$^2$) |
|---|---|---|---|---|---|---|---|---|---|
| | (0.80) | | (0.96) | (0.55) | | (0.66) | (0.40) | | (0.48) |
| 303 | (D-6) | — | (18) | (D-21) | — | (18) | (D-24) | — | (70) |
| | (0.80) | | (0.80) | (0.55) | | (0.55) | (0.40) | | (0.40) |
| 304 | (D-6) | — | (18) | (D-21) | — | (18) | (D-24) | — | (70) |
| | (0.80) | | (0.96) | (0.55) | | (0.66) | (0.40) | | (0.48) |
| 305 | Yellow | (N-2) | Developing | Magenta | (N-19) | Developing | Cyan | (N-18) | Developing |
| | coupler (3) | (0.08) | agent (4) | coupler (2) | (0.055) | agent (4) | coupler (1) | (0.04) | agent (4) |
| | (0.80) | | (0.80) | (0.55) | | (0.55) | (0.40) | | (0.40) |
| 306 | Yellow | (N-2) | Developing | Magenta | (N-19) | Developing | Cyan | (N-18) | Developing |
| | coupler (3) | (0.16) | agent (4) | coupler (2) | (0.11) | agent (4) | coupler (1) | (0.096) | agent (4) |
| | (0.80) | | (0.96) | (0.55) | | (0.66) | (0.40) | | (0.48) |
| 307 | (D-6) | (N-10) | (18) | (D-21) | (N-10) | (18) | (D-24) | (N-10) | (70) |
| | (0.80) | (0.08) | (0.80) | (0.55) | (0.055) | (0.55) | (0.40) | (0.04) | (0.40) |
| 308 | (D-6) | (N-10) | (18) | (D-21) | (N-10) | (18) | (D-24) | (N-10) | (70) |
| | (0.80) | (0.16) | (0.96) | (0.55) | (0.11) | (0.66) | (0.40) | (0.096) | (0.48) |
| 309 | (D-12) | — | (76) | (D-18) | — | (79) | (D-25) | — | (4) |
| | (0.80) | | (0.80) | (0.55) | | (0.55) | (0.40) | | (0.40) |
| 310 | (D-12) | (N-8) | (76) | (D-18) | (N-14) | (79) | (D-25) | (N-15) | (4) |
| | (0.80) | (0.16) | (0.96) | (0.55) | (0.11) | (0.66) | (0.40) | (0.096) | (0.48) |
| 311 | (D-8) | — | (85) | (D-27) | — | (38) | (D-20) | — | (90) |
| | (0.80) | | (0.80) | (0.55) | | (0.55) | (0.40) | | (0.40) |
| 312 | (D-8) | (N-22) | (85) | (D-27) | (N-20) | (38) | (D-20) | (N-16) | (90) |
| | (0.80) | (0.24) | (0.96) | (0.55) | (0.28) | (0.66) | (0.40) | (0.08) | (0.48) |

TABLE 15

| Light sensitive-material No. | Yellow Dmax | Yellow Dmin | Magenta Dmax | Magenta Dmin | Cyan Dmax | Cyan Dmin |
|---|---|---|---|---|---|---|
| 301 | 1.22 | 0.32 | 1.15 | 0.27 | 1.33 | 0.30 |
| 302 | 1.29 | 0.33 | 1.22 | 0.29 | 1.40 | 0.32 |
| 303 | 1.28 | 0.32 | 1.35 | 0.28 | 1.28 | 0.33 |
| 304 | 1.34 | 0.34 | 1.42 | 0.30 | 1.35 | 0.35 |
| 305 | 1.21 | 0.29 | 1.15 | 0.25 | 1.31 | 0.28 |
| 306 | 1.27 | 0.29 | 1.21 | 0.26 | 1.38 | 0.28 |
| 307 | 1.25 | 0.28 | 1.33 | 0.24 | 1.25 | 0.29 |
| 308 | 1.31 | 0.28 | 1.40 | 0.24 | 1.31 | 0.30 |
| 309 | 1.22 | 0.24 | 1.29 | 0.29 | 1.42 | 0.42 |
| 310 | 1.22 | 0.21 | 1.28 | 0.25 | 1.43 | 0.32 |
| 311 | 1.38 | 0.30 | 1.40 | 0.33 | 1.28 | 0.29 |
| 312 | 1.36 | 0.26 | 1.40 | 0.28 | 1.29 | 0.26 |

From the results shown in Table 15, it can be understood that the present invention can lower the minimum density effectively while hardly lowering the maximum density. Further, each of yellow, magenta, and cyan does not have color muddiness and is formed brightly.

From the above results, the effect of the present invention is apparent.

Example 4

A paper base, both surfaces of which had been laminated with a polyethylene, was subjected to surface corona discharge treatment; then it was provided with a gelatin undercoat layer containing sodium dodecylbenzensulfonate, and it was coated with various photographic constitutional layers, to produce a multi layer color photographic printing paper, Sample (401), having the layer constitution shown below. The coating solutions were prepared as follows.

First-layer Coating Solution 22.3 g of a yellow coupler (EXY-1), 12.3 g of a color-developing agent (EXCD-1), and 80 g of a solvent (Solv-1) were dissolved in ethyl acetate, and the resulting solution was emulsified and dispersed into 16% aqueous gelatin solution containing 10% sodium dodecylbenzensulfonate and citric acid, to prepare an emulsified dispersion A. On the other hand, a silver chlorobromide emulsion A (cubes, a mixture of a large-size emulsion A having an average grain size of 0.88 $\mu$m, and a small-size emulsion A having an average grain size of 0.70 $\mu$m (3:7 in terms of mol of silver), the deviation coefficients of the grain size distributions being 0.08 and 0.10, respectively, and each emulsion having 0.3 mol % of silver bromide locally contained in part of the grain surface whose substrate was made up of silver chloride) was prepared. To the large-size emulsion A of this emulsion, had been added $1.4\times10^{-4}$ mol, per mol of silver, of each of blue-sensitive sensitizing dyes A, B, and C shown below, and to the small-size emulsion A of this emulsion, had been added $1.7\times10^{-4}$ mol, per mol of silver, of each of blue-sensitive sensitizing dyes A, B, and C shown below. The chemical ripening of this emulsion was carried out optimally with a sulfur sensitizer and a gold sensitizer being added. The above emulsified dispersion A and this silver chlorobromide emulsion A were mixed and dissolved, and a first-layer coating solution was prepared so that it would have the composition shown below. The coating amount of the emulsion is in terms of silver.

EXY-1

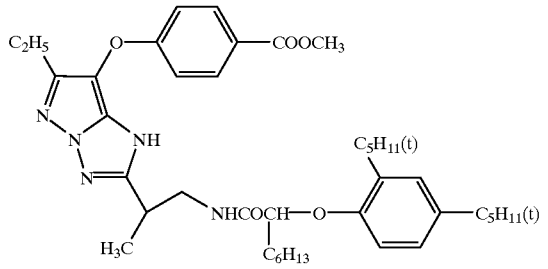

-continued

EXCD-1

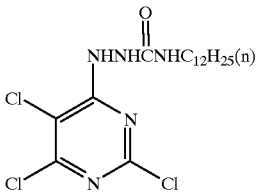

Solv-1

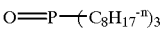

In the similar way as the method of preparing the first-layer coating solution, coating solutions for the second layer to the seventh layer were prepared. As the gelatin hardener for each layer, 1-oxy-3,5-dichloro-s-triazine sodium salt was used.

Further, to each layer, were added Cpd-2, Cpd-3, Cpd-4, and Cpd-5, so that the total amounts would be 15.0 mg/m$^2$, 60.0 mg/m$^2$, 50.0 mg/m$^2$, and 10.0 mg/m$^2$, respectively.

For the silver chlorobromide emulsion of the each light-sensitive emulsion layer, the following spectral sensitizing dyes were used.

BLUE-SENSITIVE EMULSION LAYER

Sensitizing Dye A

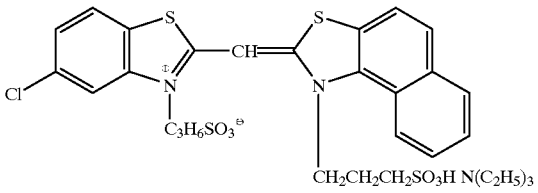

Sensitizing Dye B

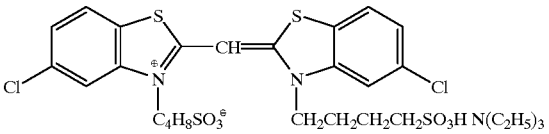

Sensitizing Dye C

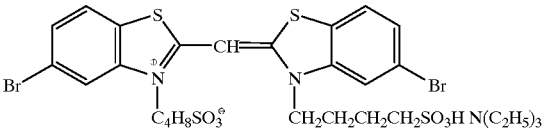

(Cpd-1) Surface-active Agent

7:3 mixture (by weight ratio) of

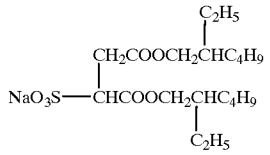

and

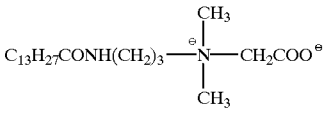

(Cpd-2) Antiseptic

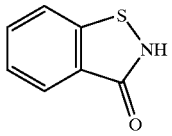

(Cpd-3) Antiseptic

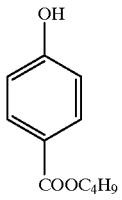

(Cpd-4) Antiseptic

1:1:1:1 mixture of a, b, c, d

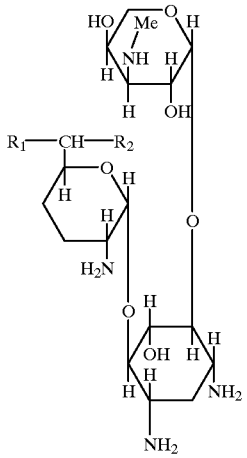

| | $R_1$ | $R_2$ |
|---|---|---|
| a | —Me | —NHMe |
| b | —Me | —$NH_2$ |
| c | —H | —$NH_2$ |
| d | —H | —NHMe |

(Cpd-5) Antiseptic

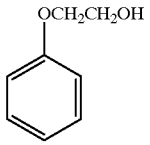

(Each was added to the large-size emulsion in an amount of $1.4\times10^{-4}$ mol per mol of the silver halide, and to the small-size emulsion in an amount of $1.7\times10^{-4}$ per mol of the silver halide.)

Green-sensitive emulsion layer

Sensitizing Dye D

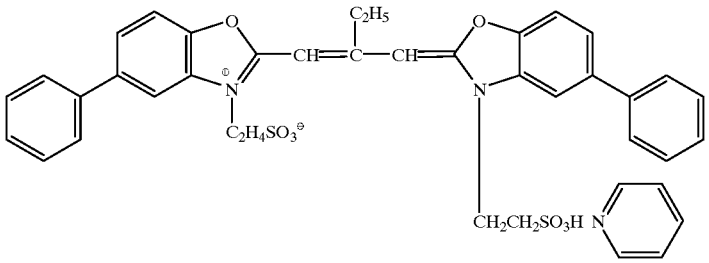

Sensitizing Dye E

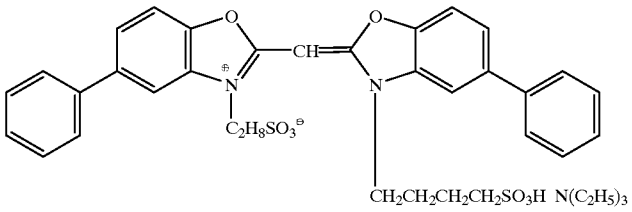

Sensitizing Dye F

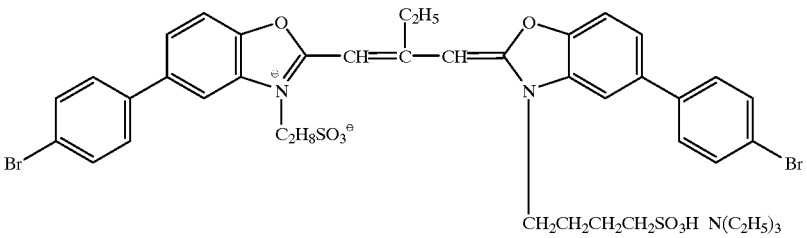

(The sensitizing dye D was added to the large-size emulsion in an amount of $3.0\times10^{-4}$ mol per mol of the silver halide, and to the small-size emulsion in an amount of $3.6\times10^{-4}$ mol per mol of the silver halide; the sensitizing dye E was added to the large-size emulsion in an amount of $4.0\times10^{-5}$ mol per mol of the silver halide, and to the small-size emulsion in an amount of $7.0\times10^{-5}$ mol per mol of the silver halide; and the sensitizing dye F was added to the large-size emulsion in an amount of $2.0\times10^{-4}$ mol per mol of the silver halide, and to the small-size emulsion in an amount of $2.8\times10^{-4}$ mol per mol of the silver halide.)

Red-sensitive emulsion layer
Sensitizing Dye G

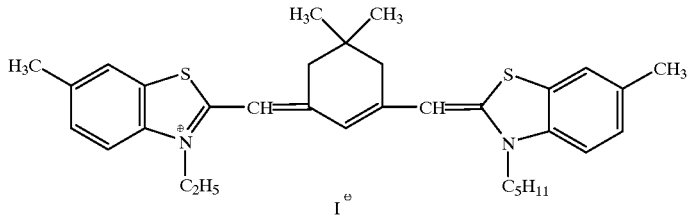

Sensitizing Dye H

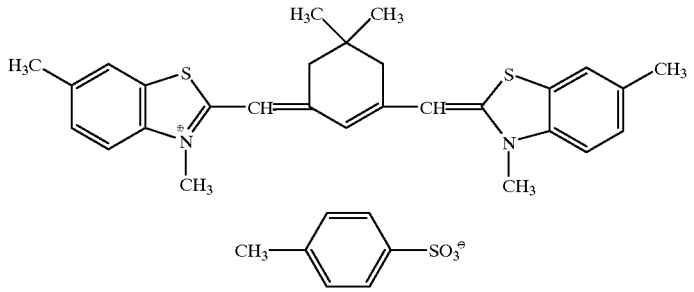

(Each was added to the large-size emulsion in an amount of $5.0\times10^{-5}$ mol per mol of the silver halide, and to the small-size emulsion in an amount of $8.0\times10^{-5}$ per mol of the silver halide.)

Further, the compound shown below was added in an amount of $2.6\times10^{-2}$ mol per mol of the silver halide.

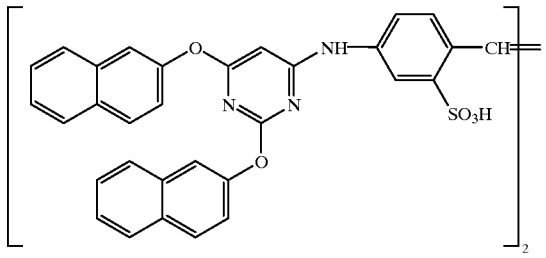

To the blue-sensitive emulsion layer, the green-sensitive emulsion layer, and the red-sensitive emulsion layer, was added 1-(5-methylureidophenyl)-5-mercaptotetrazole in amounts of $3.5\times10^{-4}$ mol, $3.0\times10^{-3}$ mol, and $2.5\times10^{-4}$ mol, respectively, per mol of the silver halide. Further, to the blue-sensitive emulsion layer and the green-sensitive emulsion layer, was added 4-hydroxy-6-methyl-1,3,3a,7-tetrazaindene in amounts of $1\times10^{-4}$ mol and $2\times10^{-4}$ mol, respectively, per mol of the silver halide.

Further, to prevent irradiation, the following dyes were added to the emulsion layers (the coating amount is shown in parentheses).

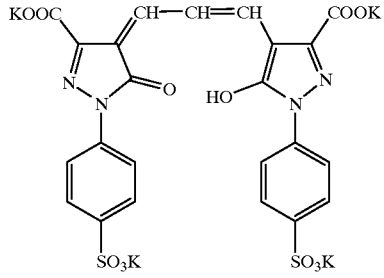

(10 mg/m$^2$)

and

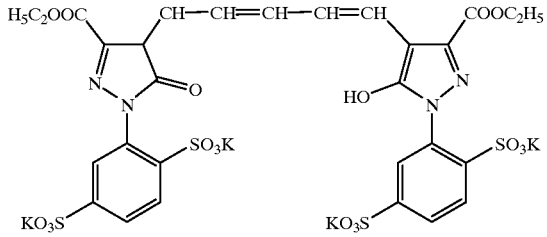

(40 mg/m$^2$)

Layer Constitution

The composition of each layer is shown below. The numbers show coating amounts (g/m$^2$). In the case of the silver halide emulsion, the coating amount is in terms of silver.

Base

Polyethylene-laminated Paper

[The polyethylene on the first layer side contained a white pigment ($TiO_2$) and a blue dye (ultramarine)]

First Layer (Blue-Sensitive Emulsion Layer)

| | |
|---|---|
| The above silver chlorobromide emulsion A | 0.40 |
| Gelatin | 3.00 |
| Yellow coupler (EXY-1) | 0.41 |
| Color-developing agent (EXCD-1) | 0.27 |
| Solvent (Solv-1) | 1.50 |

Second Layer (Color-Mixing Inhibiting Layer)

| | |
|---|---|
| Gelatin | 1.09 |
| Color-mixing inhibitor (Cpd-6) | 0.11 |
| Solvent (Solv-1) | 0.19 |
| Solvent (Solv-3) | 0.07 |
| Solvent (Solv-4) | 0.25 |
| Solvent (Solv-5) | 0.09 |

Third Layer (Green-Sensitive Emulsion Layer)

A silver chlorobromide emulsion: cubes, a mixture of a large-size emulsion B having an average grain size of 0.55 μm, and a small-size emulsion B having an average grain size of 0.39 μm (1:3 in terms of mol of silver). The deviation coefficients of the grain size distributions were 0.10 and 0.08, respectively, and each emulsion had 0.8 mol % of silver bromide locally contained in part of the grain surface whose substrate was made up of silver chloride 0.20.

| | |
|---|---|
| Gelatin | 1.50 |
| Magenta coupler (EXM-1) | 0.20 |
| Color-developing agent (EXCD-1) | 0.13 |
| Solvent (Solv-2) | 0.67 |

Fourth Layer (Color-Mixing Inhibiting Layer)

| | |
|---|---|
| Gelatin | 0.77 |
| Color-mixing inhibitor (Cpd-6) | 0.08 |
| Solvent (Solv-1) | 0.14 |
| Solvent (Solv-3) | 0.05 |
| Solvent (Solv-4) | 0.14 |
| Solvent (Solv-5) | 0.06 |

Fifth Layer (Red-Sensitive Emulsion Layer)

A silver chlorobromide emulsion: cubes, a mixture of a large-size emulsion C having an average grain size of 0.5 μm, and a small-size emulsion C having an average grain size of 0.41 μm (1:4 in terms of mol of silver). The deviation coefficients of the grain size distributions were 0.09 and 0.11, respectively, and each emulsion had 0.8 mol % of silver bromide locally contained in part of the grain surface whose substrate was made up of silver chloride 0.20.

| | |
|---|---|
| Gelatin | 0.15 |
| Cyan coupler (EXC-1) | 0.22 |
| Color-developing agent (EXCD-2) | 0.16 |
| Solvent (Solv-1) | 0.18 |

Sixth Layer (Ultraviolet Absorbing Layer)

| | |
|---|---|
| Gelatin | 0.64 |
| Ultraviolet absorbing agent (UV-1) | 0.39 |

-continued

| | |
|---|---|
| Color image stabilizer (Cpd-7) | 0.05 |
| Solvent (Solv-6) | 0.05 |

Seventh Layer (Protective Layer)

| | |
|---|---|
| Gelatin | 1.01 |

Acryl-modified copolymer of polyvinyl alcohol

| | |
|---|---|
| Acryl-modified copolymer of polyvinyl alcohol (modification degree: 17%) | 0.04 |
| Liquid paraffin | 0.02 |
| Surface-active agent (Cpd-1) | 0.01 |

(Cpd-6) Color-mixing Inhibitor mixture (by weight ratio) of (1):(2):(3)=1:1:1

(1)

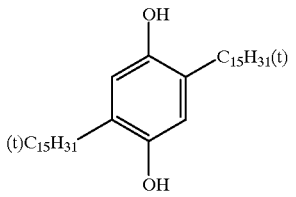

(2)

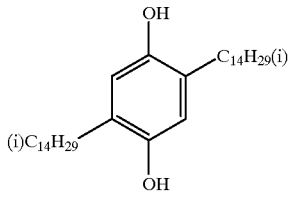

(3)

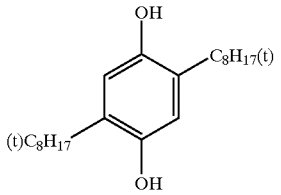

(Cpd-7) Color Image Stabilizer

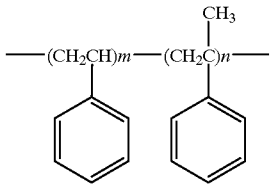

number-average
molecular weight 600
m/n = 9/1

(Solv-3) Solvent

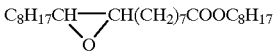

(Solv-4) Solvent

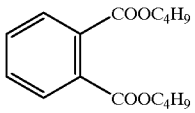

(Solv-5) Solvent

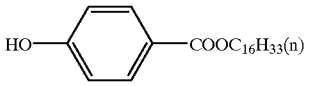

(Solv-2) Solvent

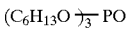

(Solv-6) Solvent

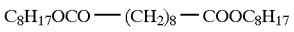

(UV-1) Ultraviolet Absorber (1)

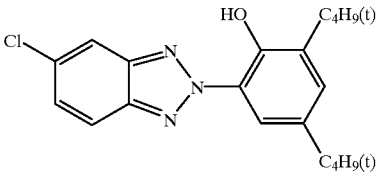

(2)

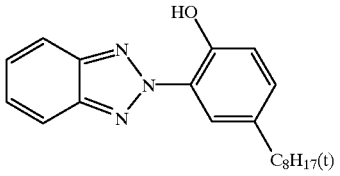

(3)

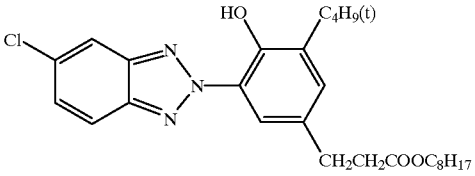

-continued (4)

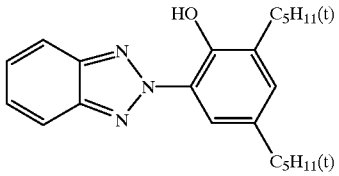

(5)

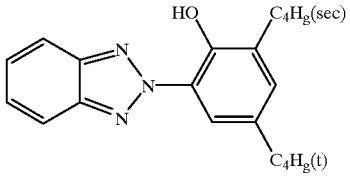

EXM-1

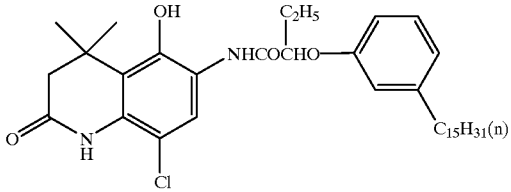

EXC-1

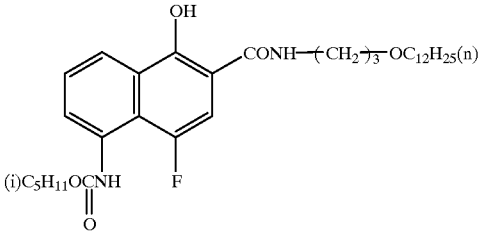

EXCD-2

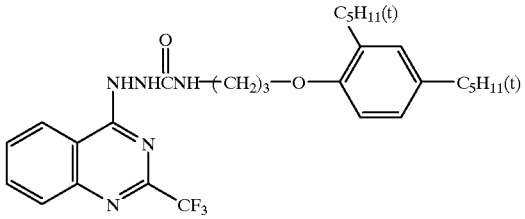

Samples (402) to (409) were prepared in the same manner as in Sample (401), except that instead of the coupler and the color-developing agent, the dye-forming coupler and the color-developing agent shown in Table 16 were used in the same molar amounts, and the couplers whose active site was unsubstituted were added in a ratio shown in Table 16.

TABLE 16

| Light-sensitive material No. | Dye-forming yellow coupler | Coupler whose active-site is unsubstituted (*) | Developing agent | Dye-forming magenta coupler | Coupler whose active-site is unsubstituted (*) | Developing agent | Dye-forming cyan coupler | Coupler whose active-site is unsubstituted (*) | Developing agent |
|---|---|---|---|---|---|---|---|---|---|
| 401 | EXY-1 | — | EXCD-1 | EXM-1 | — | EXCD-1 | EXC-1 | — | EXCD-2 |
| 402 | EXY-1 | (N-1) (5) | EXCD-1 | EXM-1 | (N-1) (5) | EXCD-1 | EXC-1 | (N-1) (5) | EXCD-2 |
| 403 | EXY-1 | (N-1) (10) | EXCD-1 | EXM-1 | (N-1) (10) | EXCD-1 | EXC-1 | (N-1) (10) | EXCD-2 |
| 404 | (D-3) | — | (20) | (D-18) | — | (20) | (D-25) | — | (1) |
| 405 | (D-3) | (N-3) (3) | (20) | (D-18) | (N-19) (3) | (20) | (D-25) | (N-17) (3) | (1) |
| 406 | (D-3) | (N-3) (6) | (20) | (D-18) | (N-19) (6) | (20) | (D-25) | (N-17) (6) | (1) |
| 407 | (D-11) | — | (82) | (D-27) | — | (72) | (D-24) | — | (88) |
| 408 | (D-11) | (N-11) (3) | (82) | (D-27) | (N-22) (5) | (72) | (D-24) | (N-21) (3) | (88) |
| 409 | (D-11) | (N-11) (6) | (82) | (D-27) | (N-22) (10) | (72) | (D-24) | (N-21) (6) | (88) |

(*): With figures in parentheses, the amount to be added of the coupler to the color-forming coupler are shown in mol %.

By using an FWH-type sensitometer (color temperature of the light source: 3,200° K), manufactured by Fuji Photo Film Co., Ltd., gradation exposure was given to all of the thus prepared Samples through a three-color-separation filter for sensitometry.

The thus exposed Samples were processed with the following processing solutions in the following processing steps:

| Processing step | Temperature | Time |
|---|---|---|
| Development | 40° C. | 15 sec |
| Bleach-fix | 40° C. | 45 sec |
| Rinse | room temperature | 45 sec |
| Alkali processing | room temperature | 30 sec |

Developing Solution

| | |
|---|---|
| Water | 800 ml |
| Potassium phosphate | 40 g |
| Disodium N,N-bis(sulfonatoethyl)hydroxylamine | 10 g |
| KCl | 5 g |
| Hydroxylethylidene-1,1-disulfonic acid (30%) | 4 ml |
| 1-Phenyl-4-methyl-4-hydroxylmethyl-3-pyrazolidone | 1 g |
| Water to make | 1,000 ml |
| pH (at 25° C. by using potassium hydroxide) | 12.0 |

Bleach-fix Solution

| | |
|---|---|
| Water | 600 ml |
| Ammonium thiosulfate (700 g/liter) | 93 ml |
| Ammonium sulfite | 40 ml |
| Ethylenediaminetetraacetic acid iron(III) ammonium salt | 55 g |
| Ethylenediaminetetraacetic acid | 2 g |
| Nitric acid (67%) | 30 g |
| Water to make | 1,000 ml |
| pH (at 25° C. by using acetic acid and ammonia water) | 5.8 |

Rinsing Solution

| | |
|---|---|
| Sodium chlorinated isocyanurate | 0.02 g |
| Deionized water (conductivity: 5 μS/cm or below) | 1,000 ml |
| pH | 6.5 |

Alkali Processing Solution 0.1 N Sodium Hydroxide

The maximum color density (Dmax) part of the processed Samples was measured using red light, green light, and blue light. The results are shown in Table 17.

TABLE 17

| Light sensitive-material No. | Yellow Dmax | Yellow Dmin | Magenta Dmax | Magenta Dmin | Cyan Dmax | Cyan Dmin |
|---|---|---|---|---|---|---|
| 401 | 1.58 | 0.16 | 1.67 | 0.17 | 1.71 | 0.18 |
| 402 | 1.56 | 0.14 | 1.65 | 0.15 | 1.68 | 0.15 |
| 403 | 1.55 | 0.13 | 1.63 | 0.14 | 1.60 | 0.14 |
| 404 | 1.65 | 0.19 | 1.42 | 0.15 | 1.77 | 0.22 |
| 405 | 1.62 | 0.15 | 1.41 | 0.13 | 1.75 | 0.17 |
| 406 | 1.61 | 0.13 | 1.38 | 0.12 | 1.71 | 0.15 |
| 407 | 1.65 | 0.18 | 1.74 | 0.18 | 1.62 | 0.17 |
| 408 | 1.64 | 0.16 | 1.70 | 0.16 | 1.59 | 0.16 |
| 409 | 1.61 | 0.15 | 1.65 | 0.14 | 1.56 | 0.15 |

As is apparent from the results shown in Table 17, it can be understood that the light-sensitive material of the present invention can lower the minimum density substantially without impairing the maximum density. Further, each of yellow, magenta, and cyan is reproduced brightly in comparison with Comparative Examples. From the above results, the effect of the present invention is apparent.

Having described our invention as related to the present embodiments, it is our intention that the invention not be limited by any of the details of the description, unless otherwise specified, but rather be construed broadly within its spirit and scope as set out in the accompanying claims.

What we claim is:

1. A method for forming an image, comprising the steps of image-wise exposing to light a silver halide color photographic heat-development light-sensitive material and subjecting said material to heat-development at a temperature of 60 to 150° C., the silver halide color photographic heat-development light-sensitive material comprising a light-sensitive silver halide emulsion layer, and containing a compound represented by formula (I) and a compound represented by formula (II) in at least one hydrophilic colloid layer provided on a base:

formula (I)

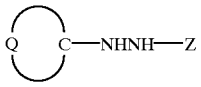

formula (II)

$C_p$-(Time)$_t$-PUG in formula (I), Z represents a carbamoyl group, and Q represents a group of atoms that, together with the C, form an unsaturated ring;

in formula (II), $C_p$ represents a group that undergoes a coupling reaction with an oxidation product of the compound represented by formula (I), (Time)$_t$—PUG represents a group that is released from $C_p$ as a result of the coupling reaction, Time represents a group that releases PUG upon being released from $C_p$, PUG represents a photographically useful group, and t is 0, 1, 2, or 3.

2. The method for forming an image as claimed in claim 1, wherein the silver halide color photographic heat-devlopment light-sensitive material is subjected to development under alkali generation from a slightly soluble metal salt and a complexing agent of the said metal salt.

3. A method for forming an image, comprising the steps of image-wise exposing to light a silver halide color photographic beat-development light-sensitive material and subjecting said material to heat-development at a temperature of 60 to 150° C., the silver halide color photographic heat-development light-sensitive material comprising a light-sensitive silver halide emulsion layer, containing a color-developing agent represented by formula (I) and a dye-forming coupler that undergoes coupling reaction with an oxidation product of the color-developing agent to form a dye image, in at least one hydrophilic colloid layer provided on a base, and the silver halide photographic light-sensitive material further containing a coupler that undergoes coupling reaction with an oxidation product of the color-developing agent but does not form color enough to substantially contribute to image density:

formula (I)

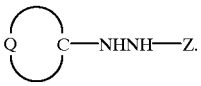

in formula (I), Z represents a carbamoyl group, and Q represents a group of atoms that, together with the C, form an unsaturated ring.

4. The method for forming an image as claimed in claim 3, wherein the coupler that undergoes coupling reaction with an oxidation product of the color-developing agent but does not form color enough to substantially contribute to image density, is a coupler whose active site is unsubstituted.

* * * * *